US007868880B2

(12) United States Patent
Ozaki et al.

(10) Patent No.: US 7,868,880 B2
(45) Date of Patent: Jan. 11, 2011

(54) DISPLAY APPARATUS AND DRIVE CONTROL METHOD THEREOF

(75) Inventors: Tsuyoshi Ozaki, Fuchu (JP); Jun Ogura, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 1056 days.

(21) Appl. No.: 11/438,967

(22) Filed: May 23, 2006

(65) Prior Publication Data

US 2006/0267886 A1 Nov. 30, 2006

(30) Foreign Application Priority Data

May 24, 2005 (JP) ..... 2005-150566
May 26, 2005 (JP) ..... 2005-153382

(51) Int. Cl.
*G09G 5/00* (2006.01)

(52) U.S. Cl. ..... 345/204; 345/100; 345/207; 345/210; 345/211; 345/690

(58) Field of Classification Search ..... 345/76–84, 345/87–104, 204–215, 690–699; 315/169.1–169.4
See application file for complete search history.

(56) References Cited

U.S. PATENT DOCUMENTS 7,071,932 B2 * 7/2006 Libsch et al. ..... 345/211
7,248,237 B2 * 7/2007 Yamada et al. ..... 345/76
7,345,685 B2 * 3/2008 Miyazawa ..... 345/207
7,348,942 B2 3/2008 Jo
7,362,288 B2 4/2008 Jang
2003/0095087 A1 5/2003 Libsch et al.

(Continued)

FOREIGN PATENT DOCUMENTS

JP 2004-252104 A 9/2004

(Continued)

OTHER PUBLICATIONS

Notification Concerning Transmittal of International Search Report and Written Opinion of the International Searching Authority for PCT/JP2006/310616, dated Mar. 15, 2007, 23 sheets.

(Continued)

*Primary Examiner*—Vijay Shankar
(74) *Attorney, Agent, or Firm*—Holtz, Holtz, Goodman & Chick, PC

(57) ABSTRACT

A display apparatus is disclosed. A display panel includes a plurality of display pixels arranged at intersections of a plurality of scanning lines and a plurality of data lines. A scanning drive unit sequentially applies a scanning signal to each of the scanning lines and sets the corresponding display pixels to a selection state. A data drive unit generates a gradation signal corresponding to the display data and supplies the gradation signal to the display pixels. A power source drive unit supplies to the display pixels a drive voltage for controlling a drive state of each of the display pixels. A drive control unit controls the power source drive unit to operate to set the display pixels to a non-display operation state during a non-display period, and controls the scanning drive unit to operate to set the display pixels to the selection state during the non-display period.

40 Claims, 27 Drawing Sheets

U.S. PATENT DOCUMENTS

| | | | |
|---|---|---|---|
| 2004/0090434 | A1 | 5/2004 | Miyazawa |
| 2004/0256617 | A1 | 12/2004 | Yamada et al. |
| 2005/0057454 | A1 | 3/2005 | Jang |
| 2006/0017668 | A1 | 1/2006 | Shirasaki et al. |

FOREIGN PATENT DOCUMENTS

| | | | |
|---|---|---|---|
| JP | 2004-287349 | A | 10/2004 |
| JP | 2004-341267 | A | 12/2004 |
| JP | 2005-006250 | A | 1/2005 |
| JP | 2005-099773 | A | 4/2005 |
| JP | 2005-107233 | A | 4/2005 |
| KR | 2003-0032530 | A | 4/2003 |
| WO | WO 2004/019314 | A1 | 3/2004 |
| WO | WO 2004/086347 | A2 | 10/2004 |

OTHER PUBLICATIONS

Korean Office Action (and English translation thereof) dated Sep. 30, 2008, issued in a counterpart Korean Application.

Japanese Office Action dated May 13, 2010 and English translation thereof in counterpart Japanese Application No. 2005-150566.

Japanese Office Action dated May 25, 2010 and English translation thereof in counterpart Japanese Application No. 2005-153382.

Japanese Office Action dated Jul. 30, 2010 and English translation thereof, issued in counterpart Japanese Application No. 2005-150566.

* cited by examiner

DISPLAY APPARATUS AND DRIVE CONTROL METHOD THEREOF

CROSS-REFERENCE TO RELATED APPLICATIONS

This application is based upon and claims the benefit of priority from prior Japanese Patent Applications No. 2005-150566, filed May 24, 2005; and No. 2005-153382, filed May 26, 2005, the entire contents of both of which are incorporated herein by reference.

BACKGROUND OF THE INVENTION

1. Field of the Invention

The present invention relates to a display apparatus and a display drive method thereof. In particular, the invention relates to a display apparatus and a drive control method thereof, the apparatus being provided with a display panel having a plurality of current control type optical elements arranged thereon to display image information.

2. Description of the Related Art

In recent years, light weight and thin type display devices which consume a lower amount of electric power are conspicuously prevalent as monitors and displays of personal computers and video equipment. In particular, liquid crystal display (LCD) apparatuses are widely applied as display devices for mobile phones, digital cameras, personal data assistants (PDA's), and portable devices (mobile handsets) such as electronic dictionaries.

As a next-generation display device which follows such an LCD apparatus, research and development have been briskly made toward a full-scale popularization of a self-luminous type display device (a self-luminous type display) provided with a display panel in which organic electroluminescent elements (organic EL elements), inorganic electroluminescent element (inorganic EL elements) or self-luminous type optical elements such as light emitting diodes (LED) are arranged in a matrix form.

In particular, a self-luminous type display apparatus to which an active matrix drive mode is applied has a higher display response speed than that of the above-described liquid crystal display. Further, the self-luminous type display apparatus does not have view field angle dependency, and can achieve an increase in luminance/contrast and in fineness of a display image quality. Furthermore, the self-luminous type display apparatus does not require the backlight used in a liquid crystal display, and hence the self-luminous type display has very advantageous characteristics in the application to portable devices that a further reduction in a thickness and a weight and/or a further decrease in power consumption is possible.

FIG. 25 is schematic structural diagram showing a primary part of an active matrix type self-luminous type display apparatus in a prior art.

FIG. 26 is a timing chart showing one example of a display drive method of the active matrix type self-luminous type display apparatus in the prior art.

FIG. 27 is a timing chart showing another example of the active matrix type self-luminous type display apparatus in the prior art.

Here, in FIGS. 26 and 27, for ease of comparison with embodiments which will be described later, there is shown a display drive method in the case where the apparatus has a configuration in which a display panel has twelve rows (first to twelfth rows) of display pixels arranged. In FIGS. 26 and 27, symbol K denotes a positive integer. Incidentally, hatching is provided for clarifying a writing operation and display operation of image data in each row, and writing operation and display operation of blanking data.

An active matrix type display apparatus such as a liquid crystal display apparatus and a self-luminous type display apparatus generally has, as shown in FIG. 25, a configuration comprising: a display panel 110P in which a plurality of display pixels EMp are arranged in two dimensions in the vicinity of intersections of a plurality of scanning lines SLp and data lines DLp arranged in row and column directions; a scanning driver 120P which is connected with the scanning lines SLp; and a data driver 140P which is connected with the data lines DL.

For example, as shown in FIG. 26, in a display drive control in the display apparatus having such a configuration, display pixels EMp for each row are sequentially set to a selection state by sequentially applying a selection level scanning signal Ssel to the scanning lines SLp in each row from the scanning driver 120P in the beginning. Then, in synchronization with the selection timing of each row, a gradation voltage Vpix corresponding to image data (display data) in the row is applied to the data line DLp in each column from the data driver 140P, whereby a voltage component based on the gradation voltage Vpix is held to each of the display pixels EMp (a image data writing period). As a consequence, a gradation control corresponding to the above-described voltage component is performed in each display pixel EMp, so that a display operation (light emitting operation) corresponding to the image data is performed and desired image information is displayed on the display panel.

Subsequently, the display pixels EMp for each row are set to a non-selection state by sequentially applying a non-selection level scanning signal Ssel to the scanning lines SLp from the scanning driver 120P. However, when the voltage component written immediately previously is held in each of the display pixels, the display operation corresponding to the image data continues (a image display period), and the operation continues until next image data is written in the display pixels EMp in each row. This type of display control method is referred to as a hold type.

In such a hold type display control method, there is provided a characteristic such that flickering is hardly generated in the display operation of static images because the display operation (the light emitting operation) corresponding to the image data continues in almost all the period of one frame period. However, on the other hand, in the display of moving images, image information displayed in the previous frame period can become visually recognized more easily as an afterimage, and consequently, blurs and stains of the image information occur, which will lead to the deterioration of display image quality.

Then, as a display drive method for improving the display image quality by suppressing blurs and stains in the display operation of moving images, there is known a technique for performing, in one frame period, an operation (a blanking data writing period) of supplying from a data driver to each data line blanking data for performing an operation (a light emitting operation) of displaying each display pixel EMp at the lowest gradation, or for performing a non-display operation (a non-light emitting operation) and a black display operation (a black display period) based on the blanking data, in addition to the above-described image data writing period and image display period. As a consequence, a definite length of a black display period is inserted into the one frame period and a blank display state is set. Accordingly, a display drive method (referred to as a "pseudo-impulse type display drive method" for convenience) in which the image display period is relatively reduced can be realized and a display image quality in the display operation of moving images can be improved.

However, in such a pseudo-impulse type display drive method, as shown in FIG. 27, it is required to set, in one frame period, the writing period of the blanking data supplied from the data driver and the black display period as well as the writing period of the image data supplied from the data driver and the image display period. For this reason, only the writing operation of the image data supplied from the data driver and the image display operation are performed in one frame period as shown in FIG. 26. As compared with the case in which the black display operation is not performed, the time which can be allocated to the writing operation of the image data is shortened, and as a consequence, it becomes necessary to write the image data at a high speed by heightening a drive frequency (that is, the drive frequency of the display apparatus) associated with the writing operation of the image data.

In this manner, when the writing period of the image data (display data) is shortened so that the writing operation must be performed at a high rate, a writing insufficiency occurs owing to the insufficiency of the time for writing the image data to each display pixel with respect to a signal delay generated resulting from a CR time constant produced by a resistance component parasitic on signal wirings of a display panel and a capacity component, etc. Consequently, gradation display corresponding to the image data may not be executed properly.

BRIEF SUMMARY OF THE INVENTION

The present invention has an advantage in that the invention can provide a display apparatus which comprises an active matrix type display panel and displays image information corresponding to display data, the apparatus being capable of displaying moving images with a favorable display quality while being capable of displaying image information at an appropriate gradation corresponding to the display data, and also can provide a display drive method thereof.

A display apparatus according to the present invention to obtain the above advantage comprises: a display panel including a plurality of display pixels arranged thereon in vicinities of respective intersections of a plurality of scanning lines arranged in a row direction and a plurality of data lines arranged in a column direction; a scanning drive unit which sequentially applies a scanning signal to each of said plurality of scanning lines and sets the display pixels corresponding to each the scanning line to a selection state; a data drive unit which generates a gradation signal corresponding to the display data and supplies the gradation signal to the display pixels set to the selection state; a power source drive unit which supplies to the display pixels a drive voltage for controlling a drive state of each of the display pixels; and a drive control unit which: (i) controls the power source drive unit to operate to set the display pixels to a non-display operation state during a non-display period in which the display pixels do not display the display data, and (ii) controls the scanning drive unit to operate to set the display pixels to the selection state during the non-display period.

A drive control method of controlling a display apparatus according to the present invention to obtain the above advantage, in which the display apparatus comprises a display panel including a plurality of display pixels arranged thereon in vicinities of intersections of a plurality of scanning lines arranged in a row direction and a plurality of data lines arranged in a column direction, the method comprising: sequentially setting the display pixels to a selection state, row by row; sequentially supplying a gradation signal corresponding to the display data to the display pixels, row by row, in each row set to the selection state; setting each of the display pixels to a display operation state in a bias state corresponding to the gradation signal; and setting the display pixels to a non-display operation state in a non-display period in which the display pixels do not display the display data; wherein the display pixels are set to the selection state while set in the non-display operation state.

DETAILED DESCRIPTION OF THE INVENTION

Hereinafter, a display apparatus according to the present invention and a drive control method thereof will be explained in detail on the basis of embodiments shown in the figure.

First Embodiment

Figure 1:
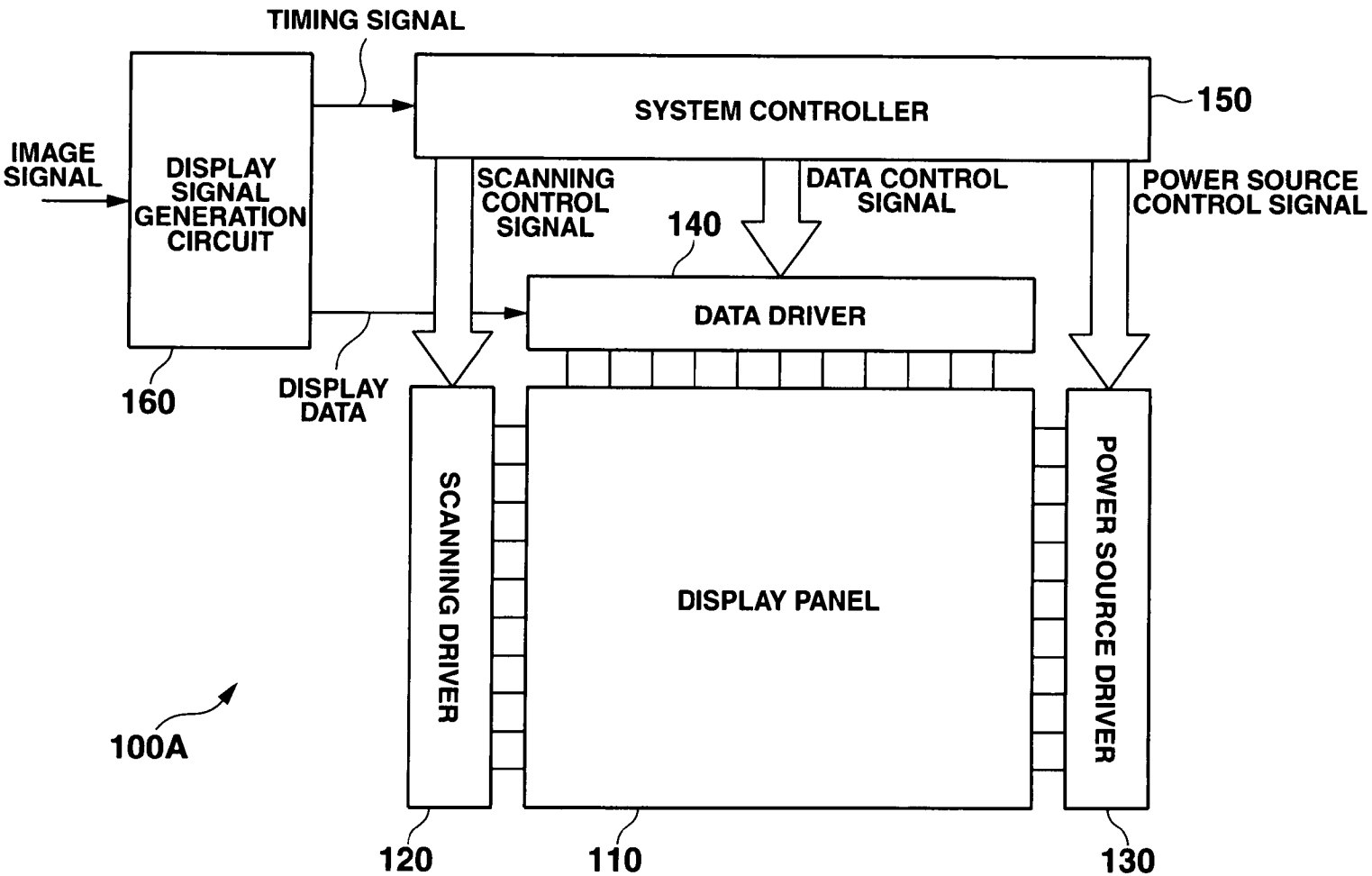
FIG. 1 is a schematic block diagram showing a first embodiment of a display apparatus according to the present invention.

First, a schematic configuration of a display apparatus according to a first embodiment will be explained with reference to the drawings. FIG. 1 is a schematic block diagram showing the first embodiment of the display apparatus according to the invention.

Figure 2:
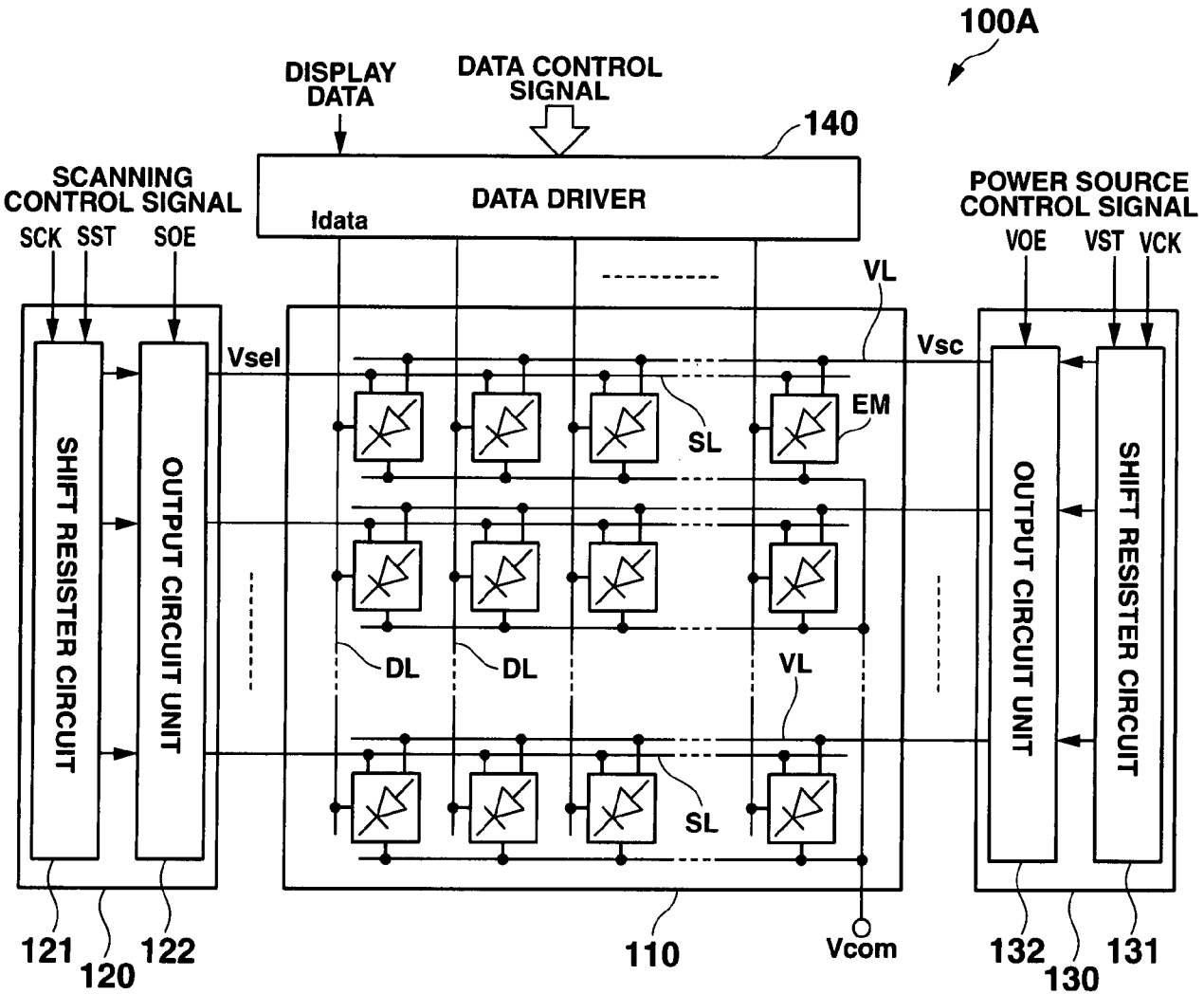
FIG. 2 is a structural diagram of a primary part, showing one example of a display panel applied to the display apparatus according to the first embodiment and a peripheral circuit thereof.

FIG. 2 is a structural diagram of a primary part, showing one example of a display panel applied to the display apparatus according to the first embodiment and a peripheral circuit thereof.

Incidentally, in the embodiment shown hereinbelow, there will be explained a self-luminous type display apparatus wherein a display panel has a configuration in which a plurality of display pixels provided with self-luminous type light emitting elements are arranged in two dimensions as optical elements, the display apparatus displaying image information by allowing the optical elements of each of the display pixels to perform a light emitting operation with a luminance gradation corresponding to display data (image data). However, the present invention is not limited thereto. Like a liquid crystal display apparatus, a display apparatus may be permissible which provides a gradation display (display operation) of desired image information by means of transmitting light or reflecting light in such a manner that each display pixel is gradation-controlled in accordance with display data (set to a bias state in accordance to the display data).

As shown in FIGS. 1 and 2, a display apparatus 100A according to the present embodiment comprises a display panel 110, a scanning driver (a scanning drive unit) 120, a power source driver (a power source drive unit) 130, a data driver (a data drive unit) 140, a system controller (a drive control unit) 150, and a display signal generation circuit 160. The display panel 110 has a plurality of display pixels EM arranged thereon in the vicinity of intersections of a plurality of scanning lines SL and a plurality of data lines DL arranged so as to generally extend at right angles to each other in row and column directions, the pixels being provided with a display drive circuit described later and a light emitting element. The scanning driver 120 is connected with the scanning lines SL of the display panel 110, and sequentially applies a selection level (high level) scanning signal Vsel at a predetermined timing for the scanning lines SL, thereby setting display pixels EM for each row to a selection state. The power source driver 130 is connected with a plurality of power source lines VL arranged in parallel to the scanning lines SL in each row, and sequentially applies a drive voltage Vsc at a predetermined timing for the power source lines VL. The data driver 140 is connected with the data lines DL of the display panel 110, and supplies a gradation signal (gradation current Idata) corresponding to display data to the display pixels EM via each of the data lines DL. The system controller 150 controls an operation state of at least the scanning driver 120, the power source driver 130 and the data driver 140 on the basis of a timing signal supplied from a display signal generation circuit 160 described later to generate and output a scanning control signal, a power source control signal and a data control signal for performing a predetermined image display operation in the display panel 110. The display signal generation circuit 160 generates display data and supplies the data to the data driver 140 on the basis of a image signal supplied, for example, from the outside of the display apparatus 100A, and also extracts or generates a timing signal (a system clock or the like) for displaying predetermined image information on the display panel 110 on the basis of the display data to supply the timing signal to the system controller 150.

Next, each of the above-described configurations will be specifically explained.

(Display Panel and Display Pixel)

Figure 3:
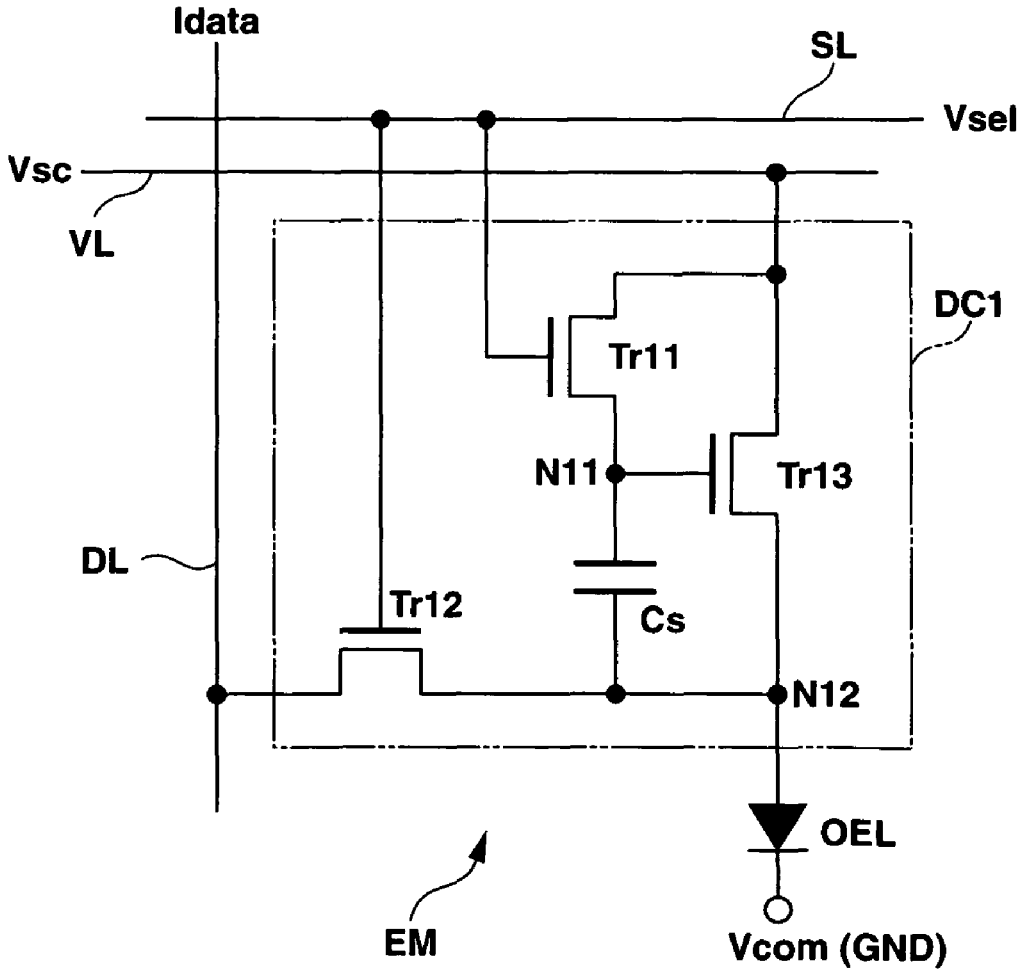
FIG. 3 is a circuit structural diagram showing one example of a display pixel applied to a display apparatus according to the first embodiment.

FIG. 3 is a circuit structural diagram showing one example of a display pixel (a display drive circuit) which is applied to the display apparatus according to the present embodiment.

Incidentally, in the present embodiment, there will be explained a case in which there is provided a circuit configuration (a display drive circuit) corresponding to a drive control method of a current gradation designation system. The drive control method allows a display drive current having a current value corresponding to display data to flow in a light emitting element provided on each display pixel by supplying a gradation current having a current value corresponding to the display data as a display pixel, thereby performing a light emitting operation (a display operation) with a desired luminance gradation. However, the present invention is not limited thereto. For example, the present invention may have a circuit configuration corresponding to a drive control method of voltage gradation designation system. The drive control method allows a display drive current having a current value corresponding to display data to flow in a light emitting element of each display pixel by applying a gradation voltage having a voltage value corresponding to the display data, thereby performing a light emitting operation with a desired luminance gradation.

The display panel 110 which is applied to the display apparatus 110A according to the present invention sequentially allows the display pixels EM in each row to perform a non-light emitting operation (a non-display operation) in a predetermined period by, for example, sequentially shutting down the application of the drive voltage for display drive to the display pixels EM for each row in the beginning in a plurality of display pixels EM arranged in two dimensions in row and column directions. Thereafter, a writing operation of the display data is sequentially performed, so that the display pixels EM for each row are controlled to sequentially perform a light emitting operation (a display operation) with a predetermined luminance gradation.

As a configuration for attaining such an object, with respect to the display pixels EM arranged in the display panel 110 according to the present embodiment, a configuration can be applied which comprises a display drive circuit DC1 and a known organic EL element (a light emitting element) OEL as shown in, for example, FIG. 3. The display drive circuit DC1 sets the display pixels EM to a selection state on the basis of the scanning signal Vsel generally applied from the scanning driver 120, fetches the gradation signal (the gradation current Idata) supplied from the data driver 140 in the selection state, and generates a display drive current corresponding to the gradation signal. The organic EL element OEL performs a light emitting operation with a predetermined luminance gradation on the basis of the display drive current supplied from the display drive circuit DC1.

The display drive circuit DC1 according to the present embodiment has, as shown in FIG. 3 specifically, a configuration which comprises a thin film transistor (a writing control circuit, a second switching circuit) Tr11, a thin film transistor (a writing control circuit, a third switching circuit) Tr12, a thin film transistor (a control circuit, a first switching circuit, a display drive circuit) Tr13, and a capacitor (an electric charge accumulation circuit, a capacitance element) Cs. In the thin film transistor Tr11, a gate terminal (a control terminal) is connected with a scanning line SL, and a drain terminal and a source terminal (first end and second end of a conduction channel) are connected respectively to a power source line VL to which a predetermined voltage Vsc is applied and a contact point N11. In the thin film transistor Tr12, a gate terminal (a control terminal) is connected with the scanning line SL, and a source terminal and a drain terminal (first end and second end of a conduction channel) are connected respectively to the power source line VL and a contact point N12. In the thin film transistor Tr13, a gate terminal (a control terminal) is connected with the contact point N11, and a drain terminal and a source terminal (one end an the other end of a conduction channel) are connected respectively to the power source line VL and the contact point (connection contact point) N12. The capacitor Cs is connected between the contact point N11 and the contact point N12 (between the gate and source terminals of the thin film transistor Tr13).

Furthermore, in the organic EL element OEL, an anode terminal is connected with the contact point N12 of the display drive circuit DC1 whereas a common voltage Vcom is applied to a cathode terminal. Here, the common voltage Vcom is set to an arbitrary potential (for example, a ground potential GND). The common voltage Vcom is set to be equipotential to a drive voltage Vsc (=Vs) set to a low level in the writing operation period in which the gradation signal (the gradation current Idata) corresponding to the display data is supplied to the display pixels EM (the display drive circuit DC1) and in the non-light emitting operation period (the non-display operation period) in which the organic EL element (the light emitting element) OEL is not allowed to perform the light emitting operation. Alternatively, the common voltage Vcom is set to an arbitrary potential (for example, a ground potential GND) which is a potential set to be higher than the drive voltage Vsc and which becomes a potential lower than the drive voltage Vsc (=Ve) set to a high level in the light emitting operation period (the display operation period) in which the display drive current is supplied to the organic EL element (the light emitting element) OEL so that the organic EL element (the light emitting element) performs the light emitting operation with a predetermined luminance gradation ($Vs \leqq Vcom \leqq Ve$).

Here, the capacitor Cs may be a parasitic capacitance which is formed between the gate and the source of the thin film transistor Tr13, or a capacitance element may be further connected in parallel between the contact point N11 and the contact point N12 in addition to the parasitic capacitance.

Furthermore, the thin film transistors Tr11 to Tr13 are not particularly limited. For example, an n-channel type amorphous silicon thin film transistor can be applied by constituting the thin film transistors Tr11 to Tr13 all with a single channel type thin film transistor (an electric field effect type transistor).

In this case, the display drive circuit comprising amorphous silicon thin film transistors having uniform and stable element characteristics can be manufactured in a relatively easy manufacturing process by applying an already established amorphous silicon manufacturing technique. Incidentally, in the following explanation, there will be explained a case in which the thin film transistors Tr11 to Tr13 are constituted all with n-channel type thin film transistors as one structural example of the display drive circuit DC1.

In addition, in the above-described case, the organic EL element OEL is used as the light emitting element which is display-driven by the display drive circuit DC1. However, the light emitting element in the present invention is not limited to the organic EL element OEL. As long as the light emitting element is a current control type light emitting element, another type of light emitting element such as a light emitting diode may be used. Furthermore, in the present embodiment, there will be explained a case in which image information is displayed by display-driving the current control type light emitting element by the display drive circuit DC1. A configuration for generating a voltage component corresponding to display data to display-drive the voltage control type light emitting element, and a circuit configuration for changing an orientation state of liquid crystal molecules may be provided.

(Scanning Driver)

The scanning driver 120 sets the display pixels EM for each row to a selection state by applying the selection level scanning signal Vsel to each scanning line SL on the basis of the scanning control signal supplied from the system controller 150. More specifically, an operation of applying the scanning signal Vsel to the scanning lines SL in each row is performed with a shift of timing for preventing the mutual overlapping of operations in terms of time to sequentially set the display pixels EM for each row to a selection state.

Here, as shown in, for example, FIG. 2, the scanning driver 120 has a configuration which comprises a known shift register 121 and an output circuit unit (an output buffer) 122. The shift register 121 sequentially outputs a shift signal corresponding to the scanning line SL in each row on the basis of a scanning clock signal SCK and a scanning start signal SST which are supplied from the system controller 150 described later as scanning control signals. The output circuit unit 122 converts the shift signal output from the shift register 121 to a predetermined signal level (on-level) signal to output the converted signals to the scanning lines SL as the scanning signals Vsel on the basis of an output control signal SOE supplied from the system controller 150 as a scanning control signal.

(Power Source Driver)

The power source driver 130 applies a high level drive voltage (a first voltage) Vsc (=Ve) to the power source line VL in the row only in the light emitting operation period with respect to the display pixels EM in each row on the basis of the power source control signal supplied from the system controller 150, and applies a low level drive voltage (a second voltage) Vsc (=Vs) in the other operation period (the non-light emitting period (the non-display operation) period) than the light emitting operation (the display operation) period. In this case, an operation of applying the low level drive voltage Vsc becomes substantially equivalent to an operation of shutting down the supply of the drive voltage Vsc to the display pixels EM (the display drive circuit DC1).

As shown in, for example, FIG. 2, the power source driver 130 has a configuration which comprises a known shift register 130 and an output circuit unit 132, as in the scanning driver 120 described above. The shift register 130 sequentially outputs a shift signal corresponding to the power source line VL in each row on the basis of a clock signal VCK and a start signal VST which are supplied as power source control signals from the system controller 150. The output circuit unit 132 converts the shift signals to predetermined voltage levels (voltage values Ve, Vs) to output the converted signals to the power source lines VL as the drive voltage Vsc on the basis of the output control signal VOE supplied as the power source control signal.

(Data Driver)

Figure 4:
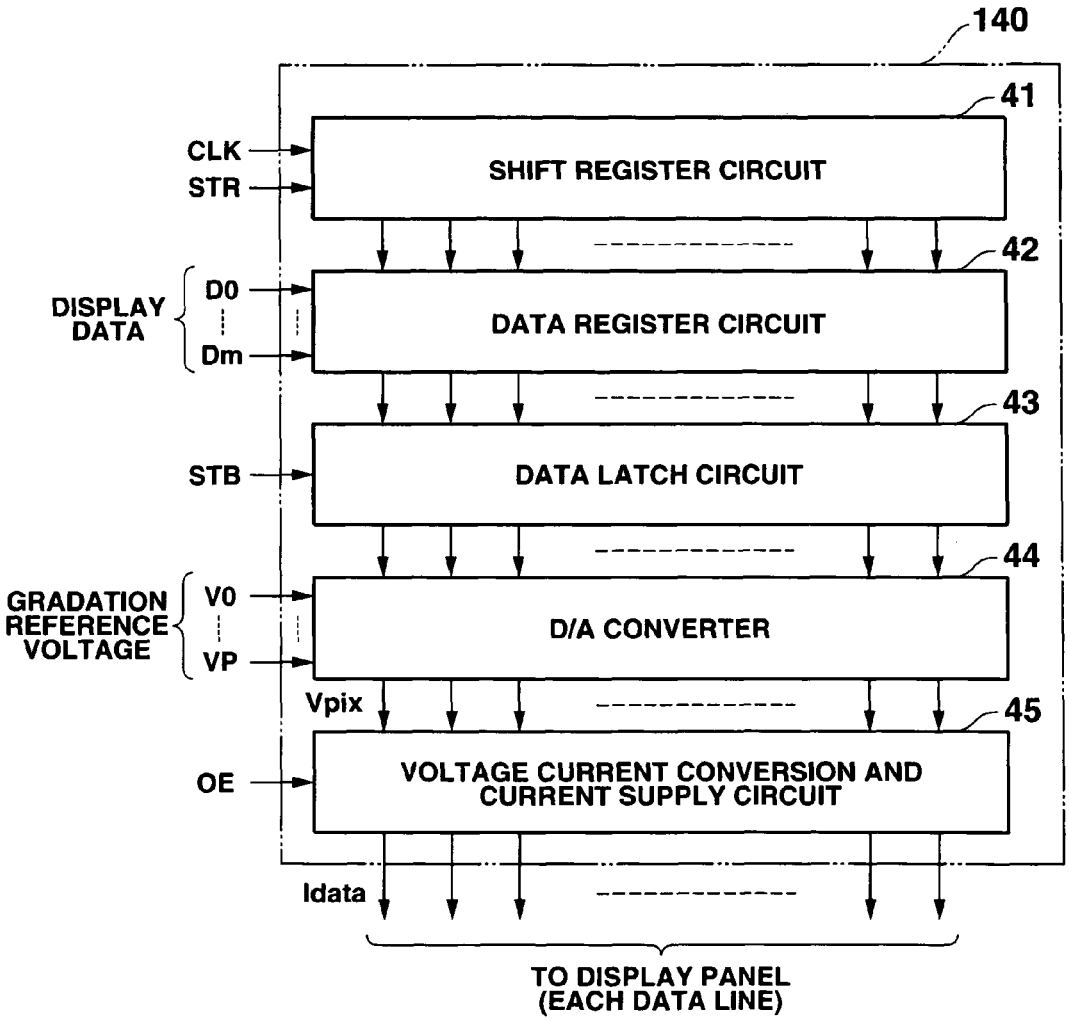
FIG. 4 is a schematic block diagram showing one example of a data driver which can be applied to the display apparatus according to the first embodiment.

FIG. 4 is a schematic block diagram showing one example of a data driver which can be applied to the display apparatus according to the present embodiment.

Incidentally, an internal configuration of the data driver shown in FIG. 4 is shown merely as one example in which a gradation current having a current value corresponding to display data can be generated, and the present invention is not limited thereto.

Generally, as shown in FIGS. 1 and 2, the data driver 140 sequentially fetches and holds display data (luminance gradation data) comprising digital signals supplied from the display signal generation circuit 160 described later on the basis of the data control signal supplied from the system controller 150 for one row portion at a predetermined timing. Then, the data driver 140 generates a gradation current Idata having a current value corresponding to a gradation value of the display data, and simultaneously supplies the gradation current Idata to the display pixels EM of a row set to a selection state in the writing period via the data lines DL.

Figure 5:
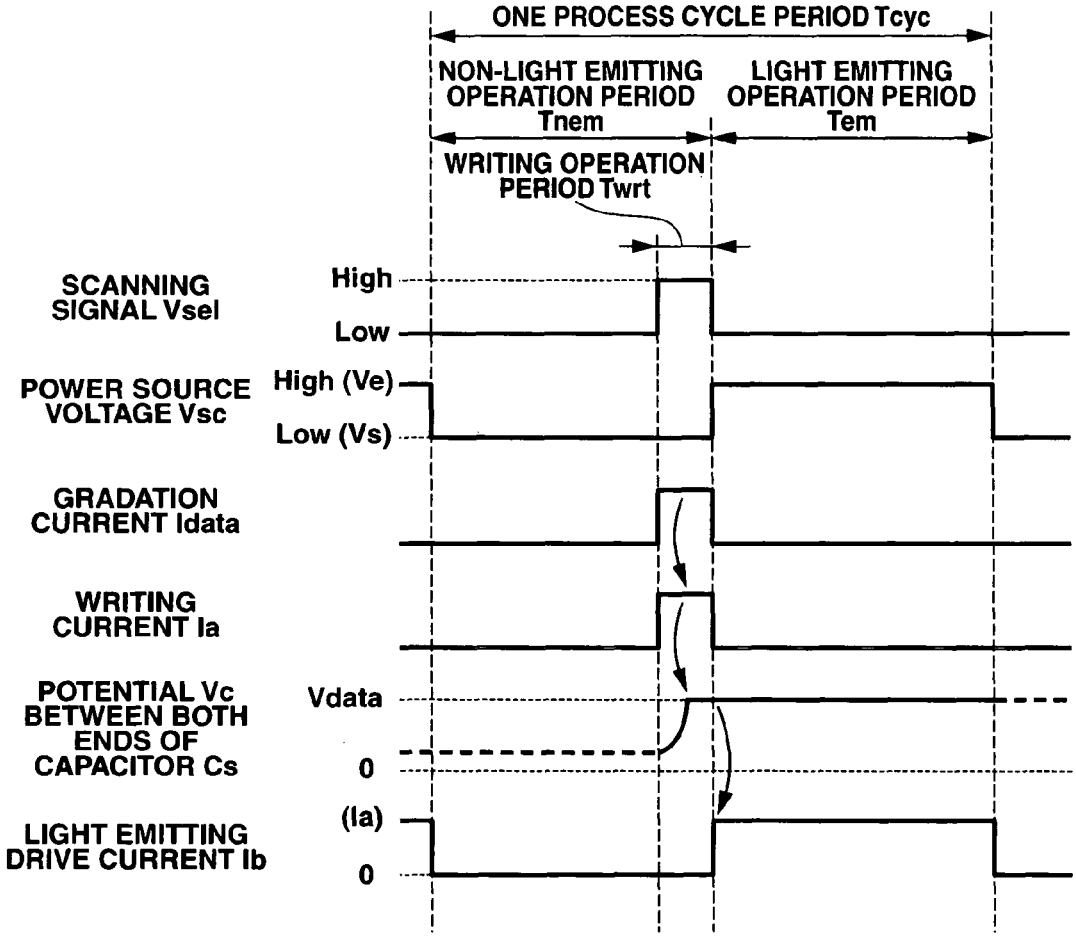
FIG. 5 is a timing chart showing a drive control method in the display pixel applied to the display apparatus according to the first embodiment.

Specifically, as shown in FIG. 5 described later, the data driver 140 can be applied with a configuration which comprises a shift register circuit 41, a data register circuit 42, a data latch circuit 43, a D/A converter 44, and a voltage current conversion and gradation current supply circuit 45. The shift register circuit 41 sequentially outputs a shift signal on the basis of a data control signal (a shift clock signal CLK, a sampling start signal STR) supplied from the system controller 150. The data register circuit 42 sequentially fetches one row portion of display data D0 to Dm which are supplied from the display signal generation circuit 160. The data latch circuit 43 holds one row portion of the display data D0 to Dm which are fetched with the data register circuit 42 on the basis of a data control signal (a data latch signal STB). The D/A converter 44 converts the held display data D0 to Dm to a predetermined analog signal voltage (a gradation voltage Vpix). The voltage current conversion and gradation current supply circuit 45 generates a gradation current Idata corresponding to the display data converted to an analog signal voltage to simultaneously output the gradation current Idata to the data lines DL in a column corresponding to the display data at a timing based on a data control signal (an output enable signal OE) supplied from the system controller 150.

(System Controller)

The system controller 150 operates each of the drivers at a predetermined timing by generating and outputting a scanning control signal, a power source control signal and a data control signal at least to each of the scanning driver 120, the power source driver 130 and the data driver 140 as timing control signals for controlling an operation state, and generates and outputs a scanning signal Vsel and a drive voltage Vsc having a predetermined voltage level as well as a gradation signal (a gradation current Idata) corresponding to the display data. Then, the system controller continuously performs the drive control operation (the non-light emitting operation, writing operation and light emitting operation) in each of the display pixels EM (the display drive circuit DC1), thereby making a control to display predetermined image information based on a image signal on the display panel 110.

(Display Signal Generation Circuit)

The display signal generation circuit 160 extracts, for example, a luminance gradation signal component from a image signal supplied from the outside of the display apparatus 100A, and supplies the luminance gradation signal component for each row portion of the display panel 110 to the data register circuit 42 of the data driver 140 as the display data (the luminance gradation data) comprising digital signals. Here, in the case where the above-described image signal includes a timing signal component for regulating a display timing of the image information like a television broadcast signal (a composite image signal), the display signal generation circuit 160 may have a function of extracting the timing signal component to supply the component to the system controller 150 in addition to the function of extracting the luminance gradation signal component. In this case, the above system controller 150 generates each of the control signals supplied individually to the scanning driver 120, the power source driver 130 and the data driver 140 on the basis of the timing signal supplied from the display signal generation circuit 160.

<Drive Control Method of Display Pixel>

Next, there will be explained a drive control method of the display pixels constituting the display panel described above in the present embodiment.

FIG. 5 is a timing chart showing the drive control method in the display pixels applied to the display apparatus according to the present embodiment.

Figure 6A:
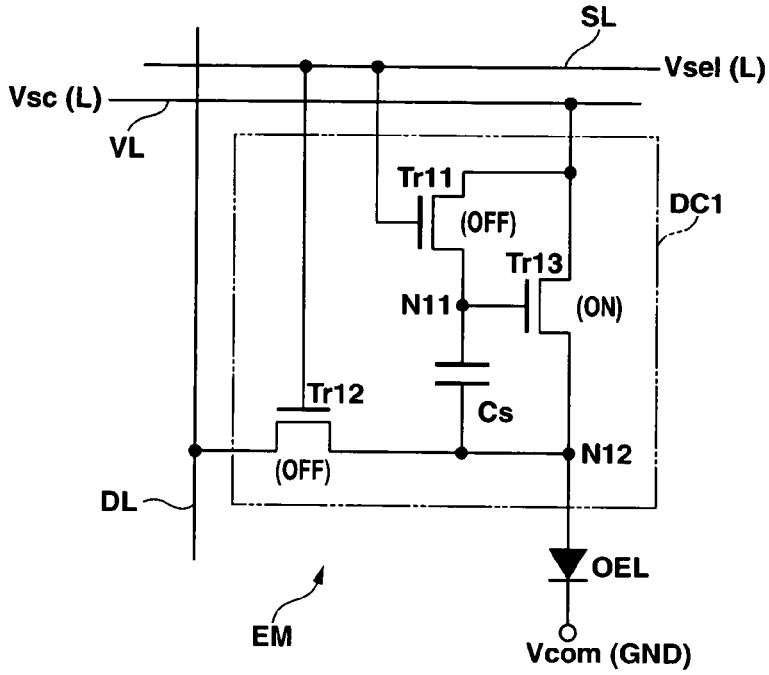
FIGS. 6A and 6B are conceptual diagrams each showing a non-light emitting operation and a writing operation in the display pixel according to the first embodiment.
Figure 6B:
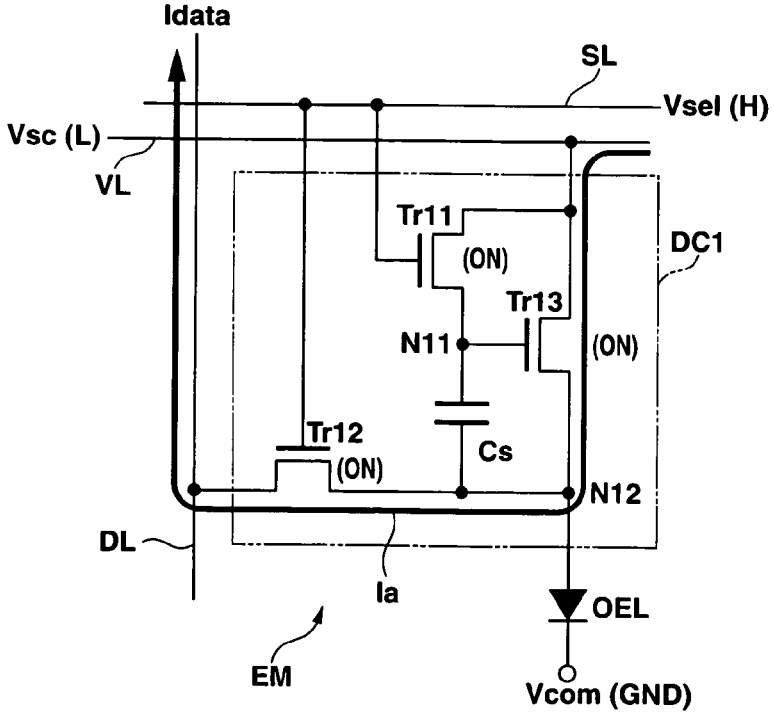

FIGS. 6A and 6B are conceptual diagrams showing a non-light emitting operation and a writing operation in the display pixels according to the present embodiment.

Figure 7:
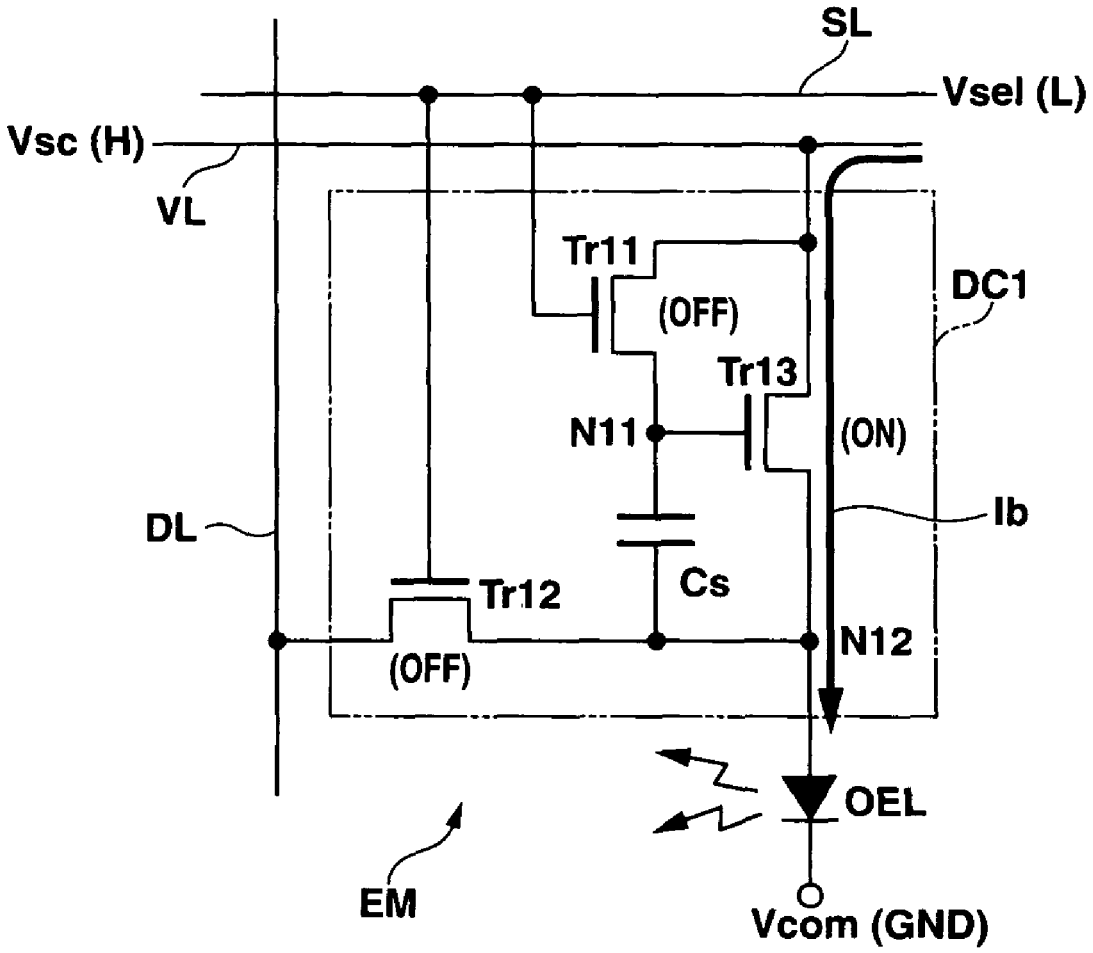
FIG. 7 is a conceptual diagram showing a light emitting operation in the display pixel according to the first embodiment.

FIG. 7 is a conceptual diagram showing a light emitting operation in the display pixels according to the present embodiment.

As shown in FIG. 5, a drive control operation in the display pixel EM (the display drive circuit DC1) according to the present embodiment is set so as to include a writing operation period Twrt, a light emitting operation period (a display operation period) Tem, and a non-light emitting operation period (a non-display operation period) Tnem in a predetermined process cycle period (an operation period) Tcyc. In the writing operation period Twrt, the display pixels EM connected with a scanning line SL are set to a selection state and a gradation current Idata having a current value corresponding to display data is sullied, whereby a voltage component corresponding to the display data is held in between the gate and the source (in the capacitor Cs) of the thin film transistor Tr13 for display drive provided on the display drive circuit DC1. In the light emitting operation period (the display operation period) Tem, a display drive current having a current value corresponding to the display data is allowed to flow in the organic EL element OEL on the basis of the voltage component held in between the gate and the source of the thin film transistor Tr13 in the writing operation period Twrt to perform a light emitting operation with a predetermined luminance gradation. The non-light emitting operation period (the non-display operation period) Tnem is the other period than the light emitting operation (a period including the above writing operation period). In The non-light emitting operation period Tnem, the supply of the display drive current to the organic EL element is shut down to prevent the light emitting operation by shutting down the supply of the drive voltage Vsc (applying a low level drive voltage Vsc) to the display pixels EM (the display drive circuit DC1) (Tcyc≧Tem+Tnem, Tnem≧Twrt).

Here, as shown in FIG. 5, the writing operation period Twrt, the light emitting operation period Tem and the non-light emitting operation period Tnem set in the one process cycle period Tcyc may be such that the writing operation and the light emitting operation are continuously performed after the non-light emitting operation, or may be such that the writing operation is performed at an arbitrary timing (during the non-light emitting operation period) of the non-light emitting operation period to perform the light emitting operation after the termination of the light emitting operation period.

Furthermore, the one process cycle period Tcyc according to the present embodiment is set to a period which is required for the display pixel EM to display one pixel portion of image information out of an image having one frame (one screen). That is, as will be explained in the display drive method of the display apparatus described later, in the case where one frame of image is displayed on the display panel 110 having a plurality of display pixels EM arranged thereon in two dimensions in the row and column directions, the above-described one process cycle period Tcyc is set to a period which is required for one row portion of the display pixels EM to display one row portion of image out of the one frame of images.

(Non-Display Operation Period)

In the non-light emitting operation period (the non-display operation period) Tnem, as shown in FIGS. 5 and 6A, the display pixels EM are set to a non-selection state by applying a non-selection level (for example, low level) scanning signal Vsel with respect to the scanning line SL from the scanning driver 120 while a low level drive voltage (a second voltage) is applied to the power source line VL from the power source driver 130. In addition, no gradation current Idata is supplied to the data line DL from the data driver 140.

As a consequence, the thin film transistors Tr11 and Tr12 provided on the display drive circuit DC1 are set to an OFF state. Accordingly, a setting is made such that an electric connection between the gate terminal (the contact point N11, one end side of the capacitor Cs) of the thin film transistor Tr13 and the power source line VL is shut down, and that an electric connection between the source terminal (the contact point N12, the other end side of the capacitor Cs) of the thin film transistor Tr13 and the data line DL is also shut down.

Here, as will be explained in the display drive method of the display apparatus described later, the drive control operation in each display pixel is repeatedly performed by using one process cycle period Tcyc (one frame period Tfr) as one cycle. Therefore, the voltage component written on the basis of the display data in a process cycle period prior to the one process cycle period by one period is held in the gate and the source (the both ends of the capacitor Cs) of the thin film transistor Tr13 at the start time of the above-described non-light emitting operation period Tnem, while the thin film transistor Tr13 is set to an ON state.

As a consequence, a low level (not more than the ground potential GND) drive voltage Vsc (=Vs) which has been applied to the power source line VL is applied to the anode terminal (the contact point N12) of the organic EL element OEL via the thin film transistor Tr13, and a potential not more than the same level is set with respect to the potential Vcom (the ground potential GND) of the cathode terminal. As a result, a reverse bias voltage is applied to the organic EL element OEL, so that no display drive current flows and no non-light emitting operation is performed (the non-light emitting operation).

(Writing Operation Period)

Next, in the writing operation period Twrt set in the above-described non-light emitting operation period Tnem, a selection level scanning signal Vsel is applied to the scanning line SL from the scanning driver 120 as shown in FIGS. 5 and 6A to set the display pixels EM to a selection state. In addition, in synchronization with this selection timing, a gradation current Idata having a current value (having a negative polarity) corresponding to display data is supplied to the data line DL from the data driver 140. Further, in the writing operation period Twrt, a low level drive voltage (a second voltage) Vsc (=Vs) is applied to the power source line VL from the power source driver 130, in the same manner as in the above-described non-light emitting operation period Tnem.

Accordingly, the thin film transistors Tr11 and Tr12 provided on the display drive circuit DC1 perform an ON operation, so that the low level drive voltage Vsc is applied to the gate terminal (the contact point N11; one end side of the capacitor Cs) of the thin film transistor Tr13 via the thin film transistor Tr11 while the source terminal (the contact point N12; the other end side of the capacitor Cs) of the thin film transistor Tr13 is electrically connected with the data line DL via the thin film transistor Tr12.

Here, since the gradation current Idata having a current value of negative polarity is supplied to the data line DL, a drawing-in action is accrued in which the gradation current Idata is likely to flow in a direction of the data driver 140 from the side of the data line DL, and a voltage level having a potential lower than the low level drive voltage Vsc is applied to the source terminal (the contact point N12; the other end side of the capacitor Cs) of the thin film transistor Tr13.

In this manner, a potential difference is generated between the contact points N11 and N12 (between the gate and the source of the thin film transistor Tr13). As a result, the thin film transistor Tr13 performs an ON operation, and a writing current Ia corresponding to the gradation current Idata flows in the direction of the data driver 140 via the thin film transistor Tr13, the contact point N12, the thin film transistor Tr12 and the data line D1 from the power source line VL.

At this time, electric charges corresponding to the potential difference generated between the contact points N11 and N12 (between the gate and the source of the thin film transistor Tr13) are accumulated in the capacitor Cs to be held as the voltage component (refer to a potential Vc between the both ends of the capacitor Cs in FIG. 5). Furthermore, the low level (not more than the ground potential GND) drive voltage Vsc (=Vs) is applied to the power source line VL, and further, the writing current Ia is controlled so as to flow in a direction of the data line DL, so that the potential applied to the anode terminal (the contact point N12) of the organic EL element becomes lower than the potential Vcom (the ground potential GND) of the cathode terminal. Consequently, a reverse bias voltage is applied to the organic EL element OEL, so that no display drive current flows in the organic EL element OEL and a non-light emitting operation is not performed (the non-light emitting operation).

(Display Operation Period)

Next, in the light emitting operation (the display operation period) Tem after the termination of the writing operation period Twrt or the non-light emitting operation period (the non-display operation period) Tnem including the writing operation Twrt, as shown in FIGS. 5 and 7, the following operation is performed in the same manner as in the non-light emitting operation period Tnem described above. That is, a low level scanning signal Vsel is applied to the scanning line SL from the scanning driver 120 to set the display pixels EM to a non-selection state, and in synchronization with this non-selection timing, the supply of the gradation current Idata from the data driver 140 is shut down and the drawing-in action in the gradation current Idata is suspended. Furthermore, in the light emitting operation period Tem, a high level drive voltage (a first voltage) Vsc (=Ve) is applied to the power source line VL from the power source driver 130.

As a consequence, the thin film transistors Tr11 and Tr12 provided on the display drive circuit DC1 perform an OFF operation, so that the application of the drive voltage Vsc to the gate terminal (the contact point N11; one end side of the capacitor Cs) of the thin film transistor Tr13 is shut down while the application of the voltage level resulting from the action of drawing-in in the gradation current Idata to the source terminal (the contact point N12; the other end side of the capacitor Cs) of the thin film transistor Tr13 is shut down. Consequently, electric charges accumulated in the writing operation period Twrt described above are held in the capacitor Cs.

In this manner, a potential difference between the contact points N11 and N12 (between the gate and the source of the thin film transistor Tr13; the both ends of the capacitor Cs) is held, so that the thin film transistor Tr13 maintains the ON state. Furthermore, since a drive voltage Vsc having a higher potential than the common voltage Vcom (the ground potential GND) is applied to the power source line VL, the potential applied to the anode terminal (the contact point N12) of the organic EL element OEL becomes higher than the potential (the ground potential) of the cathode terminal.

Accordingly, a predetermined display drive current Ib flows in a forward bias direction in the organic EL element OEL via the thin film transistor Tr13 and the contact point N12 from the power source line VL, and the organic EL element OEL emits light. Here, the voltage component (the potential Vc between the both ends of the capacitor Cs) held in the capacitor Cs corresponds to a potential difference in the case where the writing current Ia corresponding to the gradation current Idata is allowed to flow in the thin film transistor Tr13. For this reason, the display drive current Ib flowing in the organic EL element OEL has the same current value (Ib≈Ia) as the above writing current Ia.

Then, in the display pixel EM, the display drive current Ib is continuously supplied via the thin film transistor Tr13 in the light emitting operation period Tem on the basis of the voltage component corresponding to display data (the gradation current Idata) written in the writing operation period Twrt, and as a result, the organic EL element OEL continues an operation of emitting light with a luminance gradation corresponding to the display data.

In this manner, with respect to the display pixels EM (the display drive circuit DC1) according to the present embodiment, the gradation current Idata having a designated current value corresponding to the display data (the luminance gradation) is made to forcibly flow between the drain and the source of the drive transistor Tr13 in the writing operation period Twrt to control the display drive current Ib which is allowed to flow in the organic EL element (the light emitting element) OEL on the basis of the voltage component between the gate and the source of the drive transistor Tr13 held in accordance with the current value. As a consequence, a drive control method of a current gradation designation system for performing a light emitting operation with a predetermined luminance gradation can be applied.

Furthermore, with respect to the display pixel EM according to the present embodiment, it is possible to realize both a function (a current/voltage conversion function) of converting a current level of the gradation current Idata corresponding to the display data to a voltage level by means of a single display drive transistor (the thin film transistor Tr13) constituting the display drive circuit DC1 provided on each of the display pixels EM, and a function (a display drive function) of supplying the display drive current DC Ib having a predetermined current value to the organic EL element OEL. Accordingly, stable desired light emitting characteristics can be realized over a long period without being affected by a disparity in the operation characteristics of each transistor constituting the display drive circuit DC and the change with the lapse of time.

<Display Drive Method of Display Apparatus>

Next, there will be explained a display drive method (an operation of displaying image information) in the display apparatus according to the present embodiment.

Figure 8:
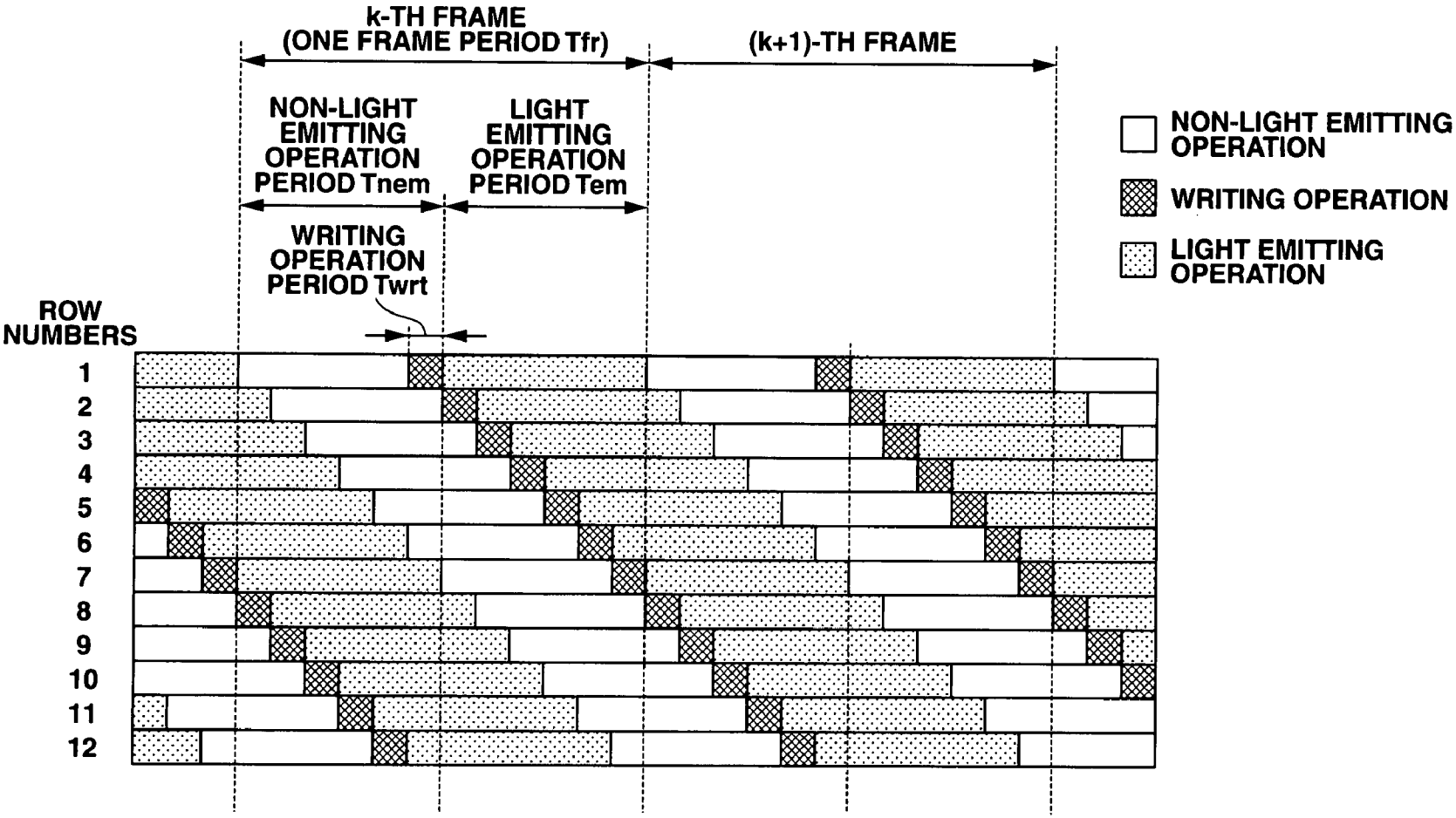
FIG. 8 is a timing chart showing one example of the display drive method of the display apparatus according to the first embodiment.

FIG. 8 is a timing chart showing one example of the display drive method of the display apparatus according to the present invention.

In the present embodiment, it is explained that the present embodiment has a configuration having twelve rows of (n=12; first to twelfth rows) display pixels arranged on the display panel, for the sake of explanation.

In the figure, symbol k denotes a positive integer. Hatching portions shown by a cross mesh in each row in the figure represent respectively the writing operation period of display data described above. Hatching portion shown by dots represent respectively the light emitting operation period described above.

In the display drive method of the display apparatus 100A according to the present embodiment, first, a non-light emitting operation is performed for preventing a display operation of the display pixels EM (preventing a light emitting operation of the organic EL element) with respect to the display pixels EM (the display drive circuit DC1) for each row arranged in the display panel 110. Then, a writing operation is sequentially performed for each row for writing a gradation current Idata corresponding to display data at an arbitrary timing (just before the end of the non-light emitting operation period Tnem in the present embodiment) in the non-light emitting operation period Tnem followed by sequentially performing a light emitting operation with a predetermined luminance gradation corresponding to the display data, whereby image information is displayed in one screen portion of the display panel 110. Here, the operation timing is controlled in such a manner that at least the writing operation periods Twrt in the respective rows are not mutually overlapped (in terms of time).

Specifically, in the beginning, as shown in FIG. 8, in the non-light emitting operation period Tnem (denoted by outline typefaces in the drawing) in one frame period Tfr, a non-selection level scanning signal Vsel is applied from the scanning driver 120 to a scanning line SL in a specific row (for example, the i-th row; $1 \leqq i \leqq 12$) of the display panel 110 to set the display pixels EM in the i-th row to a non-selection state. Furthermore, a state is set in which no gradation current Idata is supplied to each of the data lines DL from the data driver 140 (a state in which the supply of the gradation current Idata is shut down).

Then, in synchronization with this timing, a low level drive current (the second voltage) Vsc (=Vs) is applied to the power source line VL in the i-th row from the power source driver 130, so that no potential difference is generated between the drain and the source of the display drive thin film transistor Tr13 in the display pixels EM in the i-th row as shown in FIG. 6A. Consequently, the display drive current Ib does not flow in a direction of the organic EL element OEL via the thin film transistor Tr13, and the display pixels EM in the i-th row are set to a non-light emitting state (the non-light emitting operation is performed).

Next, as shown in FIG. 8, in the writing operation period Twrt (denoted by a cross mesh in the drawing) set in the above-described non-light emitting operation period Tnem, as shown in FIG. 5, a selection level scanning signal Vsel is applied from the scanning driver 120 to the scanning line SL in the i-th row of the display panel 110, so that the display pixels EM in the i-th row are set to a selection state. Furthermore, in the writing operation period Twrt, a low level drive voltage Vsc (=Vs) is applied to the power source line VL in the i-th row from the power source driver 130.

Then, in synchronization with this selection timing, a gradation current Idata having a current value corresponding to display data in the i-th row is supplied to each data line DL from the data driver 140. As a result, as shown in FIG. 6B, a writing current Ia corresponding to the gradation current Idata flows in the display drive circuit DC of each display pixel EM in the i-th row, and a voltage component corresponding to the gradation current Idata is held (electric charges are accumulated) between the gate and the source terminal (across the capacitor Cs) of each thin film transistor Tr13.

Here, in the writing operation period Twrt, the writing operation is performed in the same manner as in the non-light emitting operation Tnem described above. That is, a low level drive voltage Vsc (=Vs) is applied to a power source line VL in an i-th row in which the writing operation is performed, whereby no potential difference is generated between the drain and the source of the display drive thin film transistor Tr13 in each of the display pixels EM. For this reason, no display drive current Ib flows in the direction of the organic EL element OEL via the thin film transistor Tr13, thereby setting the display pixels EM in the i-th row to a non-light emitting state (the non-light emitting operation is performed).

The non-light emitting operation including the writing operation is sequentially performed with a shift of timing for each row with respect to the display pixels EM arranged on the display panel 110. In particular, the writing operations in the respective rows are sequentially performed such that the operations are not overlapped in terms of time.

Next, as shown in FIG. 8, in the light emitting operation (denoted by dot hatching in the drawing) as shown in FIG. 5, a non-selection level scanning signal Vsel is applied from the scanning driver 120 to the scanning line SL in an i-th row in which the non-light emitting operation period Tnem has been terminated, whereby the display pixels EM in the i-th row are set to a non-selection state. Furthermore, the supply of the gradation current Idata to each of the data lines DL from the data driver 140 is shut down.

Then, in synchronization with this timing, the high level drive voltage (the first voltage) Vsc (=Vs) is applied to the power source line VL in the i-th row from the power source driver 130, so that, as shown in FIG. 7, a potential difference is generated between the drain and the source of the display drive thin film transistor Tr13 in each of the display pixels EM in the i-th row. Consequently, the display drive current Ib corresponding to the display data (the gradation current Idata) is supplied to the organic EL element OEL on the basis of the voltage component charged in each of the display pixels EM (between the gate and the source of the display drive thin film transistor Tr13), so that the light emitting operation is performed with a predetermined luminance gradation.

Such a light emitting operation is sequentially performed with a shift of timing for each of the display pixels EM in a row in which the writing operation (the non-light emitting operation including the writing operation) has been terminated with respect to the display pixels EM arranged on the display panel 110.

That is, with respect to a plurality of display pixels EM arranged in two dimensions on the display panel 110, a non-light emitting operation period Tnem having a predetermined length is set in one frame period for each row. Therefore, a pseudo-impulse type display drive control can be realized wherein each of the display pixels EM performs a light emitting operation with a luminance gradation corresponding to the display data (the gradation current Idata) only in one definite period out of the one frame period Tfr. Here, the length of the non-light emitting operation period or the light emitting operation period Tem set in the one frame period Tfr can be arbitrarily set with the power source control signal, the data control signal and the scanning control signal which are supplied as timing control signals to the scanning driver 120, the power source driver 130, and the data driver 130 from the system controller 150, for example.

Accordingly, in the timing chart shown in FIG. 8, a ratio of the non-display period (a black insertion ratio) by means of the above-described non-light emitting operation (including the writing operation) in the one frame period Tfr is set, for example, to 50%, so that the half of the image information (the display screen) displayed on the display panel 110 can be provided in the black display (non-display). Thus, in the human sense of vision, the black insertion ratio of approximately 30% or more which is required for clear visual recognition of moving images without blurs and stains can be realized with the result that moving images can be displayed in a favorable display image quality. Incidentally, the black insertion ratio (the ratio of non-display period) in the one frame period Tfr is not limited to 50% which is described above, and an arbitrary value of the above-described 30% or more is desirable. However, a value of 30% or less is possible.

Furthermore, in this case, the writing operation can be sequentially performed to the display images EM in all the rows (twelve rows) of the display panel 110 by using all the time of the one frame period Tfr, in the same manner as in the display drive method (refer to FIG. 17) shown in the prior art. Therefore, unlike the conventional display drive method shown in FIG. 27, the writing operation period Twrt in each row (which corresponds to the image data writing period in the prior art) is not shortened to realize the operation of writing blanking data and the black display operation, and thus, the writing time of each row can be sufficiently secured. The deterioration of the display quality which results from the writing insufficiency of display data can be suppressed, so that an appropriate gradation display corresponding to display data can be realized.

Furthermore, this enables providing an allowance in the timing control of various kinds of signals, thereby making it possible to suppress the occurrence of an erroneous operation of the display apparatus.

Incidentally, in the present embodiment, as shown in the timing chart of FIG. 8, there is explained, for the sake of explanation, a case in which the non-light emitting operation (the non-display operation) including the writing operation period is performed in one frame period Tfr followed by performing the light emitting operation (the display operation). The control operation is substantially the same even in the case where, a light emitting operation having a predetermined length is performed after a writing operation which is not accompanied with the light emitting operation of the organic EL element OEL (the display operation of the display pixels EM) is performed, and then the non-light emitting operation is performed.

Second Embodiment

Next, there will be explained a second embodiment of the display apparatus according to the present embodiment and the display drive method thereof with reference to the drawings.

Figure 9:
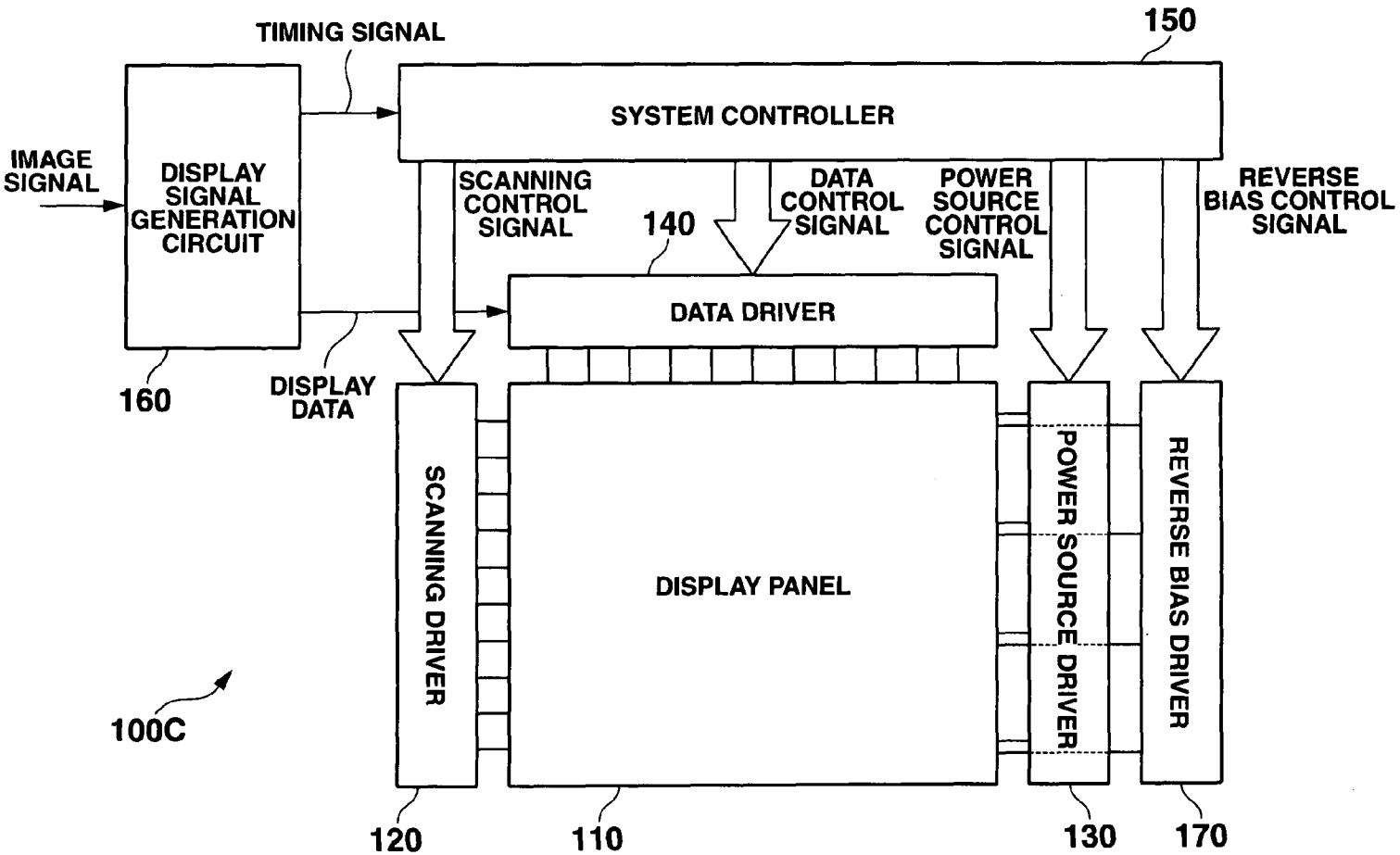
FIG. 9 is a schematic block diagram showing a second embodiment of the display apparatus according to the present invention.

FIG. 9 is a schematic block diagram showing the second embodiment of the display apparatus according to the present invention.

Figure 10:
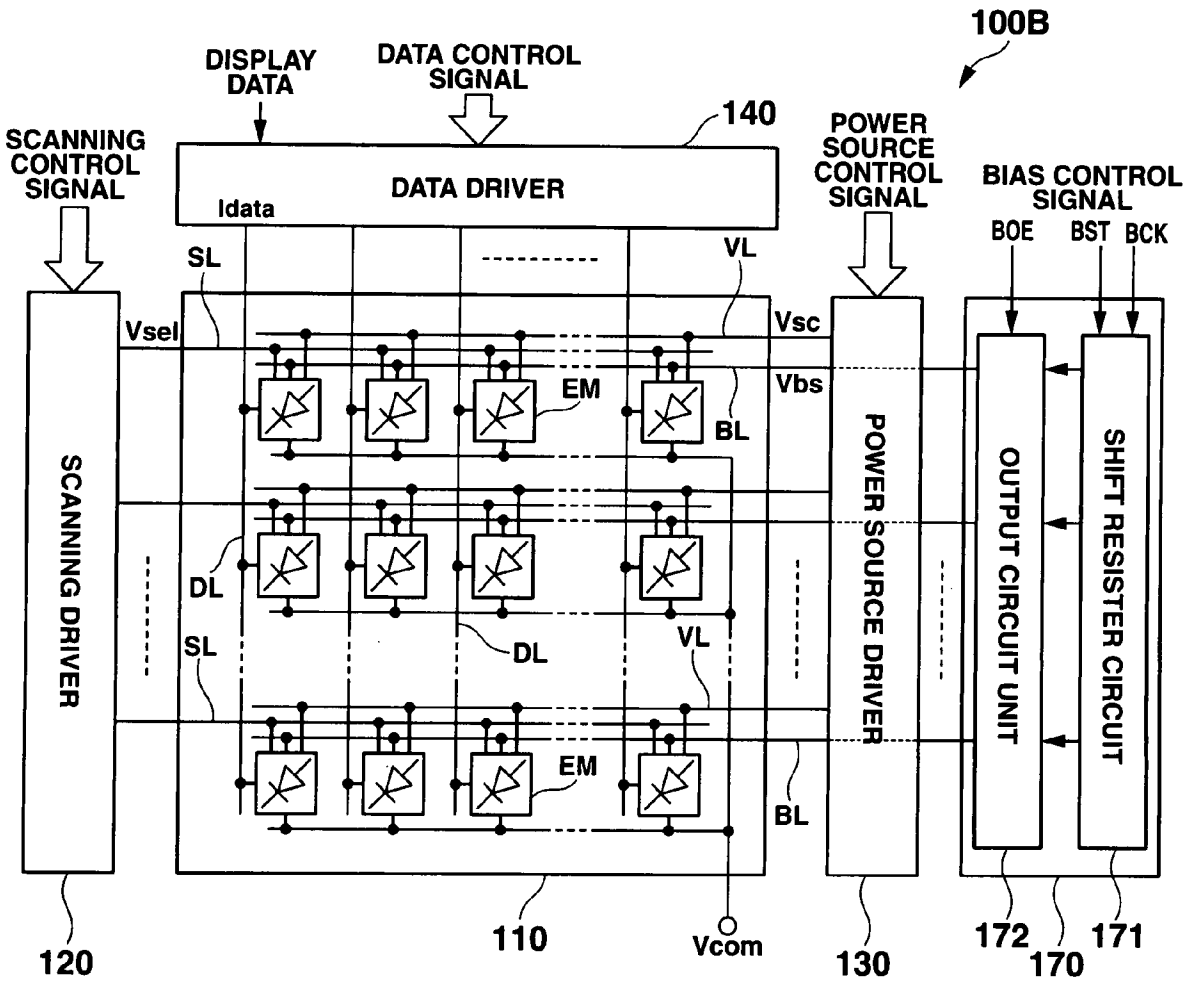
FIG. 10 is a structural diagram of a primary part, showing one example of a display panel applied to the display apparatus according to the second embodiment and a peripheral circuit thereof.

FIG. 10 is a structural diagram of a primary part, showing one example of a display panel applied to the display apparatus according to the embodiment and a peripheral circuit thereof.

Figure 11:
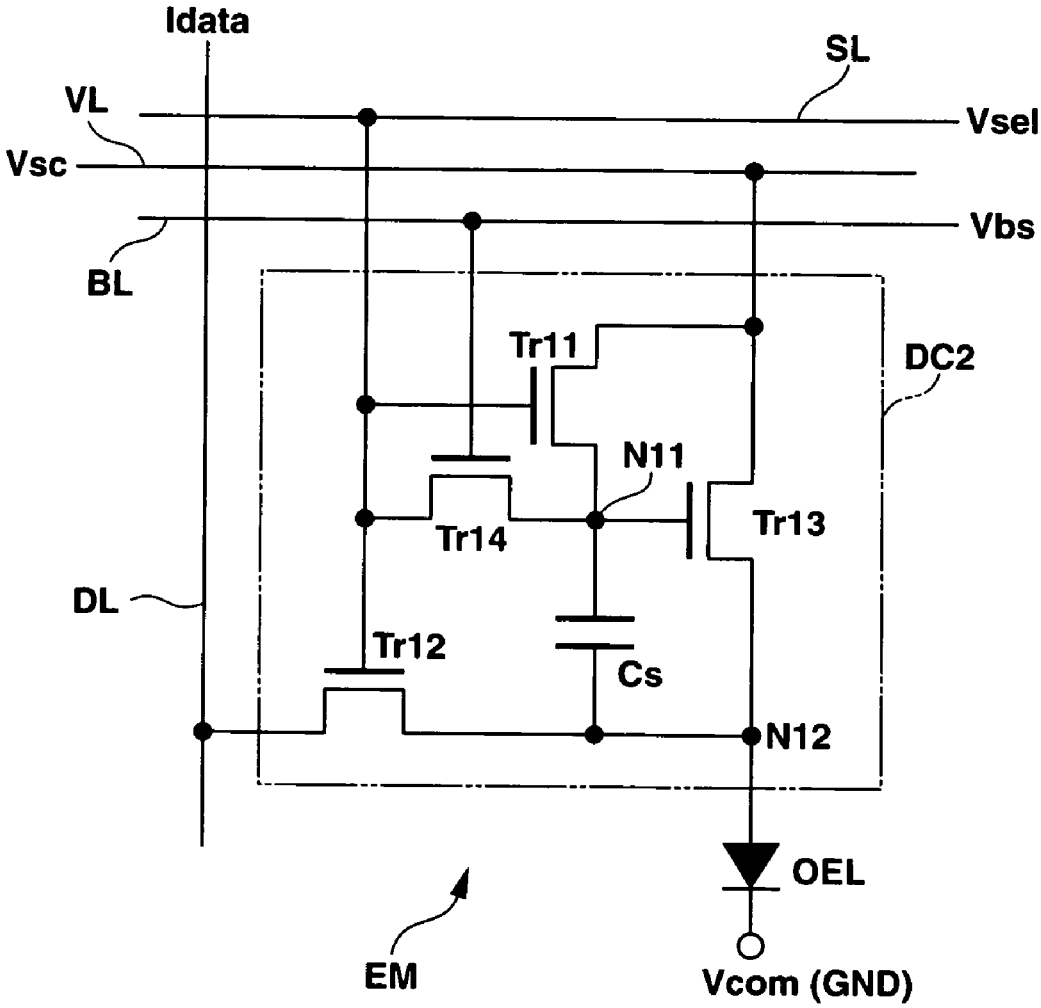
FIG. 11 is a circuit structural diagram showing one example of a display pixel applied to the display apparatus according to the second embodiment.

FIG. 11 is a circuit structural diagram showing one example of a display pixel (a display drive circuit) which is applied to the display apparatus according to the embodiment.

Here, the same components as those of the first embodiment (refer to FIGS. 1 to 3) described above are denoted by the same or equivalent reference numerals, and an explanation thereof is simplified.

In the above-described first embodiment, as shown in FIG. 3, a circuit configuration comprising a plurality of single channel type thin film transistors is shown as a display drive circuit DC1 provided on each display pixel EM. In this case, there is explained that an amorphous silicon thin film transistor which is easy in the manufacturing process and which is uniform in the element characteristics (an electron movement degree) can be applied.

However, it is known that a change in threshold voltage (Vth shift) resulting from the drive history is generally easily generated in the amorphous silicon thin film transistor.

As a consequence, in the case where an amorphous silicon thin film transistor is applied as a switching element (thin film transistor Tr13) for display drive, the current value of the display drive current Ib which is supplied to the organic EL element OEL owing to the change in threshold voltage does not correspond to display data, and the light emitting operation (the display operation) cannot be performed with an appropriate luminance gradation. Consequently, there is a possibility that the deterioration of the display image quality is invited.

Therefore, in the second embodiment, and the subsequent third and fourth embodiments, there is provided a configuration in which the voltage between the gate and the source (the potential Vc between the both ends of the capacitor Cs) of the display drive switching element (the thin film transistor Tr13) of each display pixel EM is set to 0V (no voltage) or a negative voltage (a reverse bias voltage) in the non-light emitting operation period (the non-display operation period) except for the time of the light emitting operation (the display operation) which results in the change in threshold voltage in the one frame period Tfr described above to suppress the change in threshold voltage of the switching element.

As shown in FIGS. 9 and 10, a display apparatus 100B according to the second embodiment, in the same manner as in the first embodiment, comprises a display panel 110, a scanning driver (a scanning drive unit) 120, a power source driver (a power source drive unit) 130, a data driver (a data drive unit) 140, a system controller (a drive control unit) 150, and a display signal generation circuit 160. The display panel 110 has a plurality of display pixels EM arranged in two dimensions in row and column directions. The scanning driver 120 sequentially applies a selection level scanning signal Vsel to scanning lines SL of the display panel 110 to set display pixels EM for each row to a selection state. The power source driver 130 sequentially applies a drive voltage Vsc to power source lines VL arranged in parallel to the scanning lines SL in each row. The data driver 140 supplies a gradation signal (a gradation current Idata) corresponding to display data to the display pixels EM via data lines DL. The system controller 150 generates and outputs a scanning control signal, a power source control signal, a reverse bias control signal and a data control signal for performing a predetermined image display operation in the display panel 110. The display signal generation circuit 160 generates display data (luminance gradation data) and supplies the data to the data driver 140 on the basis of a picture image supplied from the outside. Furthermore, the configuration thereof comprises a reverse bias driver (a state setting unit) 170 for applying a bias signal (a set signal) Vbs having a predetermined voltage level to the display pixels EM in each row. The display signal generation circuit 160 generates display data (luminance gradation data) and outputs the display data to the data driver 140, and also supplies to the system controller 150 a timing signal for displaying predetermined image information to the display panel 110.

With respect to the display pixels EM in each row, the reverse bias driver 170 applies the bias signal Vbs to the bias line BL of the row only in a specific period in the non-light emitting operation period Tnem on the basis of the bias control signal supplied from the system controller 150. Then, the reverse bias driver 170 sets to a no-electric field state or a reverse bias state (a specific bias state) a display drive switching element provided on each display pixel EM (a display drive circuit DC2) in the non-light emitting operation period Tnem except for the writing operation period Twrt (by applying 0V (no voltage), or a reverse bias voltage between the gate and the source of the thin film transistor Tr13).

Here, as shown in, for example, FIG. 10, the reverse bias driver 170 comprises a known shift register 171 and an output circuit unit 172, as in the scanning driver 120 and the power source driver 130 described above. The shift register 171 sequentially outputs a shift signal corresponding to the bias line BL in each row on the basis of the clock signal BCK and the start signal BST supplied from the system controller 150 as the bias control signals. The output circuit unit 172 converts the shift signal to a predetermined voltage level to output the shift signal to each bias line BL as the bias signal Vbs on the basis of the output control signal BOE supplied as a bias control signal.

The system controller 150 generates and outputs the bias control signal to the reverse bias driver 170 as a timing control signal for controlling the operation state to operate at a predetermined timing the reverse bias driver 170 in addition to the scanning driver 120, the power source driver 130 and the data driver 140 shown in the first embodiment. Consequently, a control (a display drive control of the display apparatus described later) is performed for generating a scanning signal Vsel and a drive voltage Vsc having a predetermined voltage level, a gradation signal (a gradation current Idata) corresponding to the display data and a bias signal Vbs to output them to the display panel 110 and for continuously performing a drive control operation (a non-light emitting operation, a reverse bias setting operation, a writing operation and a light emitting operation) in each display pixel EM to display predetermined image information based on a image signal on the display panel 110.

Furthermore, as shown in, for example, FIG. 11, in the same manner as the configuration shown in the above-described first embodiment, the display pixel EM arranged on the display panel 110 according to the present embodiment comprises a display drive circuit DC2 and an organic EL element (a light emitting element) OEL. The display drive circuit DC2 fetches a gradation signal (a gradation current Idata) corresponding to display data and generates a display drive current. The organic EL element OEL performs a light emitting operation with a predetermined luminance gradation on the basis of the display drive current. In particular, the display drive circuit DC2 which is applied to the display pixels EM according to the present embodiment specifically has a configuration which comprises a thin film transistor (a bias control circuit, a fourth switching circuit) Tr14 in addition to the thin film transistor Tr11 to Tr13 and the capacitor Cs shown in the first embodiment. The thin film transistor Tr14 has a gate terminal (a control terminal) connected with the bias line BL and has a drain terminal and a source terminal (one and the other end of the conduction channel) respectively connected with the scanning line SL and the contact point N11.

Here, as described above, the thin film transistors Tr11 to Tr14 are constituted by applying amorphous silicon thin film transistors, which are simple to manufacture and uniform in the element characteristics (an electron movement degree or the like).

Next, there will be explained the drive control method of the display pixel which is applied to the display panel according to the present embodiment.

Figure 12:
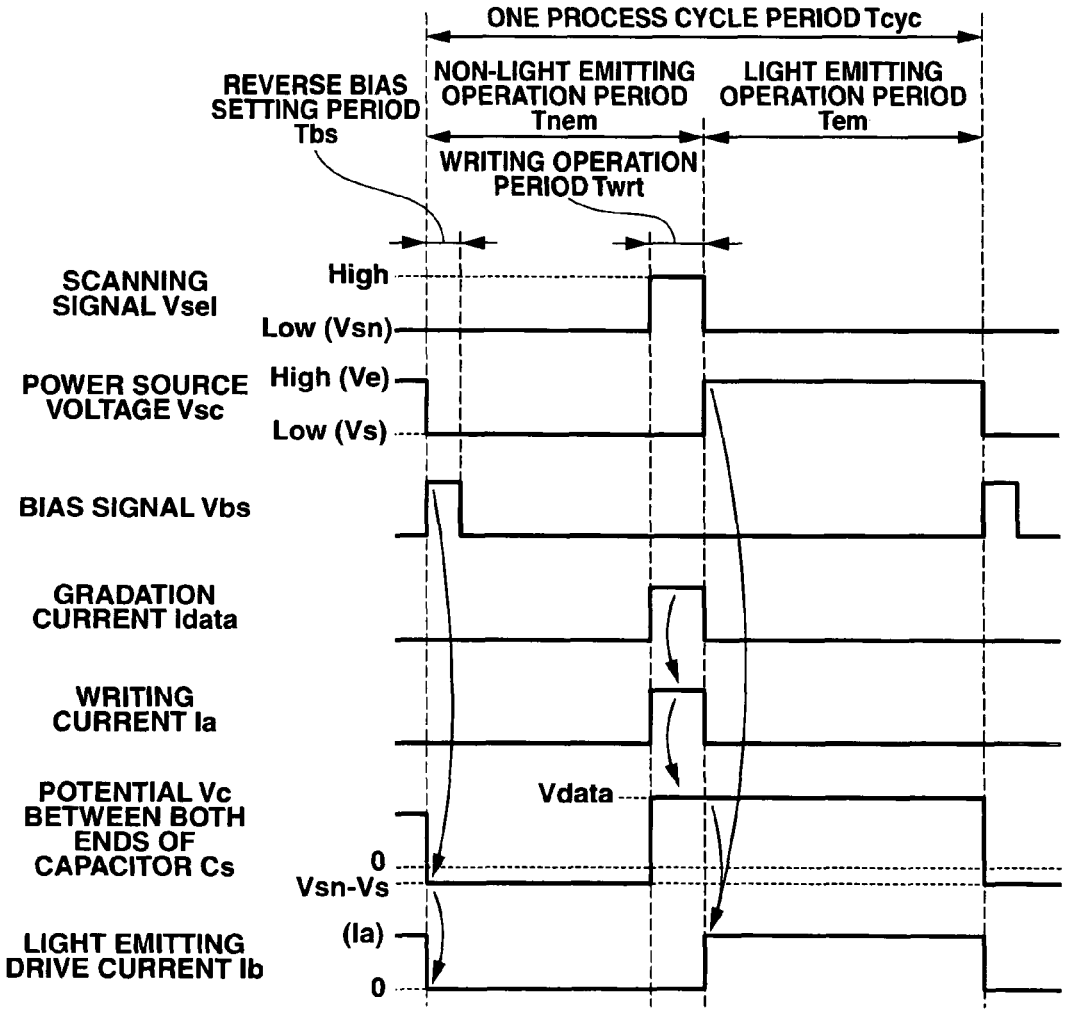
FIG. 12 is a timing chart showing a drive control method in the display pixel applied to the display apparatus according to the second embodiment.

FIG. 12 is a timing chart showing the drive control method (the reverse bias setting operation, the non-light emitting operation, the writing operation and the light emitting operation) in the display pixels applied to the display apparatus according to the present embodiment.

Figure 13A:
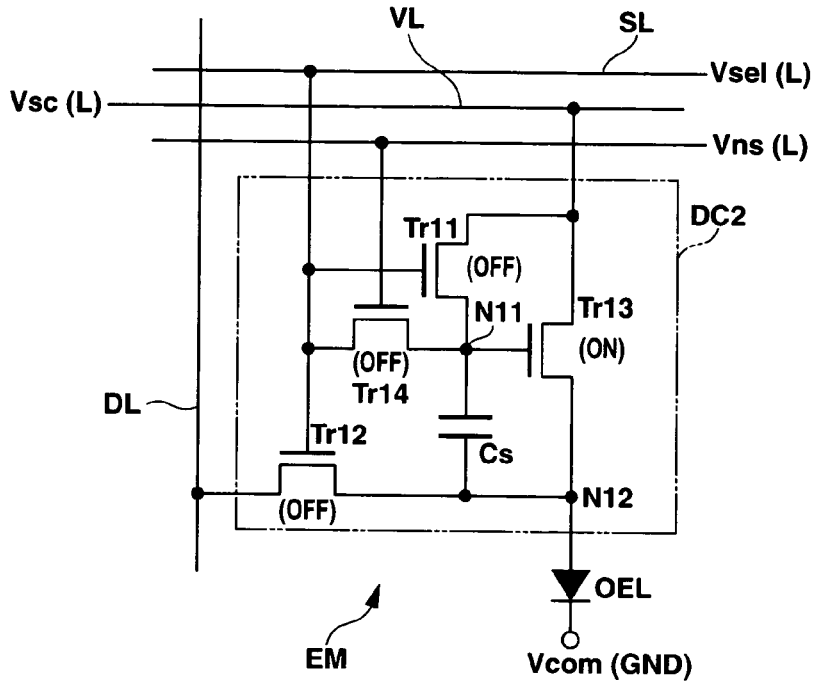
FIGS. 13A and 13B are conceptual diagrams showing a reverse bias setting operation and a non-light emitting operation in the display pixel according to the second embodiment.
Figure 13B:
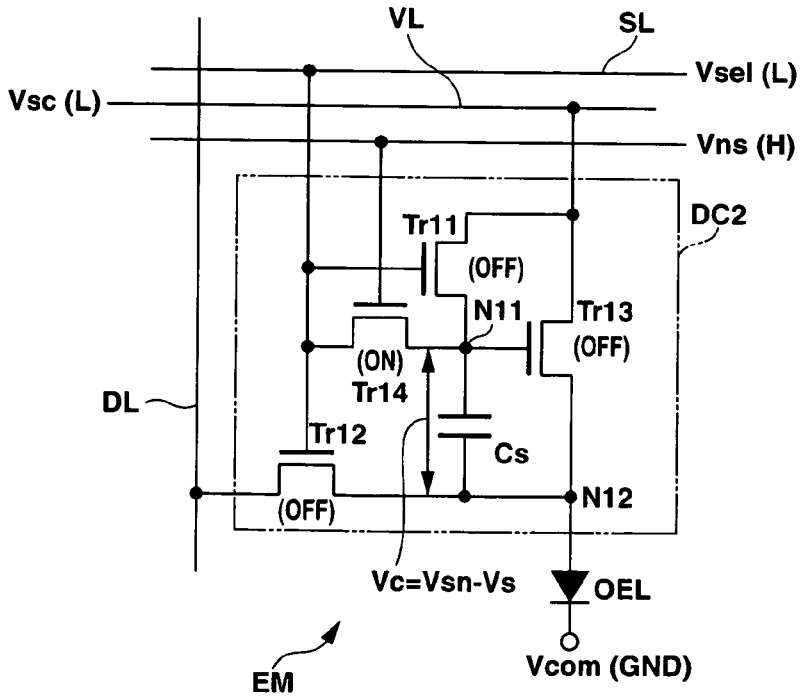

FIGS. 13A and 13B are conceptual diagrams showing the reverse bias setting operation and the non-light emitting operation in the display pixels (the display drive circuit) according to the present embodiment.

Figure 14A:
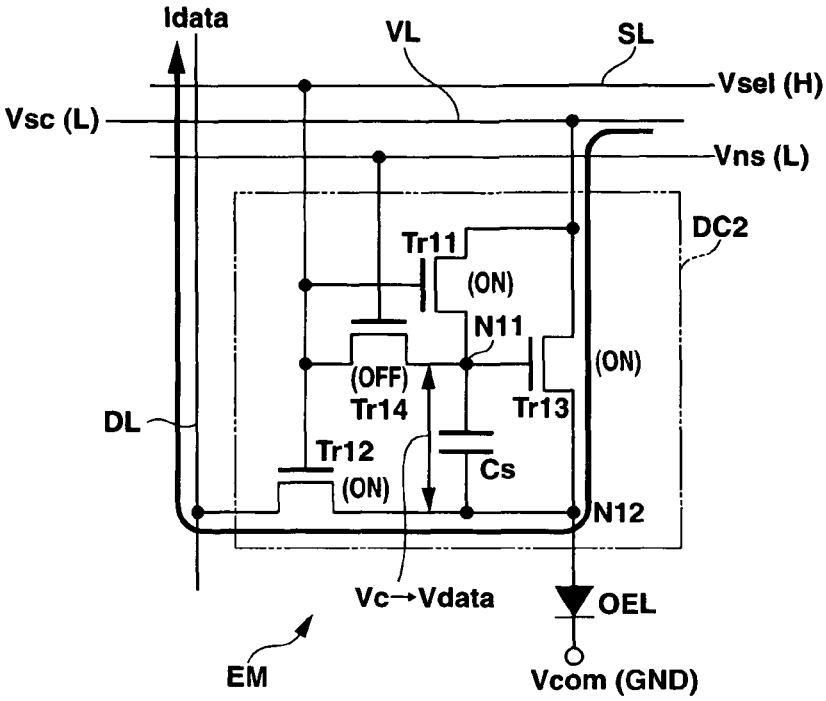
FIGS. 14A and 14B are conceptual diagrams showing a writing operation and a light emitting operation in the display pixel according to the second embodiment.
Figure 14B:
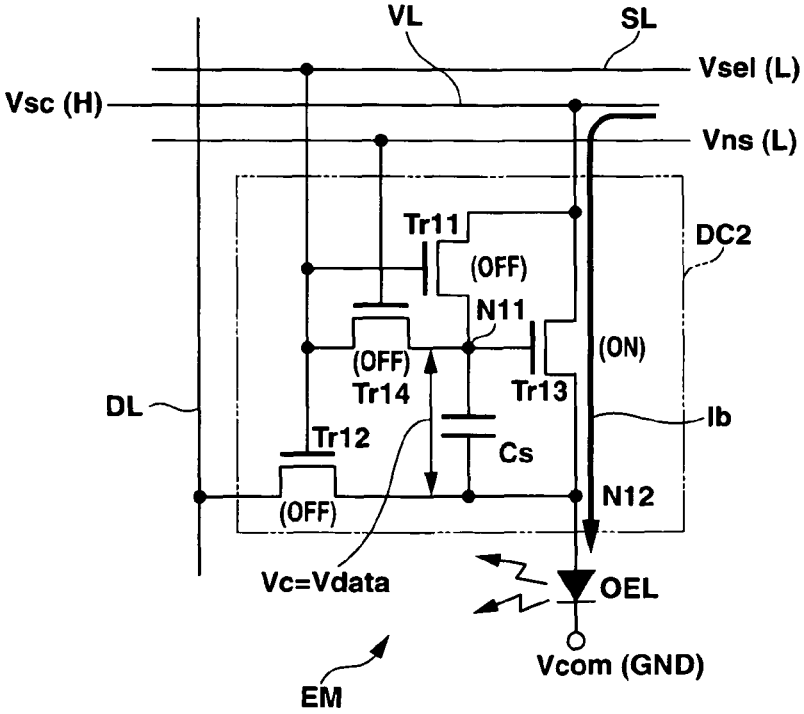

FIGS. 14A and 14B are conceptual diagrams showing the writing operation and the light emitting operation in the display pixels (the display drive circuit) according to the present embodiment.

Here, an explanation on the drive control operation which is the same as the first embodiment described above is omitted. As shown in FIG. 12, the drive control operation in the display pixels EM (the display drive circuit DC2) according to the present embodiment is set to include a non-light emitting operation period (a non-display operation period) Tnem, a reverse bias setting period Tbs, a writing operation period Twrt, and a light emitting operation period (a display operation period) Tem in a predetermined one process cycle period Tcyc (for example, one frame period Tfr). In the non-light emitting operation period Tnem, the supply of the drive current Vsc to the display pixels EM (the display drive circuit DC2) is shut down (a low level drive voltage (a second voltage) Vsc is supplied), whereby the supply of the display drive current Vsc to the organic EL element OEL is shut down to prevent the light emitting operation. The reverse bias setting period Tbs is performed in the non-light emitting operation period Tnem. In the reverse bias setting period Tbs, the bias signal Vbs is applied via the bias line BL to discharge electric charges held (resides) between the gate and the source (in the capacitor Cs) of the display drive thin film transistor Tr13 provided on the display drive circuit DC2, whereby a no-electric field state or a reverse bias state is set in which 0V (no voltage) or a reverse bias voltage is applied. The writing operation period Twrt is performed in the non-light emitting operation period Tnem. In the writing operation period Twrt, the display pixels EM connected with the scanning line SL are set to a selection state to supply a gradation current Idata having a current value corresponding to display data, whereby the voltage component corresponding to the display data is held in between the gate and the source (in the capacitor Cs) of the display drive thin film transistor Tr13 provided on the display drive circuit DC2. In the light emitting operation period Tem, the display drive current Ib having a current value corresponding to the display data is allowed to flow in the organic EL element OEL on the basis of the voltage component held in between the gate and the source of the thin film transistor Tr13 in the writing operation period Twrt, thereby performing a light emitting operation with a predetermined luminance gradation ($Tcyc \geqq Tem+Tnem$, $Tnem \geqq Tbs+Twrt$).

Here, as shown in FIG. 12, the reverse bias setting period Tbs and the writing operation period Twrt set in the non-light emitting operation period Tnem may be set at the start time and the termination time of the non-light emitting operation period Tnem. Alternatively, the reverse bias setting period Tbs and the writing operation period Twrt may be set so that the reverse bias setting operation and the writing operation are performed at an arbitrary timing (in the midst of the non-light emitting operation period) of the non-light emitting operation period.

(Non-Light Emitting Operation Period)

First, in the non-light emitting operation period Tnem, as shown in FIGS. 12 and 13A, the display pixels EM is set to a non-selection state by applying a non-selection level scanning signal Vsel to the scanning line SL from the scanning driver 120 while a low level drive voltage (a first voltage) Vsc is applied to the power source line VL from the power source driver 130. Furthermore, no gradation current Idata is supplied to the data line DL from the data driver 140.

Consequently, the thin film transistor Tr11 and Tr12 provided on the display drive circuit DC2 are set to an OFF state. Thus, there is established a state in which an electric connection between the gate terminal (the contact point N11; one end side of the capacitor Cs) of the thin film transistor Tr13 and the power source line VL is shut down while an electric connection between the source terminal (the contact point N12; the other end side of the capacitor Cs) of the thin film transistor Tr13 and the data line DL is also shut down. Incidentally, in the other period in the non-light emitting operation period Tnem than the reverse bias setting period Tbs described later, a low level bias signal Vsb is applied to the bias line BL from the reverse bias driver 170, so that the thin film transistor Tr14 is set to an OFF state. As a consequence, an electric connection between the gate terminal (the contact point N11; one end side of the capacitor Cs) of the thin film transistor Tr13 and the scanning line SL is set to a shut-down state.

Here, in the same manner as in the non-display operation period shown in the first embodiment described above, the drive control operation in each display pixel is repeatedly performed by using one process cycle period Tcyc (one frame period Tfr) as one cycle. Therefore, there is provided a state in which a voltage component written based on the display data in one process cycle period prior to the one process cycle period by one period is held in between the source and the gate (in the capacitor Cs) of the thin film transistor Tr13 at the start time of the above-described non-light emitting operation period Tnem, and the thin film transistor Tr13 is set to an ON state.

For this reason, a low level (not more than the ground potential GND) drive voltage Vsc (=Vs) which has been applied to the power source line VL is applied to the anode terminal (the contact point N12) of the organic EL element OEL via the thin film transistor Tr13, whereby a potential not more than the same level is set with respect to the potential Vcom (the ground potential GND) of the cathode terminal. Consequently, a reverse bias voltage is applied to the organic EL element OEL, so that no display drive current flows in the organic EL element OEL and the light emitting operation is not performed (non-light emitting operation).

(Reverse Bias Setting Period)

Next, in the reverse bias setting period Tbs set in the above-described non-light emitting operation period Tnem, a high level bias signal Vbs is applied to the bias line BL from the reverse bias driver 170, as shown in FIGS. 12 and 13A.

Accordingly, the thin film transistor Tr14 provided on the display drive circuit DC2 performs an ON operation, thereby setting to a state in which a voltage level of the scanning signal Vsel set to the non-selection level (Vsn) is applied to the gate terminal (the contact point N11; one end side of the capacitor Cs) of the thin film transistor Tr13. Consequently, a potential difference is generated between the voltage level based on the above-described non-selection level scanning signal Vsel (=Vsn) and the contact point N12.

Here, as described above, the voltage component written based on the display data in one process cycle period prior to the process cycle period by one period is held in the capacitor Cs at the start time of the non-light emitting operation period Tnem, and the thin film transistor Tr13 is set to an ON state. Consequently, in the case where, as shown in FIG. 12, the reverse bias setting operation is performed at the start time of the non-light emitting operation period Tnem, the drive voltage Vsc (=Vs) applied to the power source line VL is applied to the contact point N12 (the other end of the capacitor Cs) via the thin film transistor Tr13.

Accordingly, a difference (Vsn−Vs) between the non-selection level scanning signal Vsel (=Vsn) and the low level drive voltage Vsc (=Vs) is applied to and held in between the gate and the source (the both ends of the capacitor Cs) of the thin film transistor Tr13 (refer to the potential Vc between the both ends of the capacitor Cs in FIGS. 12 and 13B). Here, at least the voltage level of the non-selection level scanning signal Vsel is set to a level equal to or lower than the low level drive voltage Vsc (=Vs), whereby the potential difference (the voltage Vc between the both ends of the capacitor Cs) applied to between the gate and the source of the thin film transistor Tr13 can be set to 0V (no-electric field state) or a reverse bias state.

Incidentally, in the case where the reverse bias setting operation is performed at the start time of the non-light emitting operation period Tnem, the above-described reverse bias voltage (Vsn−Vs) is held in between the gate and the source (the both ends of the capacitor Cs) of the thin film transistor Tr13, and the no-electric field state or the reverse bias state is continuously held in the non-light emitting operation period Tnem.

As a consequence, the thin film transistor Tr13 is controlled so as to perform an OFF operation without fail. Therefore, the potential applied to the anode terminal (the contact point N12) of the organic EL element OEL is set to a level equal to or smaller than the potential Vcom (the ground potential GND) of the cathode terminal, and the reverse bias voltage is applied to the organic EL element, so that no display drive current flows in the organic EL element OEL and the light emitting operation is not performed (non-light emitting operation.

(Writing Operation Period)

Next, in the writing operation period Twrt set in the above-described non-light emitting operation period Tnem, as shown in FIGS. 12 and 14A, a selection level scanning signal Vsel is applied to the scanning line SL from the scanning driver 120 to set the display pixels EM in a selection state while a gradation current Idata having a current value (with a negative polarity) corresponding to display data is supplied to the data lines DL from the data driver 140 in synchronization with this selection timing. Furthermore, in the writing operation period Twrt, a low level drive voltage (a second voltage) Vsc (=Va) is applied to the power source line VL from the power source driver 130, and a low level bias signal Vbs is applied to the bias line BL from the reverse bias driver 170, in the same manner as in the non-light emitting operation period Tnem described above.

As a consequence, the thin film transistor Tr14 provided on the display drive circuit DC2 is set to an OFF state, whereby an electric connection between the gate terminal (the contact point N11; one end side of the capacitor Cs) of the thin film transistor Tr13 and the scanning line SL is set to a shut-down state. In addition, the thin film transistors Tr11 to Tr13 perform an ON operation in the same manner as in the writing operation period shown in the above-described first embodiment, so that a writing current Ia corresponding to the gradation current Idata flows in the direction of the data driver 140 via the thin film transistor Tr13, the contact point N12, the thin film transistor Tr12 and the data line DL from the power source line VL.

Accordingly, electric charges corresponding to the potential difference generated by the writing current Ia are accumulated between the gate and the source (the both ends of the capacitor Cs) of the thin film transistor Tr13 and are held as a voltage component Vdata (refer to the potential Vc between the both ends of the capacitor Cs in FIG. 12). In addition, a reverse bias voltage is applied to the organic EL element OEL at this time, so that no display drive current flows and the light emitting operation is not performed (the non-light emitting operation).

(Light Emitting Operation Period)

Next, in the writing operation period Twrt, or in the light emitting operation period Tem after the termination of the non-light emitting operation period Tnem including the writing operation period Twrt, as shown in FIGS. 12 and 14B, a low level scanning signal Vsel is applied to the scanning line SL from the scanning driver 120 to set the display pixels EM to a non-selection state while the supply of the gradation current Idata from the data driver 140 is shut down in synchronization with this non-selection timing, and an operation of drawing in the gradation current Idata is suspended, in the same manner as in the non-light emitting operation period Tnem. Furthermore, in the same manner as in the non-light emitting operation period Tnem, a low level bias signal Vbs is applied to the bias line BL from the reverse bias driver 170. In this writing operation period Twrt, on the other hand, a high level drive voltage (a first voltage) Vsc (=Ve) is applied to the power source line VL from the power source driver 130.

As a consequence, the thin film transistors Tr11, Tr12 and Tr14 provided on the display drive circuit DC2 perform an OFF operation, so that the electric charges (the voltage component Vdata) accumulated in the above-described writing operation period Twrt are held in the capacitor Cs, and the thin film transistor Tr13 maintains an ON operation. Furthermore, when a high level drive voltage Vsc (=Ve) is applied to the power source line VL, the potential of the anode terminal (the contact point N12) of the organic EL element OEL becomes higher than the potential (the ground potential) of the cathode terminal.

Consequently, a predetermined display drive current Ib (≈Ia) flows in the forward bias direction in the organic EL element OEL via the thin film transistor Tr13 and the contact point N12 from the power source line VL. In the light emitting operation period Tem, the organic EL element OEL continues an operation of emitting light with a luminance gradation corresponding to the display data (the gradation current Idata).

Here, there will be specifically explained an effect of change suppression of the threshold voltage (a Vth shift amount suppression effect) by means of a display pixel (a display drive circuit) having the circuit configuration described above and a display drive control method thereof.

Figure 15:
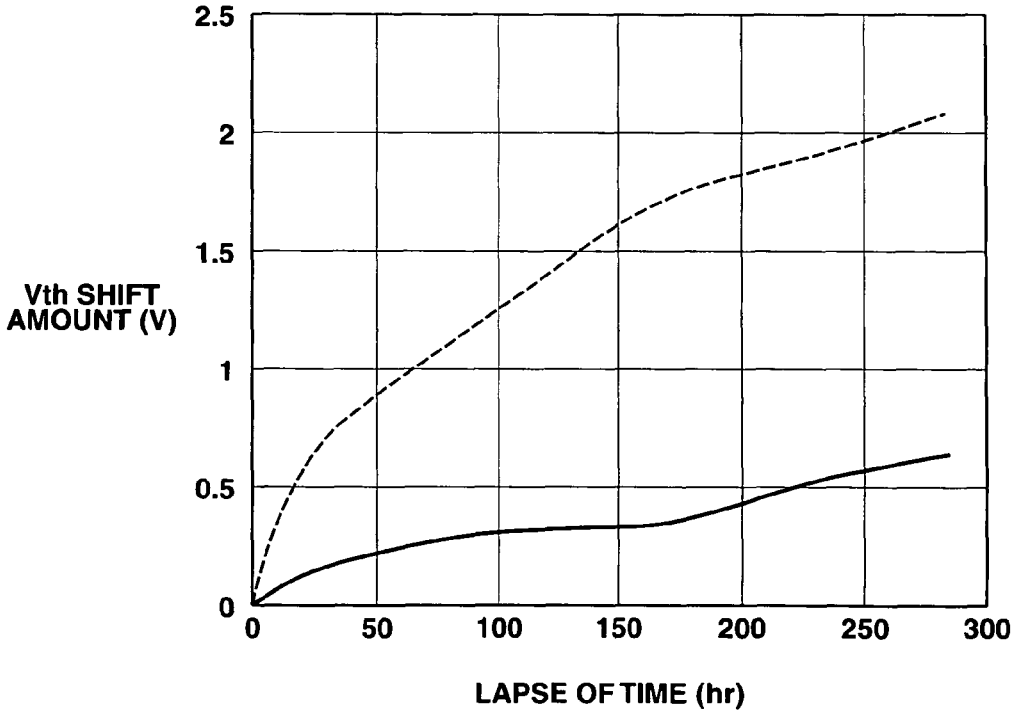
FIG. 15 is a graph showing an experiment result representative of a change amount of a threshold voltage in the case where a switching element for display drive is set to a reverse bias state in the display pixel according to the second embodiment.

FIG. 15 is a graph showing an experiment result showing a change amount (a Vth shift amount) of the threshold voltage in the case where the switching element (the thin film transistor) for display drive is set to a reverse bias state in the display pixels according to the present embodiment. Here, there is shown one example of a result of measurement in which a change tendency in the change amount of the threshold voltage is measured with respect to the lapse of time in the case where an n-channel type amorphous silicon thin film transistor applied as the display drive switching element is continuously allowed to perform an ON operation (denoted by dot lines in the drawing), and in the case where the switching element is set to a reverse bias state only in ⅕ of the drive operation period (denoted by solid lines in the drawing).

As shown in FIG. 15, in the case where a forward bias voltage is continuously applied to the thin film transistor, there is shown a tendency of remarkable increase (of about 2V with a lapse of 250 hours) in the change amount (the Vth shift amount) of the threshold voltage with the lapse of time (a horizontal axis), as shown by dot lines in the drawing. In contrast, in the case where a reverse bias voltage is applied to the thin film transistor for a definite time, it has been made clear that there is shown a tendency such that the change amount of the threshold voltage is largely suppressed (about 0.6V with a lapse of 250 hours) with respect to the lapse of time (a horizontal axis), as shown by solid lines in the figure.

It is considered that such an effect of change suppression of the threshold voltage (the Vth shift amount suppression effect) is brought about by the discharge of electric charges trapped in a nitride film by introducing electric charges into the nitride film constituting a gate insulation film in a relatively shallow area with the setting of a reverse bias state in a definite period during a drive operation period and by suppressing the introduction of the electric charges into the deep area and being set to a reverse bias state in an element structure of an amorphous silicon thin film transistor.

Consequently, even if the amorphous silicon thin film transistor is applied as the display drive switching element provided on each display pixel EM (the display drive circuit DC2), the change (Vth shift) in threshold value by the drive history can be suppressed. Accordingly, the display drive current Ib having a current value corresponding to the display data can be supplied to the organic EL element OEL and a light emitting operation (a display operation) can be performed with an appropriate luminance gradation, thereby enabling the improvement in a display image quality.

<Display Drive Method of Display Apparatus>

Next there will be explained a display drive method (an operation of displaying image information) in the display apparatus according to the present embodiment.

Figure 16:
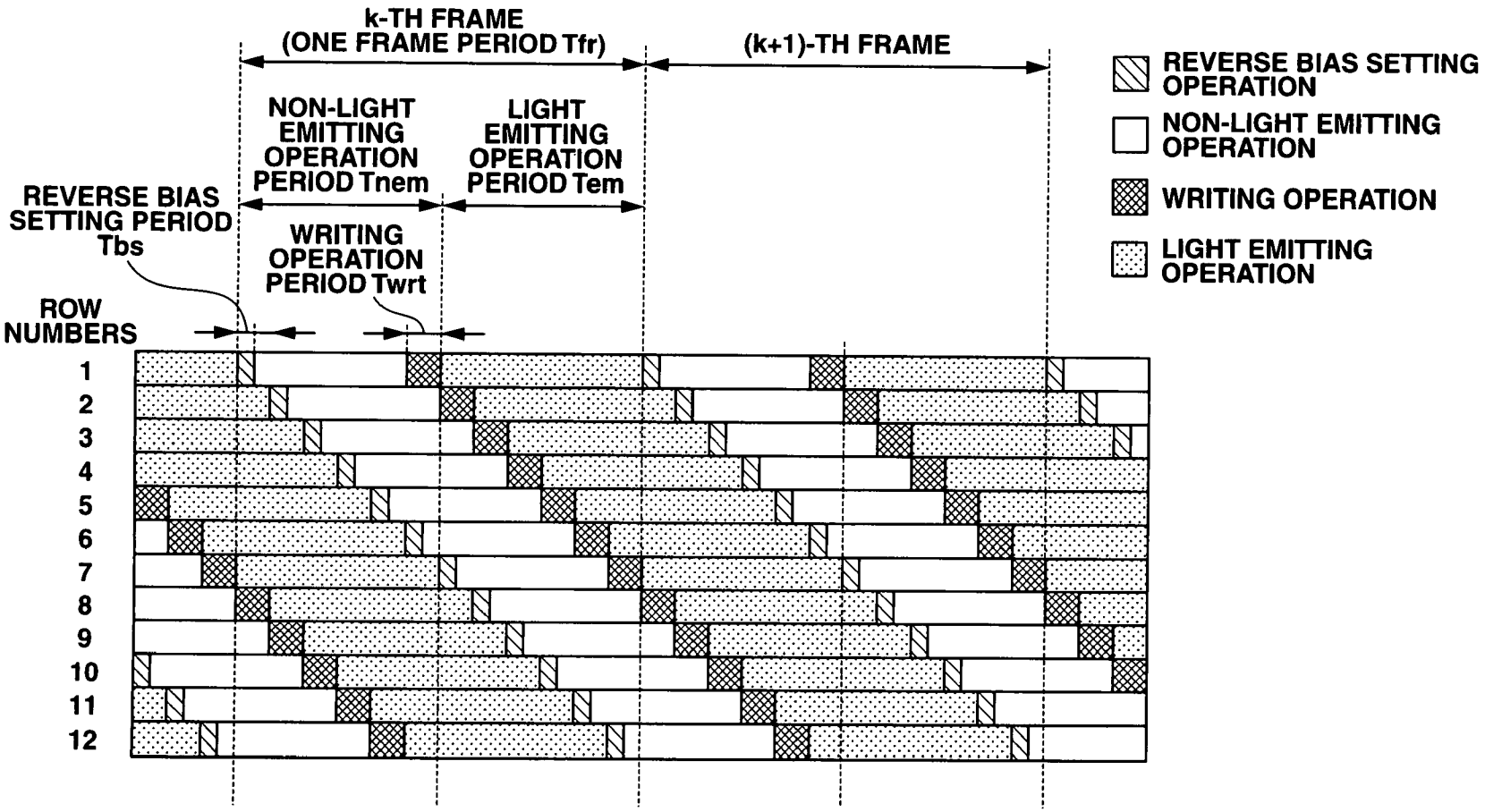
FIG. 16 is a timing chart showing one example of the display drive method of the display apparatus according to the second embodiment.

FIG. 16 is a timing chart showing one example of the display drive method of the display apparatus according to the present invention. Here, an explanation on a control method which is the same as the first embodiment described above is simplified. Furthermore, the hatching portions shown by slanted lines in each row in FIG. 16 respectively show the reverse bias period of the display data described above.

In the display drive method of the display apparatus 100B according to the present embodiment, a non-light emitting operation of preventing the display operation of the display pixels EM (preventing the light emitting operation of the organic EL element OEL) is first performed with respect to the display pixels EM (the display drive circuit DC2) for each row arranged on the display panel 110. Then, a reverse bias setting operation is sequentially performed for applying a reverse bias voltage to the display drive switching element (the thin film transistor Tr13) provided on each of the display pixels EM (the display drive circuit DC2) at an arbitrary timing (at the same time as the start of the non-light emitting operation period Tnem in the present embodiment) in the non-light emitting operation period Tnem. Thereafter, at an arbitrary timing (at the time of the termination of the non-light emitting operation period Tnem in the present embodiment) in the non-light emitting operation period Tnem, the writing operation of writing the gradation current Idata corresponding to display data is sequentially performed for each row. Subsequently, the light emitting operation is sequentially performed with a predetermined luminance gradation corresponding to the display data, whereby image information in one screen portion of the display panel 110 is displayed. Here, the operation timing is controlled so that at least the writing operation periods Twrt in the respective rows are not mutually overlapped (in terms of time).

Specifically, in the beginning, as shown in FIG. 16, in the reverse bias setting period Tbs (denoted by slanted lines in the drawing) set in synchronization with the start timing of the non-light emitting operation period Tnem in one frame period Tfr, a non-selection level scanning signal Vsel is applied to the scanning line SL in a specific row (for example, i-th row; $1 \leqq i \leqq 12$) of the display panel 110, so that the display pixels EM in the i-th row are set to a non-selection state, as shown in FIG. 12.

In synchronization with this timing, a low level drive voltage Vsc (=Vs) is applied to the power source line VL in the i-th row while applying a bias signal Vbs to the bias line BL in the i-th row. Consequently, as shown in FIG. 13B, a reverse bias voltage is applied to between the drain and the source of the display drive thin film transistor Tr13 in the display pixels EM in the i-th row (a reverse bias setting operation). Thus, the thin film transistor Tr13 performs an OFF operation, so that no display drive current Ib flows in the direction of the organic EL element OEL and the display pixels EM in the i-th row are set to a non-light emitting state (the non-light emitting operation is performed).

Furthermore, in the non-light emitting operation period Tnem (denoted by outline typefaces in the drawing) after the termination of the reverse bias setting period Tbs, a reverse bias voltage applied to between the drain and the source of the thin film transistor Tr13 is held in the reverse bias setting operation described above. Consequently, the thin film transistor Tr13 holds an OFF state, no display drive current Ib flows in the direction of the organic EL element OEL, and the display pixels EM in the i-th row continues the non-light emitting state (the non-light emitting operation is performed).

Next, as shown in FIG. 16, in the writing operation period Twrt (denoted by a cross mesh in the drawing) set in synchronization with the termination timing of the above-described non-light emitting operation period Tnem, a selection level scanning signal Vsel is applied to the scanning line SL in an i-th row, whereby the display pixels EM in the i-th row are set to a selection state, as shown in FIG. 12. Furthermore, a low level drive voltage Vsc (=Vs) is applied to the power source line VL of the i-th row.

Then, in synchronization with this selection timing, a gradation current Idata having a current value corresponding to display data in the i-th row is supplied to each of the data lines DL. As a consequence, as shown in FIG. 14A, a voltage component corresponding to the gradation current Idata is held (electric charges are accumulated) between the gate and the source (the both ends of the capacitor Cs) of the thin film transistor Tr13 of each of the display pixels EM (the display drive circuit DC2) in the i-th row.

The non-light emitting operation including such a writing operation is sequentially performed with a shift of timing for each row with respect to the display pixels EM arranged on the display panel 110. In particular, the writing operations for the respective rows are sequentially performed in such a manner that the writing operations are not mutually overlapped in terms of time.

Next, as shown in FIG. 16, in the light emitting operation (denoted by a dot hatching in the drawing), the display pixels EM in an i-th row are set to a non-selection state while the supply of the gradation current Idata to each of the data lines DL is shut down, as shown in FIG. 16.

Then, in synchronization with this timing, a high level drive voltage Vsc (=Ve) is applied to the power source line VL in the i-th row. As a result, as shown in FIG. 14B, the display drive current Ib corresponding to the display data (the gradation current Idata) is supplied to the organic EL element OEL via the thin film transistor Tr13 on the basis of the voltage component charged in each of the display pixels EM (between the gate and the source of the display drive thin film transistor Tr13), so that a light emitting operation is performed with a predetermined luminance gradation.

Such a light emitting operation is sequentially performed with a shift of timing for each of the display pixels EM in a row with which the writing operation (or the non-light emitting operation including the writing operation) described above is performed with respect to the display pixels EM arranged on the display panel 110.

That is, with respect to the plurality of display pixels EM arranged in two dimensions on the display panel 110, the non-light emitting operation period Tnem having a predetermined length is set in one frame period Tfr for each row. Therefore, a pseudo-impulse type display drive control can be realized wherein each of the display pixels EM performs a light emitting operation with a luminance gradation corresponding to the display data (the gradation current Idata) only in a definite period out of the one frame period Tfr. Consequently, moving images can be clearly displayed without blurs and stains.

Figure 26:
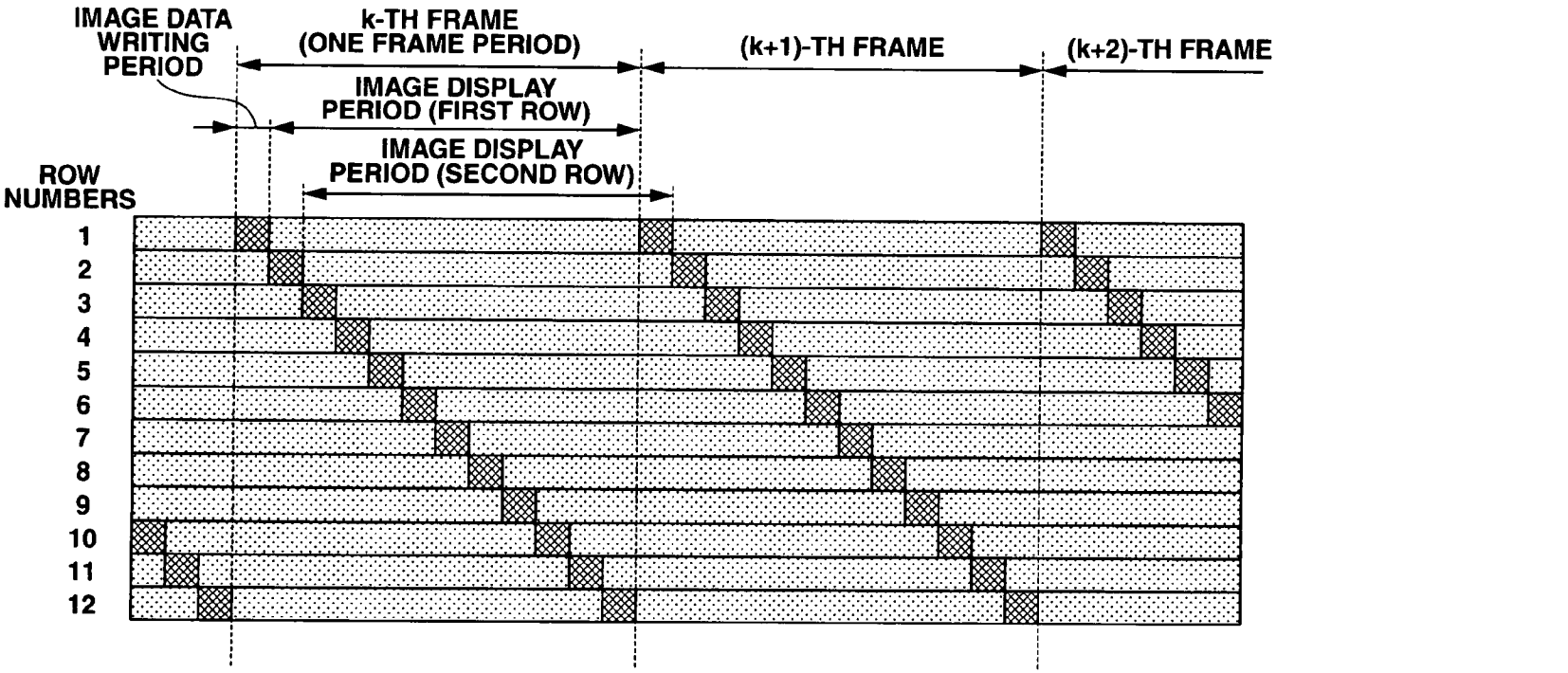
FIG.26 PRIOR ART
FIG. 26 is an equivalent circuit diagram showing a structural example of a display pixel applicable to the self-luminous type display in the prior art.

In this case, in the same manner as the display drive method (refer to FIG. 26) shown in the prior art, the writing operation is sequentially performed with respect to the display pixels EM in all the rows (twelve rows) of the display panel 110 by using the whole time of the one frame period Tfr. Accordingly, the writing operation period Twrt is not shortened in each row and the writing time can be sufficiently secured. In addition, an appropriate gradation display corresponding to the display data is realized by suppressing a deterioration of the display quality resulting from the writing insufficiency of the display data.

Moreover, in the non-light emitting operation period Tnem, a reverse bias voltage is applied to the switching element (the thin film transistor Tr13) for display drive provided on each of the display pixels EM, so that the switching element can be set to a reverse bias state. Consequently, even in the case where an amorphous silicon thin film transistor is applied as the above-described switching element, the change (Vth shift) in threshold voltage is largely suppressed, and the organic EL element OEL is allowed to perform a light emitting operation with an appropriate luminance gradation corresponding to the display data.

Third Embodiment

Next, there will be explained a display apparatus according to a third embodiment and a display drive method thereof with reference to the drawings.

Figure 17:
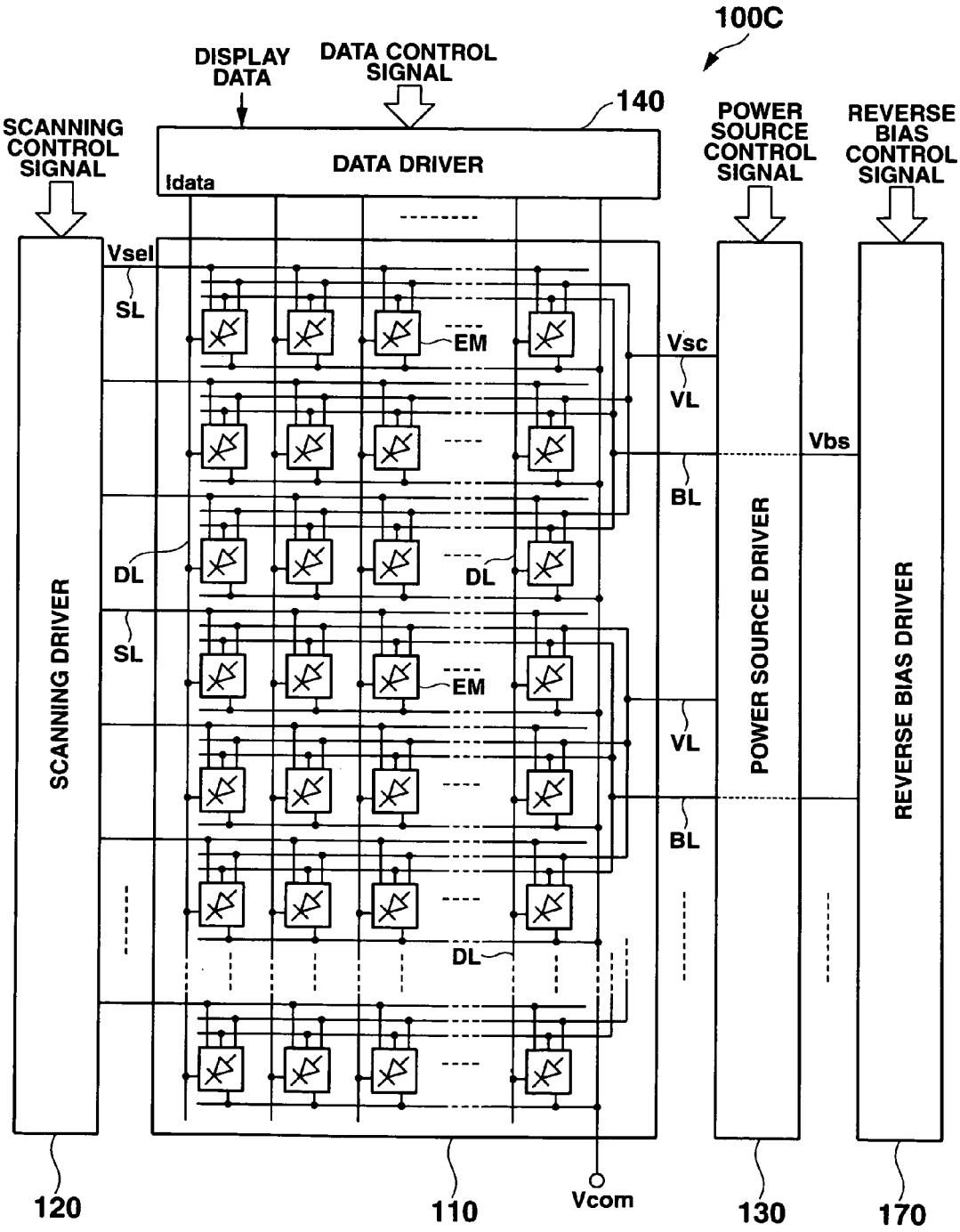
FIG. 17 is a structural diagram of a primary part, showing one example of a display panel applied to a display apparatus according to a third embodiment.

FIG. 17 is a structural diagram of a primary part, showing one example of a display panel applied to the display apparatus according to the third embodiment.

Figure 18:
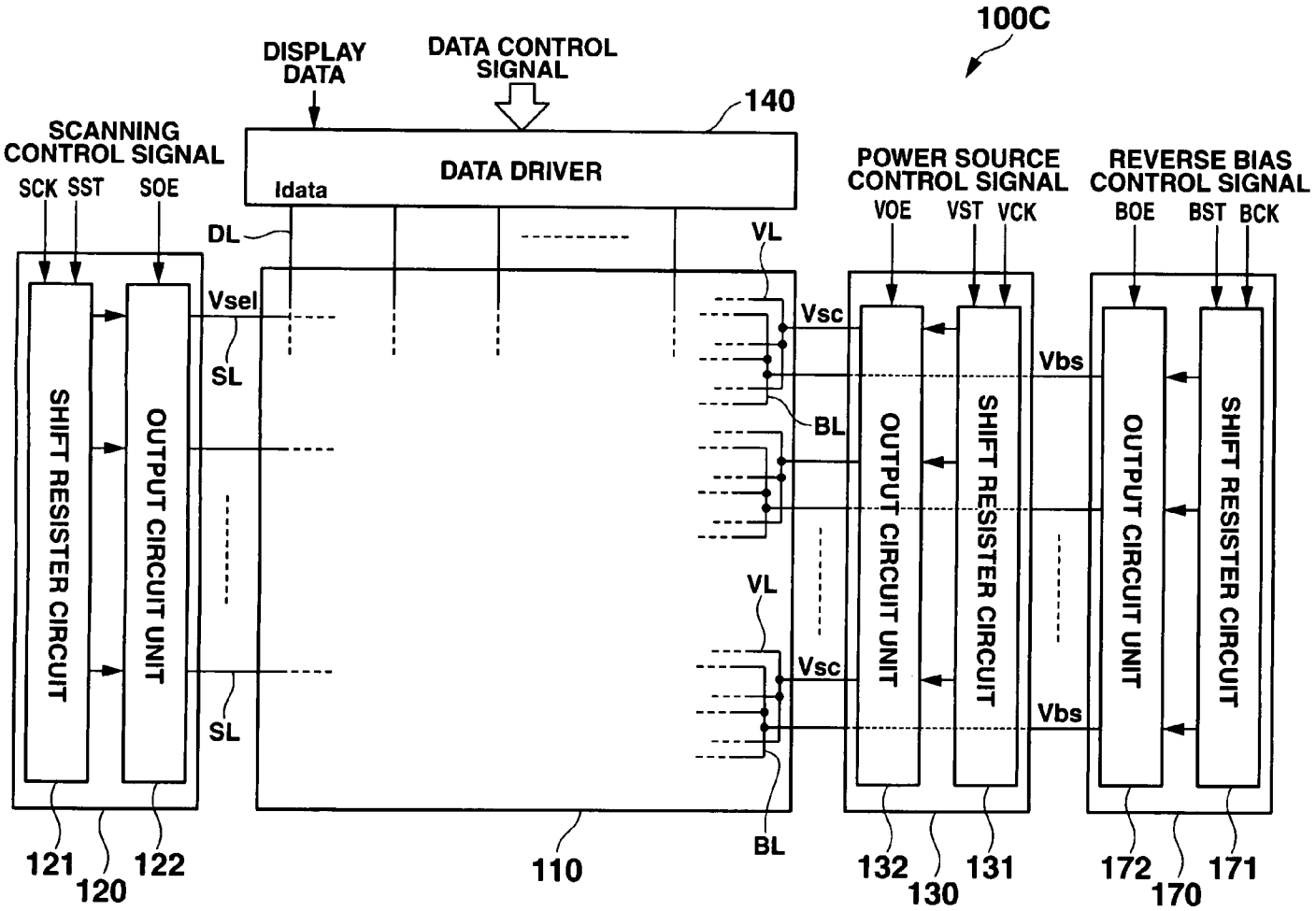
FIG. 18 is a structural diagram of a primary part, showing one example of a peripheral circuit of the display panel applied to the display apparatus according to the third embodiment.

FIG. 18 is a structural diagram of a primary part, showing one example of a peripheral circuit of the display panel applied to the display apparatus according to the third embodiment.

In the same manner as in the case of the second embodiment, the third embodiment has a configuration in which a voltage between a gate and a source of a display drive switching element of each display pixel EM is set to 0V (no voltage) or a negative voltage (a reverse bias voltage) to suppress the change in threshold voltage of the switching element in a non-light emitting operation period (a non-display operation period) other than a light emitting operation (a display operation) in one frame period.

As shown in FIGS. 17 and 18, the display apparatus 100C according to the third embodiment, in the same manner as in the second embodiment, is configured to comprise a display panel 110, a scanning driver (a scanning drive unit) 120, a power source driver (a power source drive unit) 130, a reverse bias driver (a state setting unit) 170, and a data driver (a data drive unit) 140. The display panel 110 has a plurality of display pixels EM arranged thereon in row and column directions. The scanning driver 120 sequentially sets the display pixels EM for each row to a selection state by sequentially applying a selection level scanning signal Vsel to scanning lines SL of the display panel 110. The power source driver 130 is connected with a plurality of power source lines VL arranged in parallel with the scanning lines SL in each row, and the lines are divided into groups for each of arbitrary plural rows in advance. The power source driver 130 sequentially applies a drive voltage Vsc at a predetermined timing for each group to the power source lines VL in rows included in the group. The reverse bias driver 170 is connected with a plurality of reverse bias lines BL arranged in parallel with the scanning lines SL in each row. The reverse bias driver 170 applies a reverse bias setting signal (a setting signal) Vbs at a predetermined timing to the reverse bias lines (the bias signal lines) BL in rows included in the group for each of the groups divided for each of the above-described plural rows, thereby sequentially setting the display pixels for each row to a reverse bias state (a specific bias state). The data driver 140 supplies a gradation signal (a gradation current Idata) corresponding to display data to the display pixels EM via each of the data lines DL.

Figure 19:
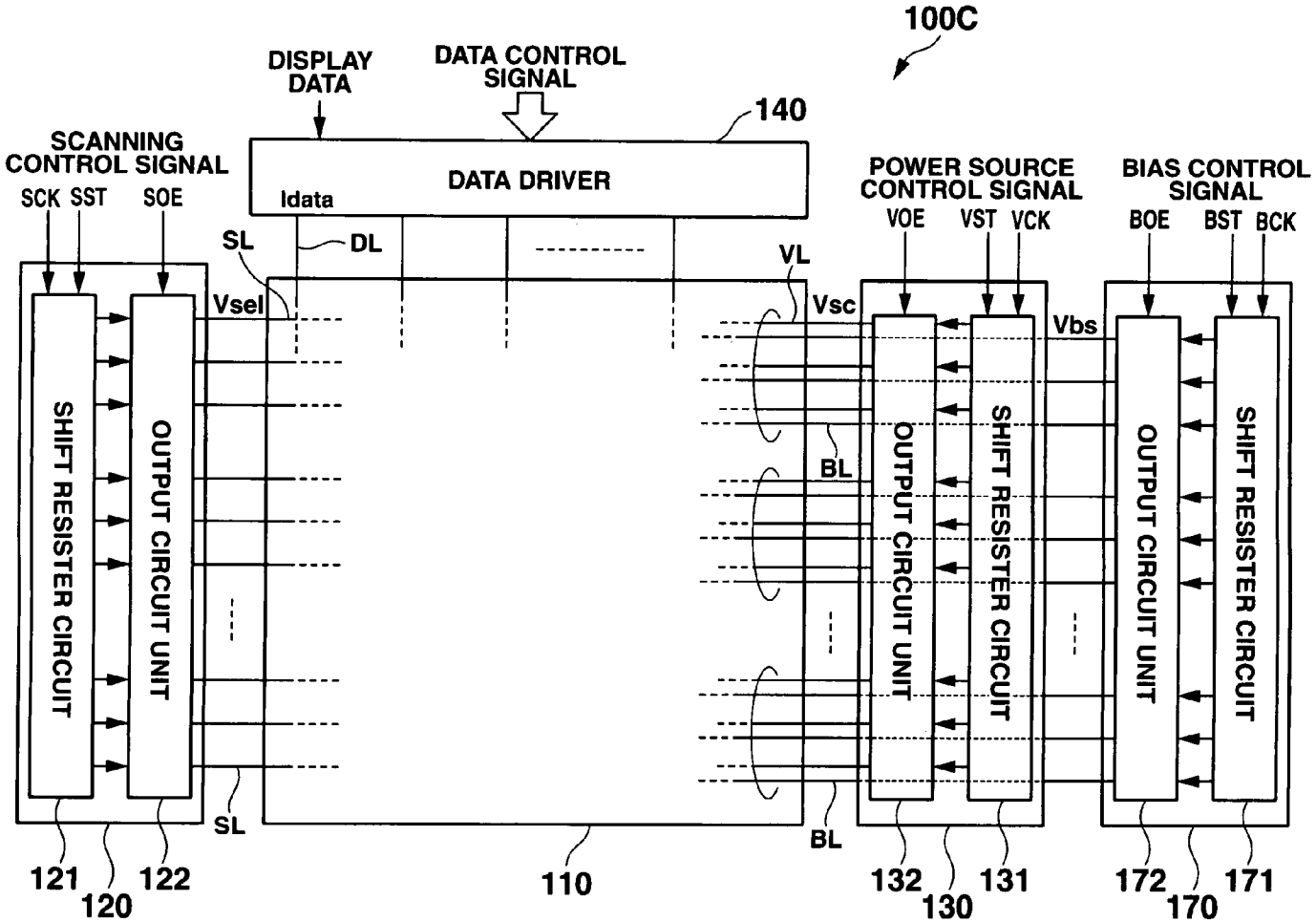
FIG. 19 is a structural diagram of a primary part, showing another example of the display panel applied to the display apparatus according to the third embodiment and the peripheral circuit thereof.

FIG. 19 is a structural diagram of a primary part, showing another example of the display panel applied to the display apparatus according to the present embodiment, and the peripheral circuit thereof (the scanning driver, the power source driver, and the reverse bias driver).

That is, another example of the display panel 110 and the peripheral circuit thereof (the scanning driver 120, the power source driver 130, and the reverse bias driver 170), as shown in FIG. 19, is configured in such a manner that individual scanning lines SL, power source lines VL and reverse bias lines BL are respectively arranged with respect to the display pixels EM in each row of the display panel 110, and that individual scanning signals Vsel, drive voltages Vsc and reverse bias setting signals Vbs are applied for each row from the scanning driver 120, the power source driver 130 and the reverse bias driver 170, respectively.

Here, with respect to the power source driver 130, a configuration can be applied wherein the drive voltages Vsc having the same voltage level are simultaneously applied to the individual power source lines VL in rows included in the same group in an output circuit unit 132 on the basis of shift signals sequentially outputted from a shift register 131 in correspondence to the power source lines VL in rows, as shown in, for example, FIG. 19, such that the drive voltages Vsc having the same voltage level can be simultaneously applied to the power source lines VL in rows included in the same group.

Also with respect to the reverse bias driver 170, a configuration can be applied wherein the reverse bias setting signals Vbs having the same voltage level are simultaneously applied to the individual reverse bias lines BL in rows included in the same group in an output circuit unit 142 on the basis of shift signals sequentially outputted from a shift register 141 in correspondence to the reverse bias lines BL in rows, as shown in, for example, FIG. 19, such that the reverse bias setting signals Vbs having the same voltage level can be simultaneously applied to the reverse bias lines BL in rows included in the same group.

<Display Drive Method of Display Apparatus>

Next, there will be explained the display drive method of the display apparatus according to the third embodiment.

Figure 20:
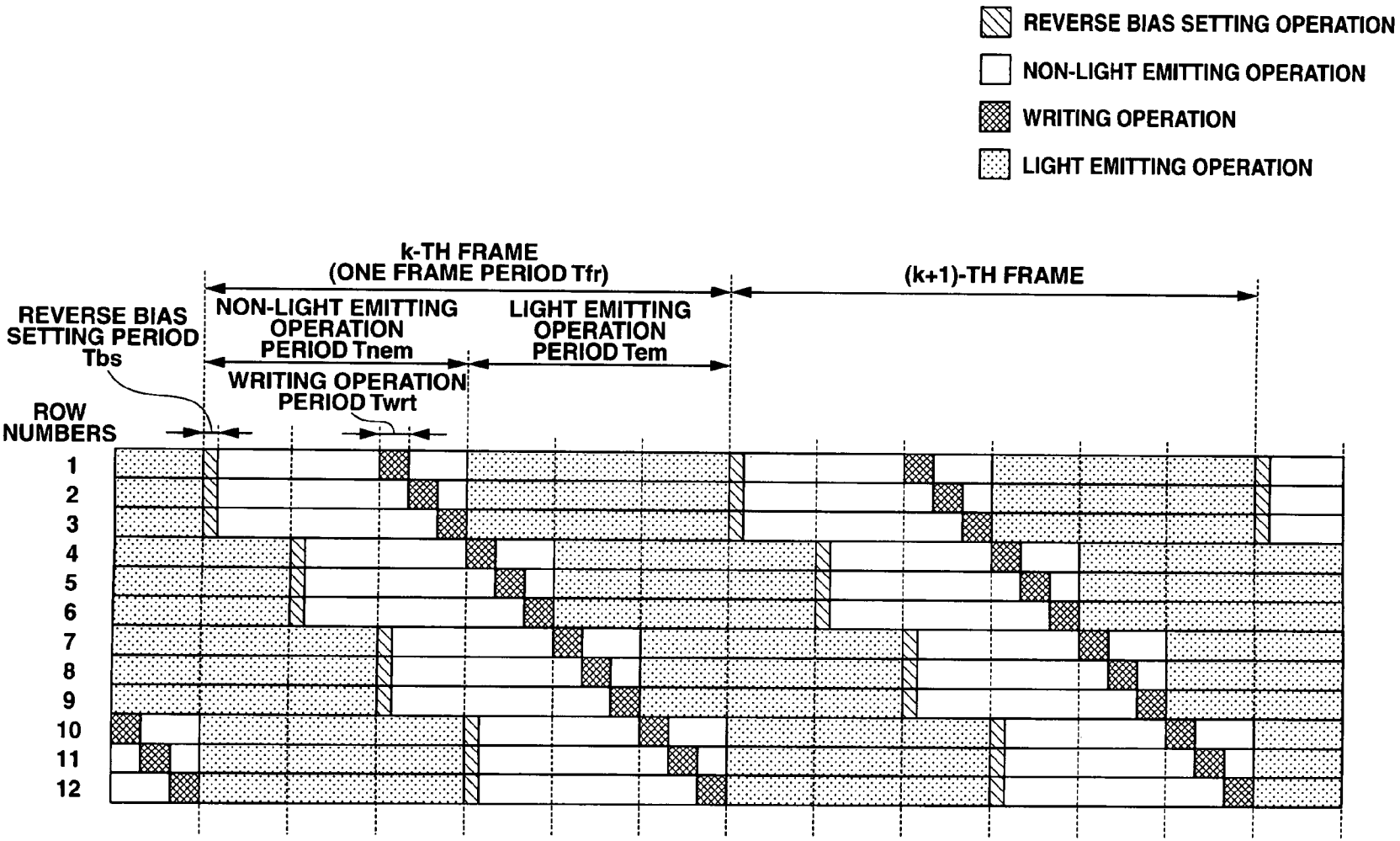
FIG. 20 is a timing chart showing a first example of the display drive method of the display apparatus according to the third embodiment.

FIG. 20 is a timing chart showing one example of the display drive method of the display apparatus according to the present embodiment.

Incidentally, in the present embodiment, it is explained, for the sake of explanation, that there is provided a configuration in which twelve rows (n=12; first to twelfth rows) of display pixels are conveniently arranged on the display panel. Furthermore, in the figure, symbol k denotes a positive integer, and the hatching portions shown by slanted lines of each row in the figure respectively denote the reverse bias setting period of the display data described above. The hatching portions shown by cross meshes respectively denote the writing operation period of the display data described above, and the hatching portions shown by dots respectively denote the light emitting operation period described above.

In a display drive method of a display apparatus 100C according to the present embodiment, in the beginning, a non-light emitting operation (a non-display operation) of preventing the display operation of the display pixels EM (preventing the light emitting operation of the organic EL element OEL) is performed for each of the display pixels EM in plurality rows divided into groups in advance with respect to the display pixels EM (the display drive circuit DC) for each row arranged on the display panel 100. Then, a writing operation of writing a gradation current Idata corresponding to display data is sequentially performed for each row at an arbitrary timing (at the time of the termination of the non-light emitting operation period Tnem in the present embodiment) in the non-light emitting operation period Tnem. Thereafter, each of the display pixels EM in a plurality of rows in each group is allowed to simultaneously perform a light emitting operation with a predetermined luminance gradation corresponding to display data (a gradation current), so that image information in one screen portion of the display panel 110 is displayed.

Specifically, in the beginning, all the display pixels EM arranged on the display panel 110 are divided into groups in advance for each of plurality rows. For example, as shown in FIG. 20, the display pixels EM in the twelve rows constituting the display panel 110 are divided into four groups by respectively setting three rows of display pixels EM as one set, such as the mutually adjacent first to third rows; the fourth to sixth rows; the seventh to ninth rows; and the tenth to twelfth rows.

Then, in the non-light emitting operation period (the non-display operation period) Tnem (denoted by outline typefaces in the drawing) in one frame period Tfr, a low level drive voltage (a second voltage) Vsc (=Vs) is applied from the power source driver 130 to the power source lines VL in plural rows included in the same group of the display panel 110. Thereby, as in FIGS. 12 and 13A described above, no potential difference is generated between the drain and the source of the display drive thin film transistor Tr13 in the display pixels EM in all the rows included in the group. Consequently, no display drive current Ib flows in the organic EL element OEL via the thin film transistor Tr13, so that all the display pixels EM in the group are set to a non-light emitting state (the non-light emitting operation is performed).

Here, in the non-light emitting operation period Tnem except for the writing operation period described above, a non-selection level scanning signal Vsel is applied from the scanning driver 120 with respect to the scanning line SL in all the rows included in the group which performs the non-light emitting operation while the display pixels EM are set to a state in which no gradation current Idata is supplied to each of the data lines DL from the data driver 140 (a state in which the supply of the gradation current Idata is shut down).

Then, in the reverse bias setting period Tbs (denoted by slanted lines in the drawing) set at an arbitrary timing in the non-light emitting operation period Tnem (in synchronization with the start timing of the non-light emitting operation period Tnem in the present embodiment), a reverse bias setting signal Vbs is applied from the reverse bias driver 170 to the reverse bias lines BL in all the rows included in the group which performs the non-light emitting operation in the same manner as shown in FIGS. 12 and 13B described above. As a consequence, a reverse bias voltage is applied to between the gate and the source of the display drive thin film transistor Tr13 in each of the display pixels EM included in the group (a reverse bias setting operation), so that the thin film transistor Tr13 performs an OFF operation.

In the non-light emitting operation period Tnem (denoted by outline typefaces in the drawing) after the termination of the reverse bias setting period Tbs, the reverse bias voltage applied to between the gate and the source of the thin film transistor Tr13 is held by the reverse bias setting operation described above, whereby the thin film transistor Tr13 holds an OFF state.

Next, as shown in FIG. 20, in the writing operation period Twrt (denoted by cross meshes in the drawing) set at an arbitrary timing after an elapse of a definite time in the reverse bias state by the above-described reverse bias setting operation in the non-light emitting operation period Tnem, the display pixels EM in each row are sequentially set to a selection state by sequentially applying the selection level scanning signal Vsel to the scanning lines SL in each row of the display panel 110 from the scanning driver 120, in the same manner as shown in FIGS. 12 and 14A described above.

Then, in synchronization with this selection timing, a gradation current Idata having a current value corresponding to display data in each row from the data driver 140 is supplied to each of the data lines DL. Thereby, a writing current Ia corresponding to the gradation current Idata flows in the display drive circuit DC of each of the display drive pixels EM in the row in the same manner as shown in FIG. 14A described above, so that a voltage component (Vdata) corresponding to the gradation current Idata is held in between the gate and the source (the both ends of the capacitor Cs) of each thin film transistor Tr13.

Such a writing operation period Twrt is sequentially performed with a shift of timing with respect to the display pixels EM arranged on the display panel 110 such that the writing operation periods are not overlapped in terms of time for each row. Here, in the writing operation period Twrt, while the display pixels EM in rows included in the same group are set to a selection state, a low level drive voltage Vsc (=Vs) is applied from the power source driver 130 to the power source lines VL in all the rows in the same group, whereby a reverse bias voltage is applied to the organic EL element OEL. Consequently, no current flows in the organic EL element OEL from the display drive circuit DC, and all the display pixels EM in the group are set to a non-light emitting state (the non-light emitting operation is performed).

Next, as shown in FIG. 20, in the light emitting operation (the display operation period) Tem (denoted by dot hatching in the drawing), a non-selection level scanning signal Vsel is applied from the scanning driver 120 to the scanning lines SL in rows included in the same group in the same manner as shown in FIGS. 12 and 14B described above. As a consequence, all the display pixels EM in the group are set to a non-selection state while the supply of the gradation current Idata to each of the data lines DL from the data driver 140 is shut down.

Then, in synchronization with this timing, a high level drive voltage (a first voltage) Vsc (=Ve) is applied from the power source driver 130 to the power source lines VL in rows included in the group. Consequently, a display drive current Ib corresponding to the display data (the gradation current Idata) is supplied to the organic EL element OEL on the basis of the voltage component held in each of the display pixels EM (between the gate and the source of the display drive thin film transistor Tr13) of the group in the same manner as shown in FIG. 14B described above. Thus, the light emitting operation is performed with a predetermined luminance gradation.

Such a light emitting operation is simultaneously started with respect to the display pixels EM in all the rows included in the same group in synchronization with the timing of the termination of the above-described writing operation (immediately after the termination thereof) with respect to the display pixels EM in all the rows of the group, and the light emitting operation is continuously performed until the timing of the start of the next non-light emitting operation (including the reverse bias setting operation) with respect to the respective rows of the group.

That is, like the present embodiment, the non-light emitting operation and the reverse bias setting operation are simultaneously performed with respect to the display pixels EM in each row in the group in which the display pixels EM in the first to third rows are set to one set. Thereafter, after the writing operation is performed in order up to the display pixels EM in the first row to those in the third row, the display pixels EM in each row simultaneously perform the light emitting operation. This light emitting operation continues until the timing of the start of the non-light emitting operation and the reverse bias setting operation in the next one frame period Tfr with respect to the display pixels EM in the first to third rows included in the group.

Hereinafter, the same operation is performed sequentially with a shift of timing in such a manner that the writing operations in respective rows are not overlapped in terms of time with respect to respective groups in which the display pixels EM in the fourth to sixth rows, the display pixels EM in the seventh to ninth rows and the display pixels EM in the tenth to twelfth rows are set to one set.

Accordingly, in such a display drive method of the display apparatus, the non-light emitting operation period Tnem having a predetermined length is set to one frame period Tfr for each group in which the display pixels in plural rows are set to one set. As a consequence, a pseudo-impulse type display drive control can be realized wherein each of the display pixels EM performs a light emitting operation with a luminance gradation corresponding to the display data (the gradation current Idata) for a definite period out of one frame period Tfr.

Incidentally, the execution timing and the execution time (length) of the non-light emitting operation, the reverse bias setting period Tbs, the writing operation period Twrt, and the light emitting operation period Tem which are executed in one frame period Tfr can be arbitrarily set with the scanning control signal, the power source control signal, the reverse bias control signal and the data control signal which are supplied as the timing control signals to the scanning driver 120, the power source driver 130, the reverse bias driver 170, and the data driver 140 from the system controller 150.

Here, in the timing chart shown in FIG. 20, a control is made in such a manner that the display pixels EM in twelve rows constituting the display panel 110 are divided into four groups, whereby the non-light emitting operation (including the reverse bias setting operation) and the light emitting operation are simultaneously performed at timings different for each of the groups. Consequently, a ratio of the non-display period (a black insertion ratio) by the above-described non-light emitting operation in one frame period Tfr is set to approximately 50%, so that a half of image information (a display screen) displayed on the display panel 110 can be provided as a black display (no display).

In order to allow clear recognition of moving images without blurs and stains with a human sense of vision, a black insertion ratio of about 30% or more is generally preferable. Consequently, according to the present embodiment, it is possible to realize a display apparatus which can display moving images of good display quality. Incidentally, the black insertion ratio (the ratio of the non-display period) in one frame period Tfr is not limited to 50% described above. The black insertion ratio can be arbitrarily set depending on the number of groups. In particular, it is desired that the black insertion ratio is not less than 30% described above, but a value of 30% or less is also possible.

Further, in the present embodiment, as shown in FIG. 20, there is explained a case in which the writing operation is sequentially performed with respect to the display pixels EM in all the rows (twelve rows) of the display panel 110 by using a majority of time (two thirds of period in one frame period Tfr in FIG. 20) of one frame period Tfr. Even if the period in which the reverse bias state is held is set to a relatively short time of one frame period Tfr (for example, one fifth of one frame period Tfr), the change in threshold voltage (the Vth shift amount) in the switching element (the thin film transistor Tr13) for display drive provided on each of the display pixels EM can be largely suppressed. As a result, the writing operation can be sequentially performed with respect to the display pixels EM in all the rows of the display panel 110 by using a majority of time of one frame period Tfr.

Figure 27:
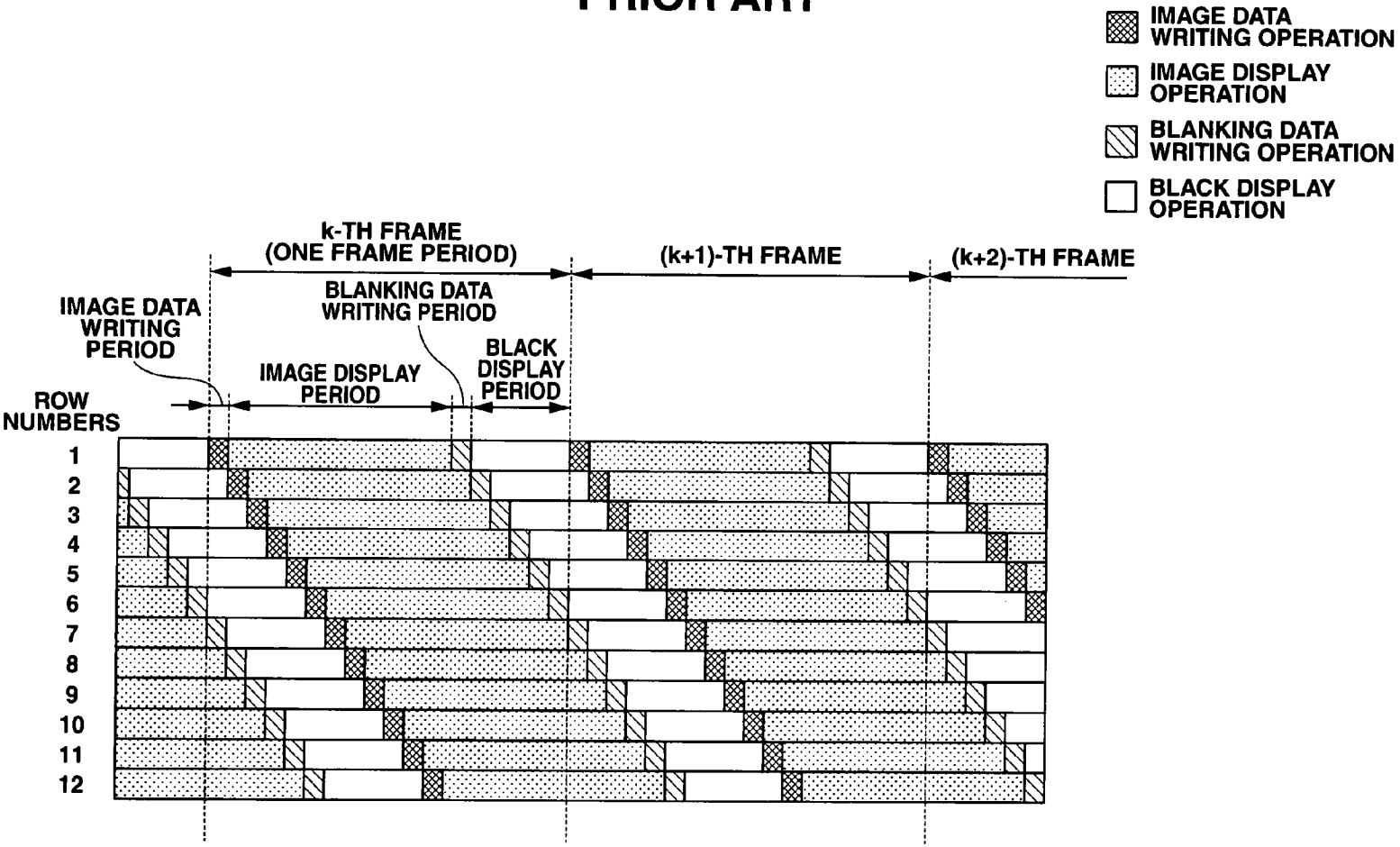
FIG.27 PRIOR ART
FIG. 27 is a timing chart showing one example of a display drive method of a display panel in the prior art.

In this case, like the display drive method shown in FIG. 27, the writing operation period Twrt (corresponding to the image data writing period in the prior art) in each row is not largely shortened in order to realize the writing operation of blanking data and the black display operation, the writing time of each row can be sufficiently secured, and an appropriate gradation display corresponding to display data can be realized by suppressing the deterioration of the display quality resulting from the writing insufficiency of the display data. In addition, this enables providing an allowance in the timing control of various kinds of signals, whereby the generation of an erroneous operation of the display apparatus can be suppressed.

Moreover, a reverse bias state can be set by applying a reverse bias voltage to the switching element (the thin film transistor Tr13) for display drive provided on each of the display pixels EM in the non-light emitting operation period Tnem. Consequently, even in the case where an amorphous silicon thin film transistor is applied as the above-described switching element, the organic EL element OEL can perform a light emitting operation with an appropriate luminance gradation corresponding to display data by largely suppressing the change in threshold voltage (the Vth shift amount).

In addition, in the present embodiment, the voltage level of the drive voltage Vsc is set for each group in order to control the light emitting operation and the non-light emitting operation. Thus, as shown in FIGS. 17 and 18, a single drive voltage Vsc is output for each group, and the drive voltage Vsc can be simultaneously applied to the display pixels EM in each row via the power source lines VL branched and arranged in the group. Furthermore, in order to suppress the change in threshold voltage of the switching element (the thin film transistor Tr13) for display drive provided on each of the display pixels EM, the application state (application and shutdown) of the reverse bias setting signal Vsc is set for each group. Therefore, as shown in FIGS. 17 and 18, a single reverse bias setting signal Vbs is output for each group, so that the reverse bias setting signal Vbs can be simultaneously applied to the display pixels EM in each row via the reverse bias lines BL branched and arranged in the group.

Accordingly, at least, the number of connection terminals for transmitting the drive voltage Vsc between the display panel 110 and the power source driver 130 and the number of connection terminals for transmitting the reverse bias setting signal Vbs between the display panel 110 and the reverse bias driver 170 can be set to the number (four in the present embodiment) corresponding to the number of groups set in the display panel 110. Consequently, the number of connection terminals can be largely decreased as compared with the case in which the connection terminals are provided for the power source lines VL and the reverse bias lines BL of each row while a circuit configuration of the power source driver 130 and the reverse bias driver 170 can be simplified.

Incidentally, in the present embodiment, as shown in the timing chart shown in FIG. 20, there is explained, for the sake of explanation, a case in which the light emitting operation (the display operation) is performed after the non-light emitting operation (non-display operation) including the reverse bias setting period and the writing operation period are performed in one frame period Tfr. The control operation is substantially the same, for example, even if the light emitting operation having a predetermined length is performed after the writing operation which is not accompanied by the light emitting operation of the organic EL element OEL (the display operation of the display pixels EM) is performed, and thereafter, the non-light emitting operation including the reverse bias setting operation is performed.

Next, there will be explained a second example of the display drive method which can be applied to the display apparatus according to the present embodiment with reference to the drawings.

Figure 21:
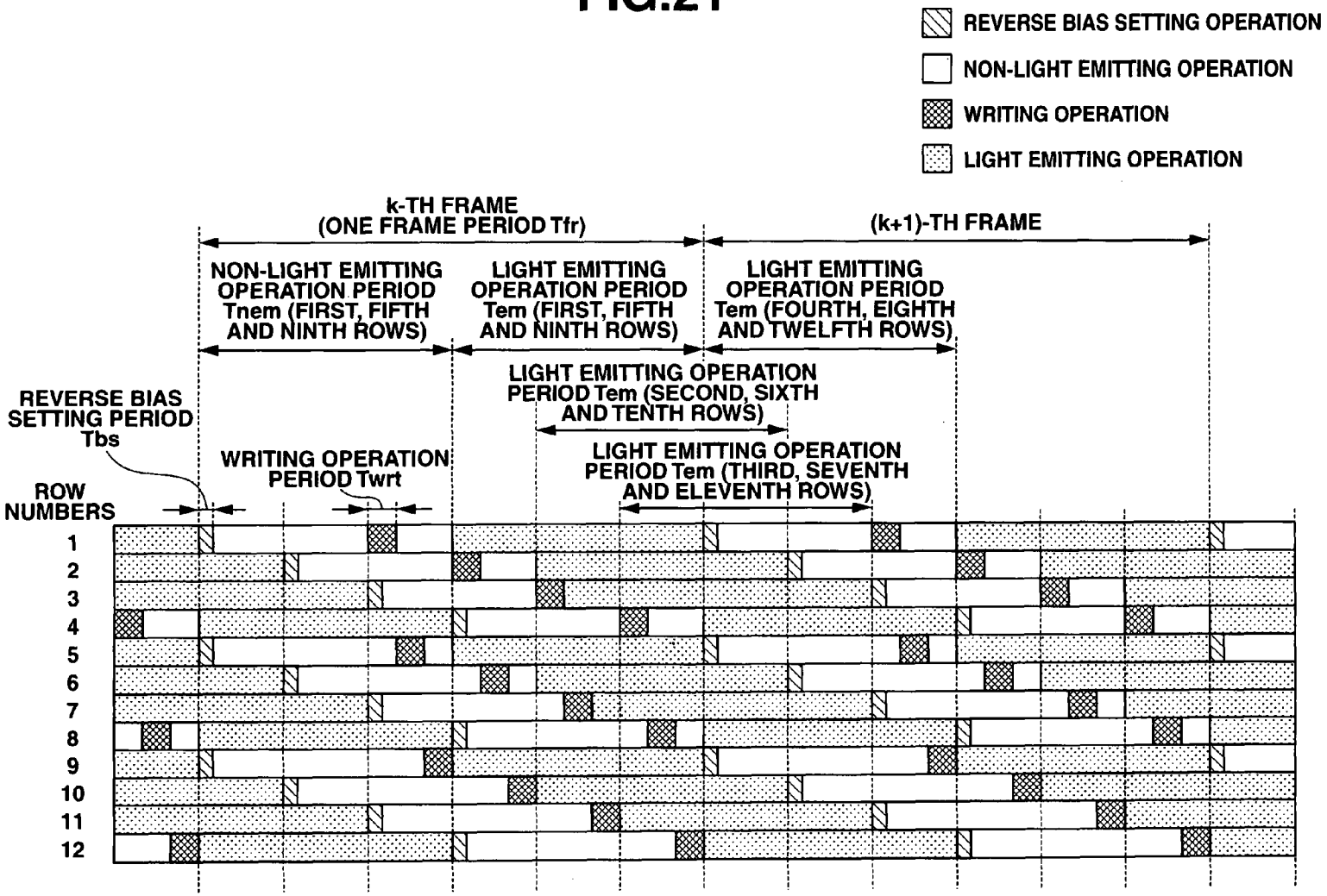
FIG. 21 is a timing chart showing a second example of the display drive method of the display apparatus according to the third embodiment.

FIG. 21 is a timing chart showing a second example of the display drive method of the display apparatus according to the present embodiment.

Here, an explanation on the display drive method which is the same as the above-described first example (refer to FIG. 20) described above will be simplified.

In the second example of the display drive method of the display apparatus 100C according to the present embodiment, the following operation is performed in one frame period Tfr. That is, a plurality of display pixels EM which are arranged on the display panel 110 and which are not mutually adjacent (continuous) to one another are divided into groups as one set, the above-described non-light emitting operation (including the reverse bias setting operation) and light emitting operation are simultaneously performed with respect to the display pixels EM for each group, and an operation is performed for sequentially performing the above-described writing operation with a shift of timing with respect to the display pixels EM for each row.

Specifically, as shown in, for example, FIG. 21, the display pixels EM in twelve rows constituting the display panel 110 are divided into four groups by setting three rows of display pixels EM respectively to one set, i.e. such as a set of the first, fifth and ninth rows; a set of the second, sixth and tenth rows; a set of the third, seventh and eleventh rows; and a set of the fourth, eighth and twelfth rows. For example, in the group in which the display pixels in the first, fifth and ninth rows are set as one set, the non-light emitting operation and the reverse bias setting operation are performed with respect to the display pixels EM in all the rows included in the group. Thereafter, the above-described writing operation is performed with respect to the display pixels EM in order of the first row, the fifth row and the ninth row. After the writing operation is completed with respect to the display pixels EM in the ninth row, the display pixels EM in all the rows of the first, fifth and ninth rows included in the group simultaneously perform the light emitting operation. This light emitting operation continues with respect to the display pixels EM in the first, fifth and ninth rows until the timing of performing the non-light emitting operation (including the reverse bias setting operation) in the next frame period.

Furthermore, at the timing of the completion of the writing operation with respect to the display pixels EM in the ninth row, the non-light emitting operation and the reverse bias setting operation, or the light emitting operation are/is simultaneously performed at a predetermined timing in such a manner that the above-described writing operation is performed with respect to the display pixels EM in an order of the second row, the sixth row and the tenth row in a group in which the display pixels EM in the second, sixth and tenth rows are set to one set. Hereinafter, the same operation is repeatedly performed in a group in which the third, seventh and eleventh rows are set as one set and in a group in which the fourth, eighth and twelfth rows are set as one set.

Consequently, even with such a display drive method of the display apparatus, a pseudo-impulse type display drive control, in the same manner as in the display drive method according to the first example described above, can be realized wherein the light emitting operation is performed with a luminance gradation corresponding to display data only in a definite period in one frame period Tfr for each group while the non-light emitting operation (including the reverse bias setting operation and the writing operation) is performed in a period except for the light emitting operation. Here, in the present display drive method as well, a ratio of the non-display period (a black insertion ratio) by the non-light emitting operation can be set to 30% or more, whereby a display apparatus can be realized wherein the clarity is improved by suppressing the blurs and stains of the moving images.

Further, for each of the rows included in each of the groups, the switching element (the thin film transistor Tr13) for display drive provided on each of the display pixels EM can be set to a reverse bias state. Accordingly, the large change in threshold voltage (the Vth shift amount) which is generated resulting from the drive history can be largely suppressed in an amorphous silicon thin film transistor applied to the switching element, and the organic EL element OEL is allowed to perform the light emitting operation with an appropriate luminance gradation corresponding to display data.

Moreover, in this case as well, the timing of the writing operation is appropriately set by the system controller 150, whereby the writing operation can be sequentially performed with respect to the display pixels EM in all the rows (twelve rows) of the display panel 110 by using a majority of time of one frame period Tfr. Consequently, the writing time of each row can be sufficiently secured, and the deterioration of the display quality resulting from the writing insufficiency of display data is suppressed, thereby enabling realizing an appropriate gradation display corresponding to the display data.

In addition, the voltage level of the drive voltage Vsc and the application state of the reverse bias setting signal Vbs are set for each of groups in order to control the light emitting operation and the non-light emitting operation as well as the reverse bias setting operation. Therefore, the number of connection terminals between the display panel 110 and the power source driver 130, and the number of connection terminals between the display panel 110 and the reverse bias driver 170 are decreased to the number corresponding to the number of the above-described groups (four in the present embodiment), thereby enabling simplification of the circuit configuration of the power source driver 130 and the reverse bias driver 170.

Incidentally, in the display drive methods according to the first and second examples described above, there will be explained a case in which the display pixels EM constituting the display panels 110 are divided into four groups by setting three rows to one set. However, the present invention is not limited thereto. It goes without saying that the number of the groups can be set by appropriately increasing and decreasing the number thereof.

Fourth Embodiment

Next, there will be explained a display apparatus according to a fourth embodiment and a display drive method thereof with reference to the drawings.

<Display Apparatus>

Figure 22:
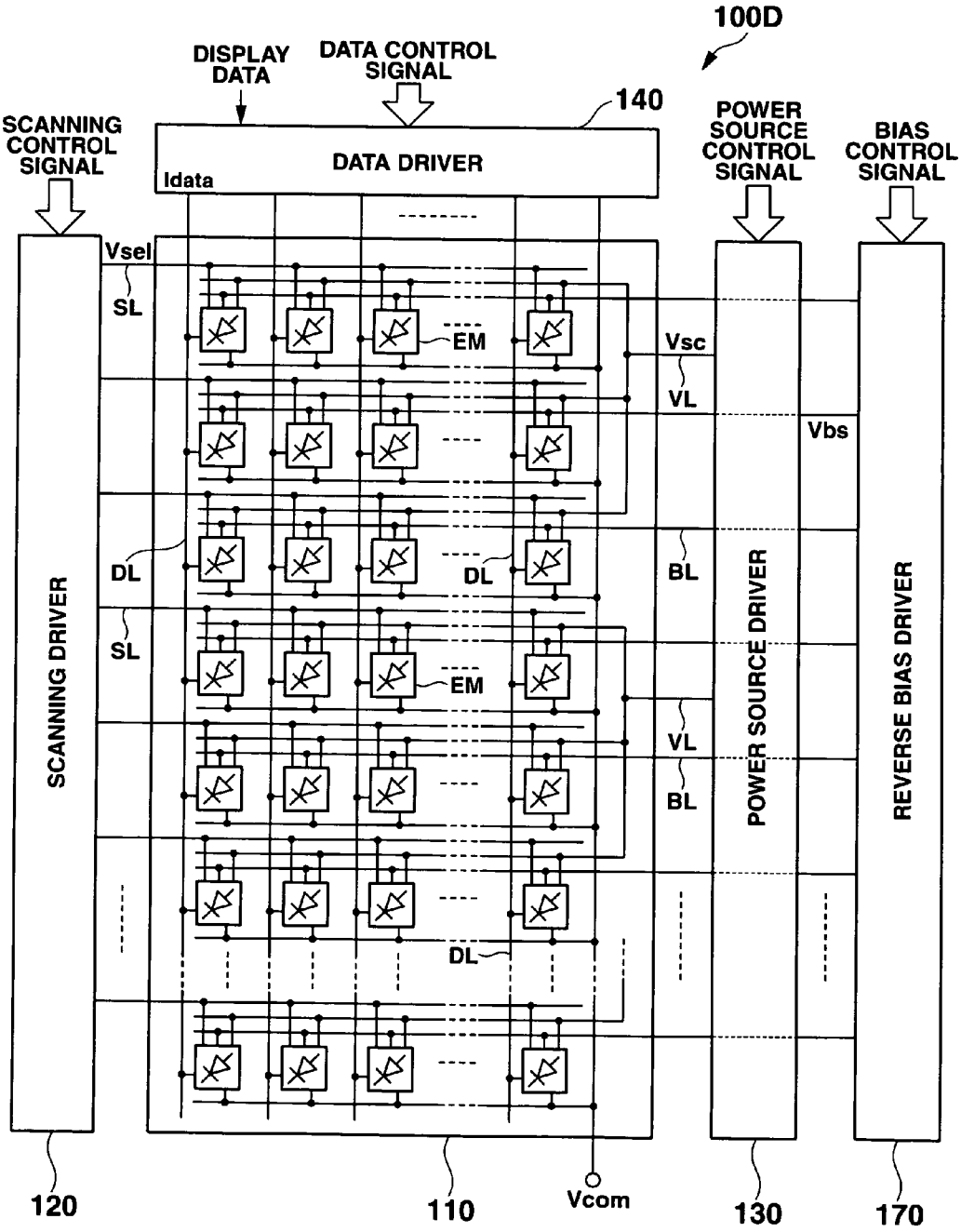
FIG. 22 is a structural diagram of a primary part, showing one example of a display panel applied to a display apparatus according to a fourth embodiment and a peripheral circuit thereof.

FIG. 22 is a structural diagram of a primary part, showing one example of a display panel which is applied to the display apparatus according to the fourth embodiment and a peripheral circuit thereof.

Here, the same components as those in the third embodiment described above are denoted by the same or similar symbols, and an explanation thereof is simplified.

In the same manner as in the second and third embodiments, the present embodiment has a configuration in which a voltage between a gate and a source of a display drive switching element of each display pixel EM is set to 0V (no voltage) or a negative voltage (a reverse bias voltage) in the non-light emitting operation period (the non-display operation period) except for the time of the light emitting operation (the display operation) in one frame period to suppress the change in threshold voltage of the switching element.

As shown in FIG. 22, a display apparatus 100D according to the present invention, in the same manner as in the first embodiment described above, has a configuration which comprises a display panel 110, a scanning driver 120, a power source driver 130, a reverse bias driver 170, a data driver 140, a system controller 150, and a display signal generation circuit 160. On the display panel 110, a plurality of display pixels EM arranged in two dimensions are divided into groups for each of arbitrary plural rows. The scanning driver 120 is connected with scanning lines SL in each row of the display panel 110. The power source driver 130 is connected with power source lines VL in each row. The reverse bias driver 170 is connected with reverse bias lines BL in each row. The data driver 140 is connected with data lines DL in each column. The system controller 150 outputs a timing control signal (a scanning control signal, a power source control signal, a reverse bias control signal and a data control signal) to the respective drivers described above. The display signal generation circuit 160 generates display data (luminance gradation data) and supplies the data to the data driver 140. In particular, the present embodiment has a configuration in which a single power source line VL is branched and arranged so as to correspond to the display pixels EM in each row for each of the above-described groups, and further, individual reverse bias lines BL are arranged so as to correspond to the display pixels EM in each of the rows included in each of the groups.

That is, in the same manner as in the third embodiment described above, the power source driver 130 is configured to sequentially output for each group a single drive voltage Vsc corresponding to the power source lines VL in a plurality of rows in each group while the reverse bias driver 170 is configured to sequentially output for each row individual reverse bias setting signal Vbs corresponding to the reverse bias lines BL in the plurality of rows included in each row, as in the above-described scanning driver 120.

As a consequence, a drive voltage Vsc having a predetermined voltage level is simultaneously applied for each group from the power source driver 130 with respect to the power source lines VL in the rows included in each group. Accordingly, in the case where a low level drive voltage (a second voltage) Vsc (=Vs) is applied, the display pixels EM in all the rows in the group are simultaneously set to a light emitting state. On the other hand, in the case where a high level drive voltage (a first voltage) Vsc (=Ve) is applied, the display pixels in all the rows of the group are simultaneously set to a light emitting state (a gradation display state).

Furthermore, a reverse bias setting signal Vbs is sequentially applied for each row from the reverse bias driver 170 to the reverse bias lines BL in each of the rows included in each group. Consequently, in the same manner as in the case in which the display pixels in each row are sequentially set to a selection state with the scanning signal Vsel output from the scanning driver 120, the display pixels EM in each row are sequentially set to a reverse bias state.

<Display Drive Method of Display Apparatus>

Next, there will be explained a display drive method (an operation of displaying image information) in the display apparatus according to the present embodiment.

Figure 23:
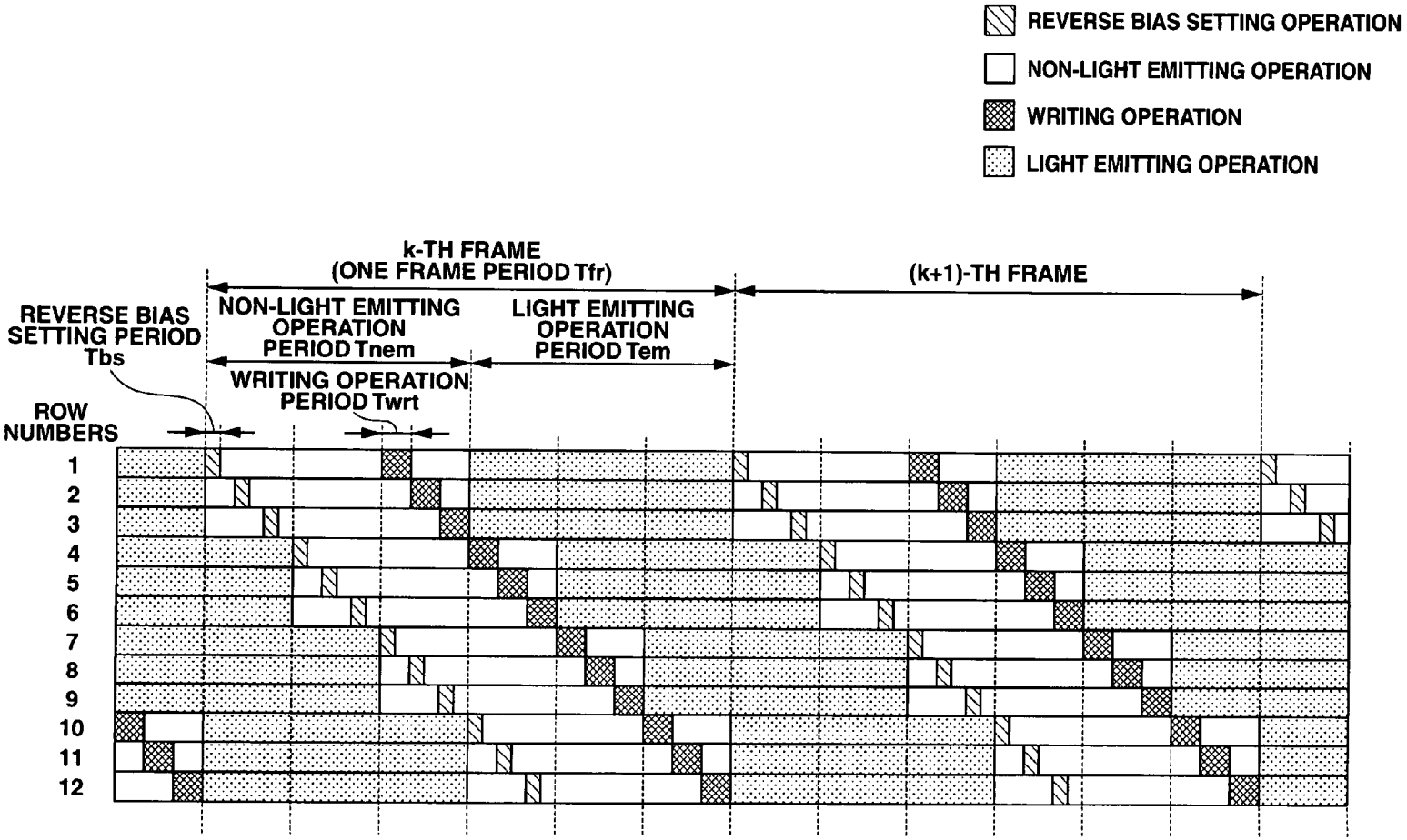
FIG. 23 is a timing chart showing a first example of a display drive method of the display apparatus according to the fourth embodiment.

FIG. 23 is a timing chart showing a first example of the display drive method of the display apparatus according to the fourth embodiment. Here, the drive control method of the display pixels shown in the above-described first embodiment will be appropriately explained with reference to the drawings. In addition, an explanation on the same display drive method as that of the third embodiment described above is simplified.

In the first example of the display drive method of the display apparatus 100D according to the present embodiment, the following operation is performed in one frame period Tfr. That is, the display pixels EM in a plurality of mutually adjacent (continuous) rows arranged on the display panel 110 are divided into groups as one set, the above-described non-light emitting operation and light emitting operation are simultaneously performed with respect to the display pixels EM for each group, and the above-described reverse bias setting operation and writing operation are sequentially performed with a shift of timing with respect to the display pixels EM for each row.

Specifically, in the beginning, all the display pixels EM arranged on the display panel 110 are divided into groups in advance for each of plural rows in the same manner as in the first example according to the third embodiment described above. For example, as shown in FIG. 23, the display pixels EM in twelve rows constituting the display panel 110 are divided into four groups by setting respectively three rows of display pixels EM as one set, such as mutually adjacent (continuous) first to third rows; fourth to sixth rows; and tenth to twelfth rows.

Then, in the non-light emitting operation period Tnem (denoted by outlined typefaces in the drawing) in one frame period Tfr, a single low level drive voltage Vsc (=Vs) is applied from the power source driver 130 to the power source lines VL in plural rows included in the same group of the display panel 110 via the power source line VL branched and arranged. Thereby, all the display pixels EM in the group are simultaneously set to a non-light emitting state (the non-light emitting operation is performed).

In the reverse bias setting period Tbs (denoted by slanted lines in the drawing) set at an arbitrary timing in this non-light emitting operation period Tnem (in synchronization with the start timing of the non-light emitting operation period Tnem in this embodiment), a reverse bias setting signal Vbs is applied with a shift of timing in order from the first row to the individually arranged reverse bias line BL for each row from the reverse bias driver 170. Consequently, a reverse bias voltage is applied to between the gate and the source of the display drive thin film transistor Tr13 provided on the display pixels EM in each row, thereby sequentially setting the display pixels EM to a reverse bias state. The reverse bias state set for each row is continued until a voltage component Vdata corresponding to display data (a gradation current Idata) is held in between the gate and the source of the thin film transistor Tr13 provided on the display pixels EM in each row in the writing operation described later.

Next, in the writing operation period Twrt (denoted by cross meshes in the drawing) set at an arbitrary timing after the termination of the reverse bias setting operation in each of the rows included in each group in the above-described non-light emitting operation period Tnem, a selection level scanning signal Vsel is sequentially set in order from the first row to the scanning line SL in each row from the scanning driver 120 to sequentially set the display pixels EM in each row to a selection state. In synchronization with this selection timing, the gradation current Idata having a current value corresponding to display data in each row is supplied from the data driver 140 to the data lines DL in each column, so that the writing operation is performed for holding the voltage component Vdata corresponding to the gradation current Idata in between the gate and the source of the display driver thin film transistor Tr13 provided on each of the display pixels EM in the row.

Subsequently, in the light emitting operation period Tem (denoted by a dot hatching in the drawing), a single high level drive voltage Vsc (=Ve) is applied from the power source driver 130 to the power source line VL branched and arranged in each of the rows included in a group with which the writing operation in each of the rows is terminated, whereby all the display pixels EM in the group are simultaneously set to a light emitting state (the light emitting operation is performed). The light emitting operation which is performed for each of the groups is continued until the next non-light emitting operation (including the reverse bias operation) is started with respect to each row of the group.

Hereinafter, the same operation is performed with respect to each of the groups in which the fourth to sixth rows, the seventh to ninth rows and the tenth to twelfth rows of the display pixels EM are respectively set to one set in such a manner that the above-described reverse bias setting operation and writing operation are sequentially performed with a shift of timing (are not overlapped in terms of time) with respect to each row of the display panel 110. As a consequence, image information in one screen portion of the display panel 110 is displayed.

Accordingly, since a pseudo-impulse type display drive control can be realized with such a display drive method of the display device in the same manner as in the display drive method according to the above-described first embodiment, a display apparatus can be realized in which the blurs and stains of moving images are suppressed and the clarity thereof is improved.

Furthermore, the period in which the reverse bias state set between the reverse bias setting period and the writing operation is held by individually performing the reverse setting operation and the writing operation for each row can be set to be definite for intervals between the rows. Consequently, the suppression amount of the change (Vth shift) in threshold voltage in the switching element (the thin film transistor Tr13) for display drive provided on each display pixel EM is made to be uniform, and a more favorable display image quality can be realized by allowing the organic EL element OEL to perform a light emitting operation (a display operation) with an appropriate gradation corresponding to display data.

Next, there will be explained a second example of the display drive method which can be applied to the display apparatus according to the present embodiment with reference to the drawings.

Figure 24:
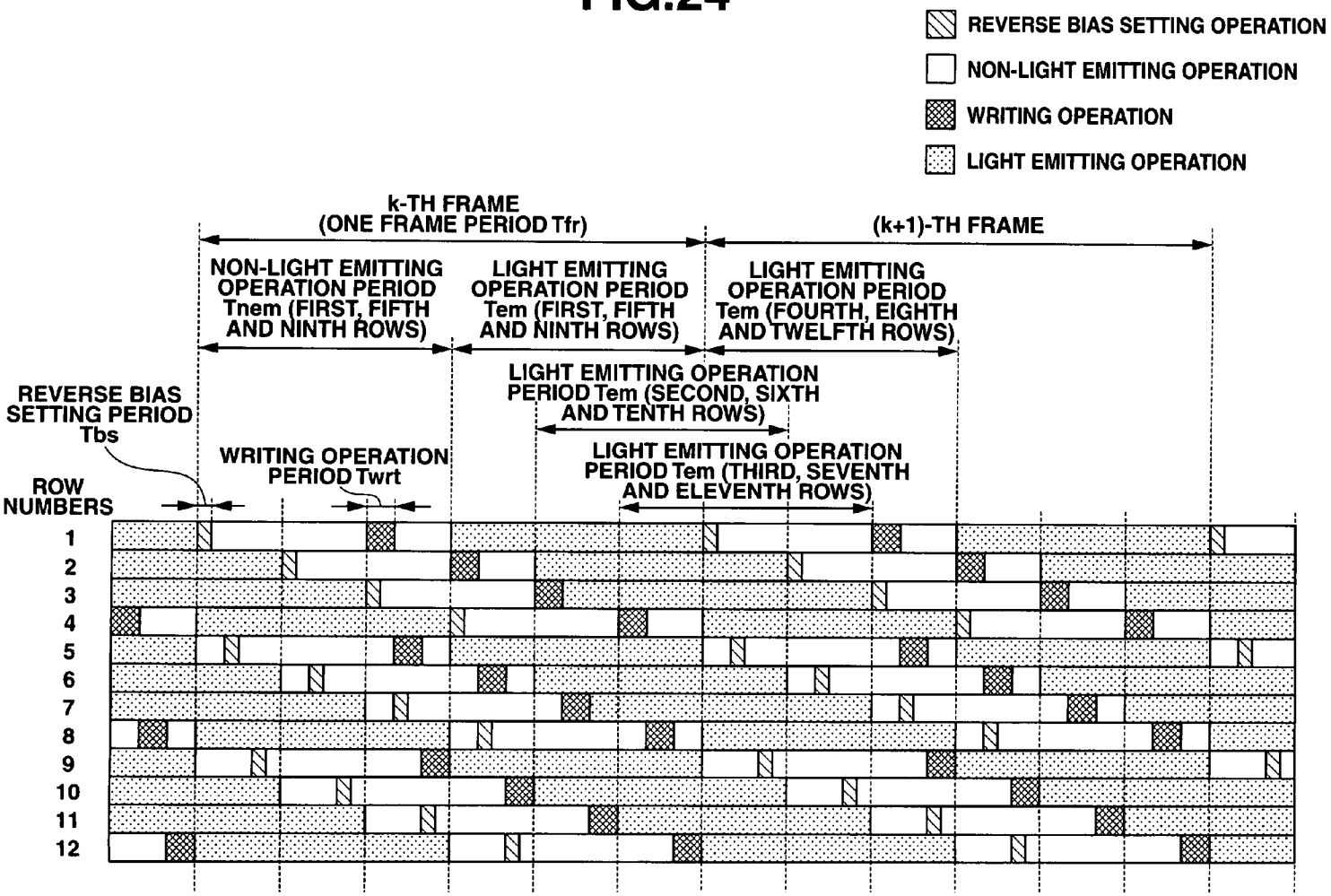
FIG. 24 is a timing chart showing a second example of the display drive method of the display apparatus according to the fourth embodiment.
Figure 25:
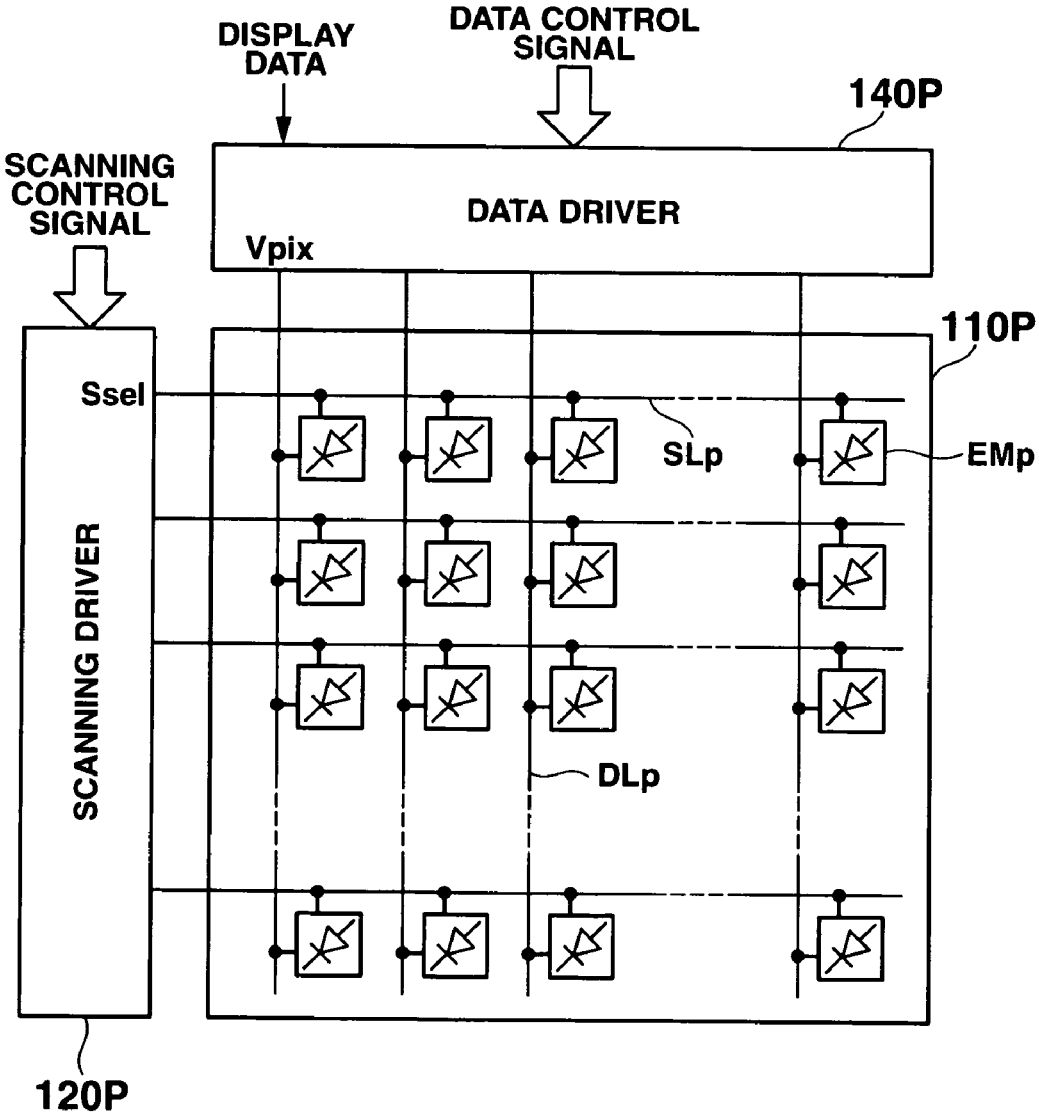
FIG.25 PRIOR ART
FIG. 25 is a conceptual structural diagram showing a primary part of a voltage control active matrix self-luminous type display in the prior art.

FIG. 24 is a timing chart showing the second example of the display drive method of the display apparatus according to the present embodiment. Here, an explanation on the display drive method same as that of the above-described first example (refer to FIG. 23) will be simplified.

In the second example of the display drive method of the display apparatus 100D according to the present embodiment, the following operation is performed in one frame period Tfr. That is, the display pixels EM in a plurality of rows which are arranged on the display panel 110 and which are not mutually adjacent (continuous) to one another are divided into groups, the above-described non-light emitting operation and light emitting operation are simultaneously performed with respect to the display pixels EM for each group, and the above-described bias setting operation and writing operation are sequentially performed with a shift of timing with respect to the display pixels EM for each row.

Specifically, as shown in, for example, FIG. 24, the display pixels EM arranged on the display panel 110 are divided into four groups by setting three rows of display pixels EM to one set as seen in mutually not adjacent (not continuous) rows such as: the first, fifth and ninth rows; the second, sixth and tenth rows; the third, seventh and eleventh rows; and the fourth, eighth and twelfth rows.

Then, for example, in a group in which the first, fifth and ninth rows of the display pixels EM are set as one set, the non-light emitting operation is simultaneously performed with respect to the display pixels EM in all the rows included in the group, and then, the reverse bias setting operation is performed with respect to the display pixels EM in an order of the first row, the fifth row and the tenth row. Thereafter, the writing operation is performed with respect to the first row, the fifth row and the tenth row and the writing operation is completed with respect to the display pixels EM in the ninth row, and then, the display pixels EM in all the rows of the first, fifth and tenth rows included in the group simultaneously perform the light emitting operation. This light emitting operation continues until the timing at which the non-light emitting operation is performed in the next frame period with respect to the display pixels EM in the first, fifth and ninth rows.

Furthermore, at a timing at which the reverse bias setting operation is completed with respect to the display pixels EM in the ninth row described above, the non-light emitting operation is simultaneously performed in the group in which the display pixels in the second, sixth and tenth rows are set to one set, and the reverse bias setting operation is performed with respect to the display pixels EM in an order of the second row, the fifth row and the tenth row. At the timing at which the writing operation is completed with respect to the display pixels EM in the ninth row described above, the non-light emitting operation, the reverse bias setting operation and the writing operation are performed at a predetermined timing in such a manner that the writing operation is performed with respect to the display pixels EM in an order of the second row, the sixth row and the tenth row in the group in which the display pixels EM in the second, sixth and tenth rows are set to one set. Hereinafter, the same operation is repeatedly performed in the group in which the third, seventh and eleventh rows are set to one set as well as the group in which the fourth, eighth and twelfth rows are set to one set.

Therefore, with such a display drive method of the display apparatus, a pseudo-impulse type display drive control is realized in the same manner as in the display drive method according to the first example described above, so that the blurs and stains of moving images can be suppressed. In the meantime, the period of holding the reverse bias state between respective rows is set, whereby the suppression amount of the change (Vth shift) in threshold voltage in the switching element (the thin film transistor Tr13) for display drive provided on each of the display pixels EM can be made uniform.

What is claimed is:

1. A display apparatus for displaying image information corresponding to display data, comprising:

a display panel including a plurality of display pixels arranged thereon in vicinities of respective intersections of a plurality of scanning lines arranged in a row direction and a plurality of data lines arranged in a column direction;

a plurality of bias lines provided on the display panel along the scanning lines, respectively;

a scanning drive unit which sequentially applies a scanning signal to each of said plurality of scanning lines and sets the display pixels corresponding to each said scanning line to a selection state;

a data drive unit which generates a gradation signal corresponding to the display data and supplies the gradation signal to the display pixels set to the selection state;

a power source drive unit which supplies to the display pixels a drive voltage for controlling a drive state of each of the display pixels;

a state setting unit; and a drive control unit which controls the power source drive unit to operate to set the display pixels to a non-display operation state during a non-display period in which the display pixels do not display the display data, and controls the scanning drive unit to operate to set the display pixels to the selection state during the non-display period, wherein each of the plurality of display pixels comprises an optical element and a display drive circuit which controls an operation of the optical element, the display drive circuit comprising an electric charge accumulation circuit which holds a voltage component corresponding to the gradation signal, a supply control circuit which generates a drive current having a predetermined current value based on the voltage component held in the electric charge accumulation circuit, and which supplies the drive current to the optical element, and a writing control circuit which controls a supply state of electric charges, based on the gradation signal, to the electric charge accumulation circuit, and wherein the state setting unit eliminates a bias state set corresponding to the display data based on the gradation signal to the display drive circuit of the display pixels in each row, generates a setting signal for setting a specific bias state, applies the setting signal to each of the bias lines, and applies the setting signal to the display pixels for each row of the display panel.

2. A drive control method of controlling a display apparatus to display image information corresponding to display data, wherein the display apparatus comprises a display panel including a plurality of display pixels arranged thereon in vicinities of intersections of a plurality of scanning lines arranged in a row direction and a plurality of data lines arranged in a column direction, and each of the plurality of display pixels has an optical element and a display drive circuit which controls an operation of the optical element, the method comprising:

sequentially setting the display pixels to a selection state, row by row;

sequentially supplying a gradation signal corresponding to the display data to the display pixels in each row set to the selection state;

setting each of the display pixels to a display operation state with said display pixels in a bias state corresponding to the gradation signal; and in a non-display period including a period in which the display pixels are set to a selection state, setting the display pixels to a non-display operation state in which the display data is not displayed, wherein the setting the display pixels to the display operation state is performed by applying to the display drive circuit a first voltage for setting the optical element to a forward bias state, and by holding a voltage component corresponding to the gradation signal in the display drive circuit, and wherein the setting of each display pixel to the non-display operation state comprises setting a specific bias state by eliminating the bias state set, corresponding to the gradation signal, to the display drive circuit of the display pixel.

3. A display apparatus for displaying image information corresponding to display data, comprising:

a display panel including a plurality of display pixels arranged thereon in vicinities of respective intersections of a plurality of scanning lines arranged in a row direction and a plurality of data lines arranged in a column direction;

a scanning drive unit which sequentially applies a scanning signal to each of said plurality of scanning lines and sets the display pixels corresponding to each said scanning line to a selection state;

a data drive unit which generates a gradation signal corresponding to the display data and supplies the gradation signal to the display pixels set to the selection state;

a power source drive unit which supplies to the display pixels a drive voltage for controlling a drive state of each of the display pixels; and a drive control unit which sets a period including a select period in which the scanning drive unit sets the display pixels to the selection state as a non-display period in which the display pixels do not display the display data, and controls a voltage value of the drive voltage supplied from the power source drive unit to set the display pixels to a non-display operation state during the non-display period, wherein each of the plurality of display pixels has an optical element and a display drive circuit which controls an operation of the optical element, the display drive circuit having a first switch circuit including a control terminal and a conduction channel having a first end and a second end, the drive voltage being applied to the first end of the conduction channel, a first end of the optical element being connected to the second end of the conduction channel, and a second end of the optical element being set to a given potential.

4. The display apparatus according to claim 3, wherein the power source drive unit selectively supplies, as the drive voltage, a first voltage for setting the display pixels to a display operation state in a bias state corresponding to the gradation signal, and a second voltage for setting the display pixels to the non-display operation state.

5. The display apparatus according to claim 4, wherein the drive control unit controls the power source drive unit to supply the first voltage as the drive voltage in a display period in which the display pixels display the display data, and to supply the second voltage as the drive voltage in the non-display period.

6. The display apparatus according to claim 3, further comprising:

a plurality of bias lines provided on the display panel along the scanning lines, respectively; and a state setting unit which eliminates a bias state set corresponding to the display data based on the gradation signal to the display drive circuit of the display pixels in each row, generates a setting signal for setting a specific bias state, applies the setting signal to each of the plurality of bias lines, and applies the setting signal to the display pixels for each row of the display panel.

7. The display apparatus according to claim 6, wherein the drive control unit controls the state setting unit to supply the setting signal to the bias lines corresponding to the display pixels during a portion of the non-display period.

8. The display apparatus according to claim 6, wherein each of the display pixels comprises:

an electric charge accumulation circuit which holds a voltage component corresponding to the gradation signal;

a supply control circuit which generates a drive current having a predetermined current value based on the voltage component held in the electric charge accumulation circuit, and which supplies the drive current to the optical element; and a writing control circuit which controls a supply state of electric charges, based on the gradation signal, to the electric charge accumulation circuit, wherein the supply control circuit includes the first switch circuit and is configured to supply the drive current to the optical element via the conduction channel, and wherein the electric charge accumulation circuit is connected to the control terminal of the first switch circuit.

9. The display apparatus according to claim 8, wherein the optical element comprises a light emitting element which performs a light emitting operation at a luminance corresponding to a value of the drive current applied thereto.

10. The display apparatus according to claim 9, wherein the data drive unit comprises a circuit which generates, as the gradation signal, a gradation current having a current value to cause the light emitting element to perform a light emitting operation with a luminance gradation corresponding to the display data.

11. The display apparatus according to claim 9, wherein the light emitting element comprises an organic electroluminescent element.

12. The display apparatus according to claim 8, wherein the display panel includes a plurality of power source lines corresponding respectively to rows of the display panel, and the drive voltage is supplied to the power source lines, and wherein the first end of the conduction channel of the first switch circuit of each of the display pixels is connected to one of the power source lines.

13. The display apparatus according to claim 12, wherein the writing control circuit of each of the display pixels comprises:

a conduction channel having a first end connected with one of the data lines and a second end connected with the control terminal of the first switch circuit of the supply control circuit via the electric charge accumulation circuit; and a control terminal connected with one of the scanning lines.

14. The display apparatus according to claim 8, wherein the display drive circuit further comprises a bias control circuit which discharges electric charges accumulated in the electric charge accumulation circuit, and applies one of no voltage and a reverse bias voltage to the supply control circuit.

15. The display apparatus according to claim 14, wherein the bias control circuit comprises:

a conduction channel having a first end connected with one of the scanning lines and a second end connected with the control terminal of the first switch circuit of the supply control circuit; and a control terminal connected with one of the bias lines.

16. The display apparatus according to claim 14, wherein the display drive circuit comprises:

a second switch circuit including a control terminal connected with one of the scanning lines, and a conduction channel having a first end to which the drive voltage is applied and a second end to which a control terminal of the first switch circuit is connected;

a third switch circuit including a control terminal connected with one of the scanning lines, and a conduction channel having a first end to which one of the data lines is connected and a second end to which a connection contact point is connected;

a capacitance element connected between the control terminal of the first switch circuit and the connection contact point; and a fourth switch circuit including a control terminal connected with one of the bias lines, and a conduction channel having a first end connected with one of the scanning lines and a second end connected with the control terminal of the first switch circuit, wherein the bias control circuit comprises the fourth switch circuit, and wherein the electric charge accumulation circuit comprises the capacitance element.

17. The display apparatus according to claim 16, wherein each of the first through fourth switch circuits comprises an amorphous silicon thin film transistor.

18. The display apparatus according to claim 4, wherein said plurality of image pixels of the display panel are divided into a plurality of groups each including a plurality of rows, and wherein the drive control unit controls the power source drive unit to supply the first voltage to the display pixels for each said group as the drive voltage in a display period for operating the display pixels to display the display data, and, within each said group, simultaneously sets the display pixels to a display operation state.

19. The display apparatus according to claim 18, wherein the plurality of rows of each said group comprises a plurality of adjacent rows.

20. The display apparatus according to claim 18, wherein the plurality of rows of each said group comprises a plurality of separated rows.

21. The display apparatus according to claim 18, wherein the drive control unit controls the power source drive unit to supply the second voltage to the display pixels for each said group as the drive voltage in the non-display period, and, within each said group, simultaneously sets the display pixels to the non-display operation state.

22. The display apparatus according to claim 21, wherein the display panel includes a plurality of power source lines corresponding respectively to rows of the display panel, and the drive voltage is applied via the power source lines, wherein the power source lines are divided into groups in correspondence to the plurality of rows of each said group, and wherein, within each said group, the power source drive unit commonly supplies the drive voltage to each of the power source lines in the group, and simultaneously supplies the drive voltage to the display pixels in the group.

23. The display apparatus according to claim 18, further comprising:

a plurality of bias lines provided on the display panel along the scanning lines, respectively; and a state setting unit which eliminates a bias state set corresponding to the display data based on the gradation signal to the display drive circuit of the display pixels in each row, generates a setting signal for setting a specific bias state, and applies the setting signal to each of the bias lines;

wherein the plurality of bias lines are divided into groups each including a plurality of bias lines corresponding to the plurality of rows of each said group, and wherein, within each said group, the state setting unit supplies the setting signal to said plurality of bias lines in the group, and simultaneously supplies the setting signal to said plurality of display pixels in the group.

24. The display apparatus according to claim 18, further comprising:

a plurality of bias lines provided on the display panel along the scanning lines, respectively; and a state setting unit which eliminates a bias state set corresponding to the display data based on the gradation signal to the display drive circuit of the display pixels in each row, generates a setting signal for setting a specific bias state, and applies the setting signal to each of the bias lines;

wherein the state setting unit sequentially supplies the setting signal to the plurality of bias lines corresponding to the plurality of rows of each said group, and, within each said group, sequentially supplies the setting signal to the display pixels in the plurality of rows in the group.

25. A drive control method of controlling a display apparatus to display image information corresponding to display data, wherein the display apparatus comprises a display panel including a plurality of display pixels arranged thereon in vicinities of intersections of a plurality of scanning lines arranged in a row direction and a plurality of data lines arranged in a column direction, and wherein each of the plurality of display pixels has an optical element and a display drive circuit which controls an operation of the optical element, the display drive circuit having a first switch circuit including a control terminal and a conduction channel having a first end and a second end, a drive voltage being applied to the first end of the conduction channel, a first end of the optical element being connected to the second end of the conduction channel, and a second end of the optical element being set to a given potential, the method comprising:

sequentially setting the display pixels to a selection state, row by row;

sequentially supplying a gradation signal corresponding to the display data to the display pixels in each row set to the selection state;

in a display period, supplying as the drive voltage a voltage which sets each of the display pixels to a display operation state, and setting the display drive circuit of each of the display pixels to the display operation state in a bias state corresponding to the gradation signal; and in a non-display period including a period in which the display pixels are set to the selection state, supplying as the drive voltage a voltage which sets each of the display pixels to a non-display operation state, and setting each of the display pixels to the non-display operation state in which the display data is not displayed.

26. The drive control method according to claim 25, wherein the setting of each display pixel to the display operation state comprises supplying to the display pixel a first voltage for setting the optical element to a forward bias, as the drive voltage, and wherein the setting of each display pixel to the non-display operation state comprises supplying to the display pixel a second voltage for setting the optical element to the non-display operation state, as the drive voltage.

27. The drive control method according to claim 25, wherein the setting of each display pixel to the non-display operation state comprises setting the display pixel to a specific bias state by eliminating the bias state corresponding to the gradation signal set in the display pixel.

28. The drive control method according to claim 27, wherein the setting the display pixel to the specific bias state is performed by applying one of a no-voltage and a reverse bias voltage.

29. The drive control method according to claim 27, wherein the setting the display pixels to the display operation state is performed by applying to the display drive circuit a first voltage for setting the optical element to a forward bias state, as the drive voltage, and by holding a voltage component corresponding to the gradation signal in the display drive circuit.

30. The drive control method according to claim 29, wherein the setting the display pixels to the specific bias state is performed by discharging the voltage component held in the display drive circuit, and by applying and holding one of a no-voltage and a reverse bias voltage in the display drive circuit.

31. The drive control method according to claim 29, wherein the optical element comprises a light emitting element which performs a light emitting operation at a luminance corresponding to a current value of a current applied thereto, and wherein the display pixels are caused to perform a display operation by causing the light emitting element to perform a light emitting operation with a luminance gradation corresponding to the gradation signal.

32. The drive control method according to claim 31, wherein the light emitting element comprises an organic electroluminescent element.

33. The drive control method according to claim 31, wherein the supplying the gradation signal to the display pixels comprises supplying to the display pixels a gradation current having a current value which causes the light emitting element to perform the light emitting operation with a luminance gradation corresponding to the display data.

34. The drive control method according to claim 25, wherein said plurality of display pixels of the display panel are divided into a plurality of groups, each including a plurality of rows, and wherein the setting the display pixels to the display operation state comprises supplying to the display pixels for each said group a first voltage for setting the optical element to a forward bias, as the drive voltage, such that, within each said group, the display pixels are simultaneously set to the display operation state.

35. The drive control method according to claim 34, wherein the plurality of rows of each said group comprises a plurality of continuous rows.

36. The drive control method according to claim 34, wherein the plurality of rows of each said group comprises a plurality of separated rows.

37. The drive control method according to claim 34, wherein the setting the display pixels to the non-display operation state comprises supplying to the display pixels for each said group a second voltage for setting the optical element to the non-display operation state, as the drive voltage, such that, within each said group, the display pixels are simultaneously set to the non-display operation state.

38. The drive control method according to claim 34, wherein the setting the display pixels to the non-display operation state comprises eliminating the bias state corresponding to the gradation signal set to the display pixels to set the display pixels to a specific bias state.

39. The drive control method according to claim 38, wherein the operation of setting the display pixels to the specific bias state comprises, within each said group, simultaneously setting said plurality of display pixels to the specific bias state.

40. The drive control method according to claim 38, wherein the setting the display pixels to the specific bias state comprises, within each said group, sequentially setting rows of the display pixels to the specific bias state.

* * * * *